US010610797B2

(12) United States Patent
Weisman et al.

(10) Patent No.: US 10,610,797 B2
(45) Date of Patent: Apr. 7, 2020

(54) WATER TOY

(71) Applicant: GLOBAL MARKETING ENTERPRISE (GME) LTD., Tel Aviv (IL)

(72) Inventors: Zafrira Weisman, Tel Aviv (IL); Israel Zanger, Tel Aviv (IL)

(73) Assignee: Global Marketing Enterprise (GME) LTD. (IL)

( * ) Notice: Subject to any disclaimer, the term of this patent is extended or adjusted under 35 U.S.C. 154(b) by 0 days.

(21) Appl. No.: 15/852,397

(22) Filed: Dec. 22, 2017

(65) Prior Publication Data

US 2018/0117483 A1 May 3, 2018

Related U.S. Application Data

(62) Division of application No. 15/307,306, filed as application No. PCT/IL2015/050935 on Sep. 10, 2015, now Pat. No. 10,010,800.

(Continued)

(51) Int. Cl.

| | |
|---|---|
| ***A63H 23/10*** | (2006.01) |
| ***A63H 23/14*** | (2006.01) |
| *A63H 23/16* | (2006.01) |

(52) U.S. Cl.

CPC ..... *A63H 23/14* (2013.01); *A63H 23/10* (2013.01)

(58) Field of Classification Search

CPC ..... A63H 23/00; A63H 23/10; A63H 23/08; A63H 23/16; A63G 31/007; B05B 1/00; B05B 12/002

(Continued)

(56) References Cited

U.S. PATENT DOCUMENTS

| | | | |
|---|---|---|---|
| 2,511,323 | A | 6/1950 | Briggs et al. |
| 2,787,863 | A | 4/1957 | Laird |

(Continued)

FOREIGN PATENT DOCUMENTS

| | | |
|---|---|---|
| CN | 2170133 Y | 6/1994 |
| CN | 101041105 | 9/2007 |

(Continued)

OTHER PUBLICATIONS

Waterway Pipe Builders, Lakeshore website, printed 2015.

(Continued)

*Primary Examiner* — Kien T Nguyen

(74) *Attorney, Agent, or Firm* — McDonnell Boehnen Hulbert & Berghoff LLP

(57) ABSTRACT

A mutually opposite generally horizontal gravity-driven flow water toy including at least first and second water inlets, at least first and second generally vertical water conduits coupled to respective ones of the at least first and second water inlets for directing a gravity flow of water therethrough from the respective ones of the first and second water inlets, at least first and second generally horizontal water conduits coupled to respective ones of the at least first and second generally vertical water conduits for directing a gravity flow of water therethrough from the respective ones of the first and second water inlets and via respective ones of the at least first and second generally vertical water conduits, the at least first and second generally horizontal water conduits being arranged such that the gravity flow of water therethrough is in generally opposite directions.

23 Claims, 70 Drawing Sheets

Related U.S. Application Data

(60) Provisional application No. 62/048,694, filed on Sep. 10, 2014.

(58) Field of Classification Search
USPC ..... 446/71, 74, 153–163, 267, 475, 483; 472/117, 128; 239/211, 251, 195
See application file for complete search history.

(56) References Cited

U.S. PATENT DOCUMENTS

| | | | | |
|---|---|---|---|---|
| 4,846,751 | A | 7/1989 | Kosoris | |
| 4,951,329 | A | 8/1990 | Shaw | |
| 4,963,116 | A | 10/1990 | Huber | |
| 5,049,080 | A | 9/1991 | Kriebel | |
| 5,093,943 | A | 3/1992 | Wei | |
| 5,114,375 | A | 5/1992 | Wellhausen et al. | |
| 5,251,345 | A | 10/1993 | Pechner | |
| 5,385,472 | A | 1/1995 | Mullin | |
| 6,049,919 | A | 4/2000 | Roteman | |
| 6,370,713 | B2 | 4/2002 | Bosio | |
| 6,739,979 | B2 * | 5/2004 | Tracy | B05B 17/08 472/117 |
| 6,782,567 | B1 | 8/2004 | Austin et al. | |
| 7,111,795 | B2 * | 9/2006 | Thong | B05B 1/1636 239/222.15 |
| 7,757,963 | B2 | 7/2010 | Kiolbassa et al. | |
| 7,941,968 | B1 | 5/2011 | Coyle | |
| 7,987,533 | B2 | 8/2011 | Phipps et al. | |
| 8,221,184 | B2 | 7/2012 | Nuttall et al. | |
| 2003/0027648 | A1 | 2/2003 | Hunter | |
| 2005/0263613 | A1 | 12/2005 | Beck et al. | |
| 2006/0226262 | A1 | 10/2006 | Chuang | |
| 2008/0227364 | A1 | 9/2008 | Todokoro | |
| 2009/0000022 | A1 | 1/2009 | Phipps et al. | |
| 2010/0273392 | A1 | 10/2010 | Nuttall | |
| 2012/0178336 | A1 | 7/2012 | Nuttall et al. | |

FOREIGN PATENT DOCUMENTS

| | | | |
|---|---|---|---|
| CN | 202341889 | | 7/2012 |
| DE | 10 2007 010 964 | A1 | 9/2008 |
| GB | 2301540 | A | 11/1996 |
| JP | 361 | | 6/1887 |
| JP | S43-19970 | | 8/1968 |
| JP | S55-158799 | | 11/1980 |
| JP | U11987200394 | | 12/1987 |
| JP | H01297026 | A | 11/1989 |
| JP | H0284915 | A | 3/1990 |
| JP | H04277383 | A | 10/1992 |
| JP | 3039377 | | 7/1997 |
| JP | 2008-55070 | | 3/2008 |
| JP | 2006223756 | A | 8/2008 |
| JP | 2012-223307 | | 11/2012 |
| WO | 2014/195940 | A1 | 12/2014 |

OTHER PUBLICATIONS

The International Search Report with Written Opinion for PCT/IL2015/050935, dated Feb. 25, 2016, pp. 1-17.
An Office Action dated Jun. 7, 2017, which issued during the prosecution of U.S. Appl. No. 15/307,312.
Partial European Search Report dated May 23, 2018, which issued during the prosecution of Applicant's European App No. 15840310.5.
An Office Action together with the English translation dated Dec. 7, 2018 which issued during the prosecution of Chinese Patent Application No. 201580022183.X.
European Search Report dated Oct. 9, 2018 which issued during the prosecution of Applicant's European App No. 15839689.5.
Office Action dated Oct. 12, 2018, which issued during the prosecution of U.S. Appl. No. 15/852,362.
V Peryshkin, Physics. 7th grade: textbook for general educational institutions, 2nd edition, stereotype., Moscow Drofa, 2013, p. 120-123, fig. 118 and 123.
An English translation of an Office Action dated Aug. 7, 2018, which issued during the prosecution of Japanese Patent Application No. 2016-567618.

* cited by examiner 944
902
904
916
914
954
922
912
946
948
952
918
900
910
950
B
B
924
920

900
934
910
918
902
912
920
904
916
914
922
924
B
B 902
904
912
914
922
924
900
934
910
918
940
942

900
934
910
902
944
912
918
920
922
914
904
956
916
924
B
B 900
934
910
950
940
962
942
952
964
918
948
912
946
902
944
920
922
960
958
954
914
956
904
916
924

1270
1224

1270
1224

1270
1250

1270
1250

1634
1624
1622
1632
1626
1636

1634
1624
1622
1632
1626
1636

1634
1624
1622
1632
1626
1636

1634
1624
1622
1632
1626
1636

1758
1754
1758
1758
1758
1758
A
A 1760
1754

1760
1758
1758
1758
1758
1754
1758
B
B

WATER TOY

REFERENCE TO RELATED APPLICATIONS

This application is a divisional application of U.S. patent application Ser. No. 15/307,306, filed Oct. 27, 2016, entitled "WATER TOY", which is a National Phase Application of International Patent Application No. PCT/IL2015/050935, filed Sep. 10, 2015, entitled "WATER TOY", which claims priority of U.S. Provisional Patent Application Ser. No. 62/048,694, filed Sep. 10, 2014 and entitled "SPRAY STATION WATER TOY AND METHOD OF USE", the disclosures of which are hereby incorporated by reference.

FIELD OF THE INVENTION

The present invention relates to water toys and more particularly to bath toys.

BACKGROUND OF THE INVENTION

Various types of bath toys are known.

SUMMARY OF THE INVENTION

The present invention seeks to provide improved bath toys.

There is thus provided in accordance with a preferred embodiment of the present invention a mutually opposite generally horizontal gravity-driven flow water toy including at least first and second water inlets, at least first and second generally vertical water conduits coupled to respective ones of the at least first and second water inlets for directing a gravity flow of water therethrough from the respective ones of the first and second water inlets, at least first and second generally horizontal water conduits coupled to respective ones of the at least first and second generally vertical water conduits for directing a gravity flow of water therethrough from the respective ones of the first and second water inlets and via respective ones of the at least first and second generally vertical water conduits, the at least first and second generally horizontal water conduits being arranged such that the gravity flow of water therethrough is in generally opposite directions.

Preferably, the at least first and second generally horizontal water conduits are mutually parallel. Additionally or alternatively, the first and second generally horizontal water conduits are integrally formed with each other. Additionally or alternatively, the first and second generally horizontal water conduits are defined within a common outer generally horizontal conduit.

In accordance with a preferred embodiment of the present invention the mutually opposite generally horizontal gravity-driven flow water toy also includes a first water turbine driven by a gravity flow of water from the first water inlet via the first water conduit and driving a visually sensible fanciful moving display, a second water turbine driven by a gravity flow of water from the second water inlet via the second water conduit, the second water turbine being visible and child engageable and stoppable.

Preferably, the mutually opposite generally horizontal gravity-driven flow water toy also includes a first water turbine driven by a gravity flow of water from the first water inlet via the first water conduit and driving a visually sensible fanciful moving display. Additionally or alternatively, the second water conduit receiving water includes a plurality of spray exit apertures therein.

In accordance with a preferred embodiment of the present invention the mutually opposite generally horizontal gravity-driven flow water toy also includes a first water turbine assembly driven by a gravity flow of water from the first water inlet via the first water conduit and driving a visually sensible fanciful moving display, a second water turbine assembly driven by a gravity flow of water from the second water inlet via the second water conduit, the second water turbine assembly being visible and child engageable and stoppable, a third water conduit coupled to the second water receptacle, a third water turbine assembly driven by a gravity flow of water from the second water inlet via the first water conduit and driving a visually sensible fanciful moving display and a fourth water conduit receiving water from the first water receptacle and having a plurality of spray exit apertures therein.

There is also provided in accordance with another preferred embodiment of the present invention a water impingement driven toy including a plurality of mutually interdigitated water spray drivable wheels arranged for rotation in a generally vertical plane in response to impingement thereof of a flow of water, and a plurality of rotatable hubs onto which the mutually interdigitated water spray drivable wheels are mounted, the plurality of rotatable hubs being arranged for rotation about generally horizontally axes, each of the plurality of hubs having a different geometrical outer circumferential configuration; each of the plurality of mutually interdigitated water spray drivable wheels having a different geometrical inner circumferential configuration corresponding to one of the geometrical outer circumferential configurations of the plurality of hubs, thus enabling one of the wheels to be mounted by a child only onto a hub having a corresponding geometrical configuration.

There is further provided in accordance with yet another preferred embodiment of the present invention a water toy including a source of pressurized water and a nozzle receiving the source of pressurized water and having plural nozzle outlets including at least one principal nozzle outlet and at least one secondary nozzle outlet which are interconnected with the source of pressurized water such that when the principal nozzle outlet is not blocked, water is expelled only from the at least one principal outlet and water is expelled from the at least one secondary nozzle outlet only when the at least one principal outlet is blocked.

Preferably, the at least one principal nozzle outlet is normally open and may be selectably manually blocked by a child, thereby causing water to expelled from the at least one secondary nozzle outlet. Alternatively, the at least one principal nozzle outlet normally blocked, whereby water is normally expelled from the at least one secondary outlet and the at least one principal nozzle outlet may be selectably opened by a child, thereby causing water to be expelled from the at least one principal outlet.

In accordance with a preferred embodiment of the present invention the source of pressurized water is a submerged pump. Additionally or alternatively, the source of pressurized water and the nozzle are mounted on a floatable platform.

Preferably, the at least one principal nozzle outlet is upwardly facing. Alternatively, the at least one principal nozzle outlet is downwardly facing.

In accordance with a preferred embodiment of the present invention the source of pressurized water is a submersible water pump coupled to a flexible conduit for providing a pressurized water flow therethrough and the nozzle is a child hand holdable water spray nozzle coupled to the flexible conduit for receiving the pressurized water flow and having a child hand operable water flow switch including a pair of oppositely directed squeezable button elements governing output of water through the nozzle from the pressurized water flow, the child hand operable water flow switch being electrically connected to an electrical water flow controller and to a source of electrical power via an electrical conductor conduit extending through the flexible conduit.

In accordance with a preferred embodiment of the present invention the water toy also includes at least first and second water inlets for receiving a flow of water from the nozzle, at least first and second generally vertical water conduits coupled to respective ones of the at least first and second water inlets for directing a gravity flow of water therethrough from the respective ones of the first and second water inlets and at least first and second generally horizontal water conduits coupled to respective ones of the at least first and second generally vertical water conduits for directing a gravity flow of water therethrough from the respective ones of the first and second water inlets and via respective ones of the at least first and second generally vertical water conduits, the at least first and second generally horizontal water conduits being arranged such that the gravity flow of water therethrough is in generally opposite directions.

Preferably, the water toy also includes a water receptacle arranged to receive a flow of water from the nozzle, a first water conduit coupled to the water receptacle, a first water turbine driven by a gravity flow of water from the water receptacle via the first water conduit and driving a visually sensible fanciful moving display, a second water conduit receiving water from the first water receptacle and a second water turbine driven by a gravity flow of water from the water receptacle via the second water conduit, the second water turbine being visible and child engageable and stoppable.

There is yet further provided in accordance with still another preferred embodiment of the present invention a water toy including a submersible water pump coupled to a flexible conduit for providing a pressurized water flow therethrough and a child hand holdable water spray nozzle coupled to the flexible conduit for receiving the pressurized water flow and having a child hand operable water flow switch including a pair of oppositely directed squeezable button elements governing output of water through the nozzle from the pressurized water flow, the child hand operable water flow switch being electrically connected to an electrical water flow controller and to a source of electrical power via an electrical conductor conduit extending through the flexible conduit.

There is even further provided in accordance with yet another preferred embodiment of the present invention a water toy including a submersible water pump coupled to a flexible conduit for providing a pressurized water flow therethrough, a child hand holdable water spray nozzle coupled to the first conduit for receiving the pressurized water flow and having a child hand operable water flow switch governing output of water through the nozzle from the pressurized water flow, the child hand operable water flow switch being electrically connected to an electrical water flow controller and to a source of electrical power and a flexible security element, extending through the flexible conduit and securely attached at ends thereof to the submersible water pump and the spray nozzle.

Preferably, the water toy also includes a water receptacle arranged to receive a flow of water, a first water conduit coupled to the water receptacle, a first water turbine driven by a gravity flow of water from the water receptacle via the first water conduit and driving a visually sensible fanciful moving display, a second water conduit receiving water from the first water receptacle and a second water turbine driven by a gravity flow of water from the water receptacle via the second water conduit, the second water turbine being visible and child engageable and stoppable.

In accordance with a preferred embodiment of the present invention the water toy also includes a water receptacle arranged to receive a flow of water, a first water conduit coupled to the water receptacle, a first water turbine driven by a gravity flow of water from the water receptacle via the first water conduit and driving a visually sensible fanciful moving display and a second water conduit receiving water from the first water receptacle and having a plurality of spray exit apertures therein.

Preferably, the water toy also includes a first water receptacle arranged to receive a flow of water, a first water conduit coupled to the first water receptacle, a first water turbine assembly driven by a gravity flow of water from the water receptacle via the first water conduit and driving a visually sensible fanciful moving display, a second water conduit receiving water from the first water receptacle, a second water turbine assembly driven by a gravity flow of water from the water receptacle via the second water conduit, the second water turbine assembly being visible and child engageable and stoppable, a second water receptacle arranged to receive a flow of water, a third water conduit coupled to the second water receptacle, a third water turbine assembly driven by a gravity flow of water from the second water receptacle via the first water conduit and driving a visually sensible fanciful moving display and a fourth water conduit receiving water from the first water receptacle and having a plurality of spray exit apertures therein.

In accordance with a preferred embodiment of the present invention the first and second water conduits together include at least first and second generally vertical water conduits for directing a gravity flow of water therethrough and at least first and second generally horizontal water conduits coupled to respective ones of the at least first and second generally vertical water conduits for directing a gravity flow of water therethrough, the at least first and second generally horizontal water conduits being arranged such that the gravity flow of water therethrough is in generally opposite directions. Additionally, the at least first and second generally horizontal water conduits are mutually parallel. Additionally or alternatively, the first and second generally horizontal water conduits are integrally formed with each other. Alternatively or additionally, the first and second generally horizontal water conduits are defined within a common outer generally horizontal conduit.

BRIEF DESCRIPTION OF THE DRAWINGS

The present invention will be understood and appreciated more fully from the following detailed description, taken in conjunction with the drawings in which.

Figure 19:
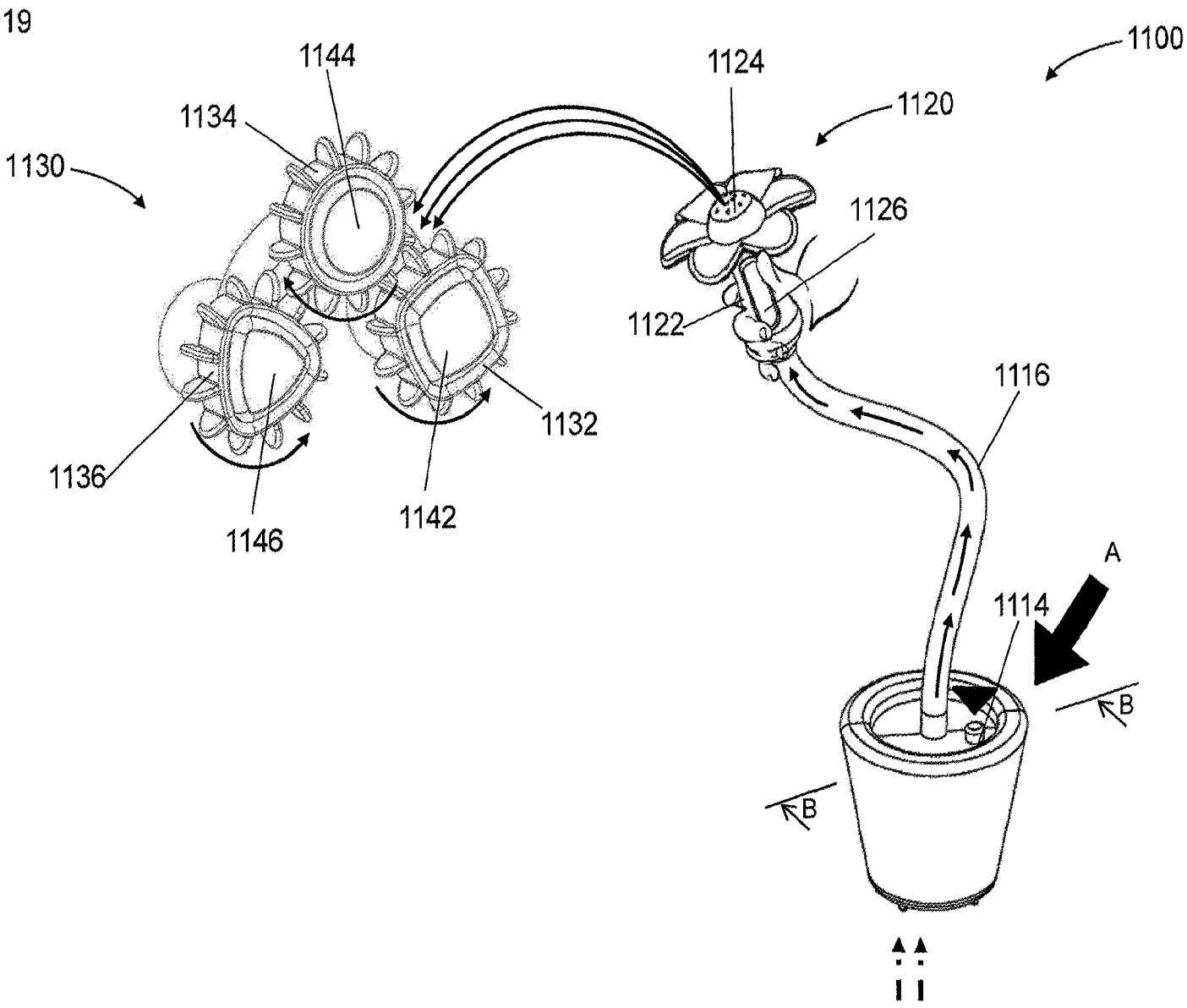
FIG. 19 is a simplified pictorial illustration of a combination pumped flow and gravitational flow bath toy system constructed and operative in accordance with another preferred embodiment of the present invention.
Figures 25A, 25B, 25C, 25D:
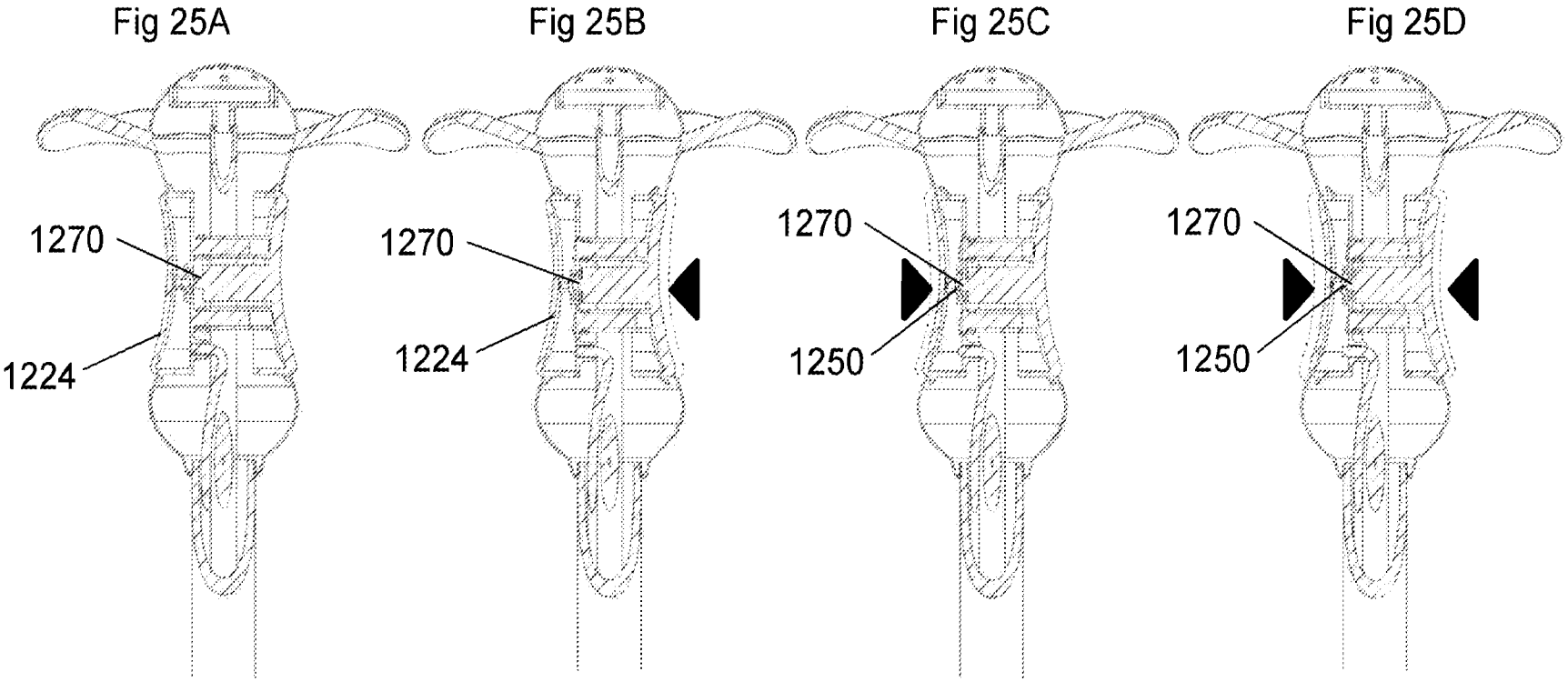
FIGS. 25A, 25B, 25C and 25D are simplified sectional illustrations corresponding to FIGS. 24A, 24B, 24C and 24D, taken along section lines B-B in FIG. 23A.
Figure 26A:
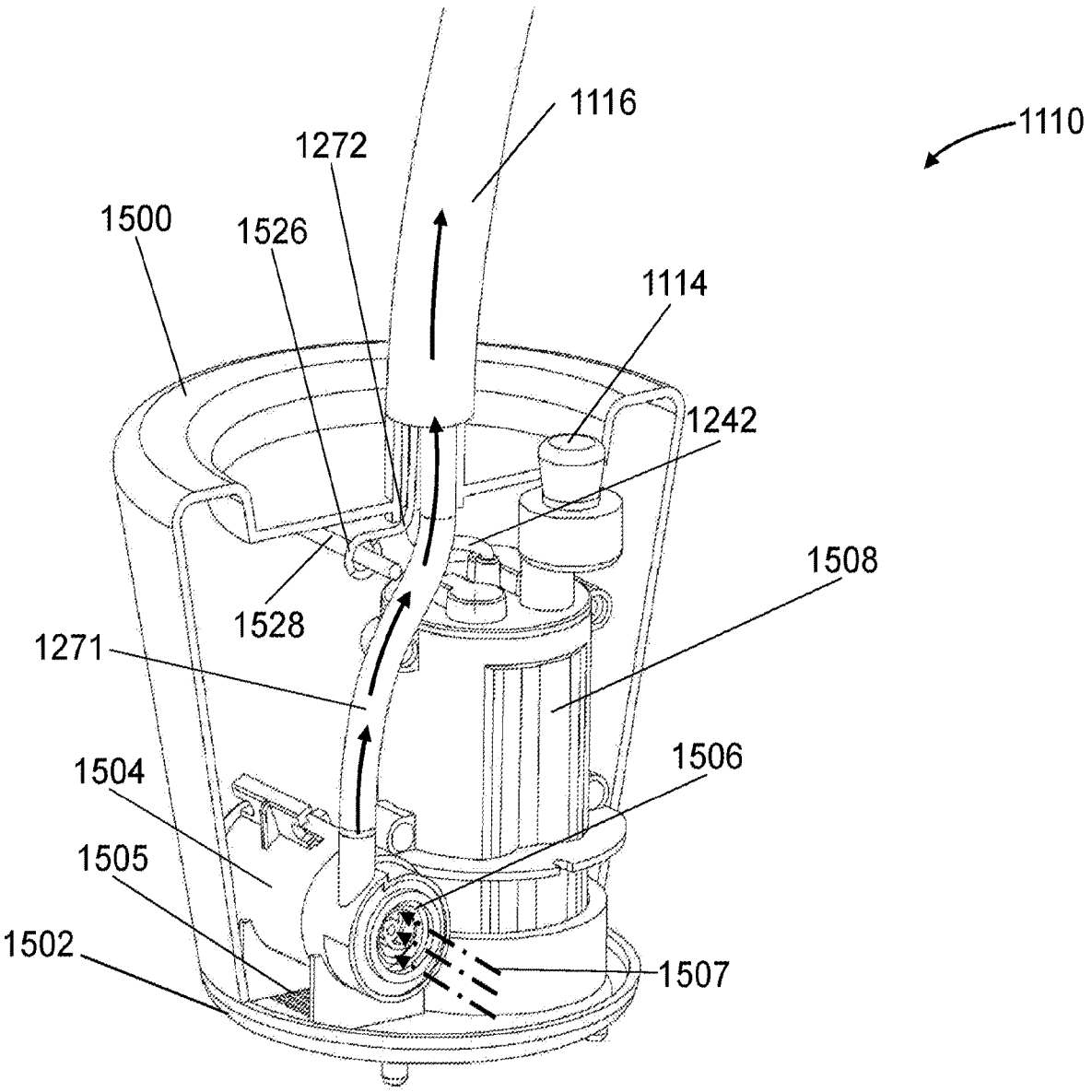
FIGS. 26A, 26B and 26C are, respectively, a simplified partially cut-away illustration of the pump portion taken in a direction indicated by an arrow A in FIG. 19, a simplified sectional illustration of a pump portion of the combination pumped flow and gravitational flow bath toy system of FIG.
Figure 26B:
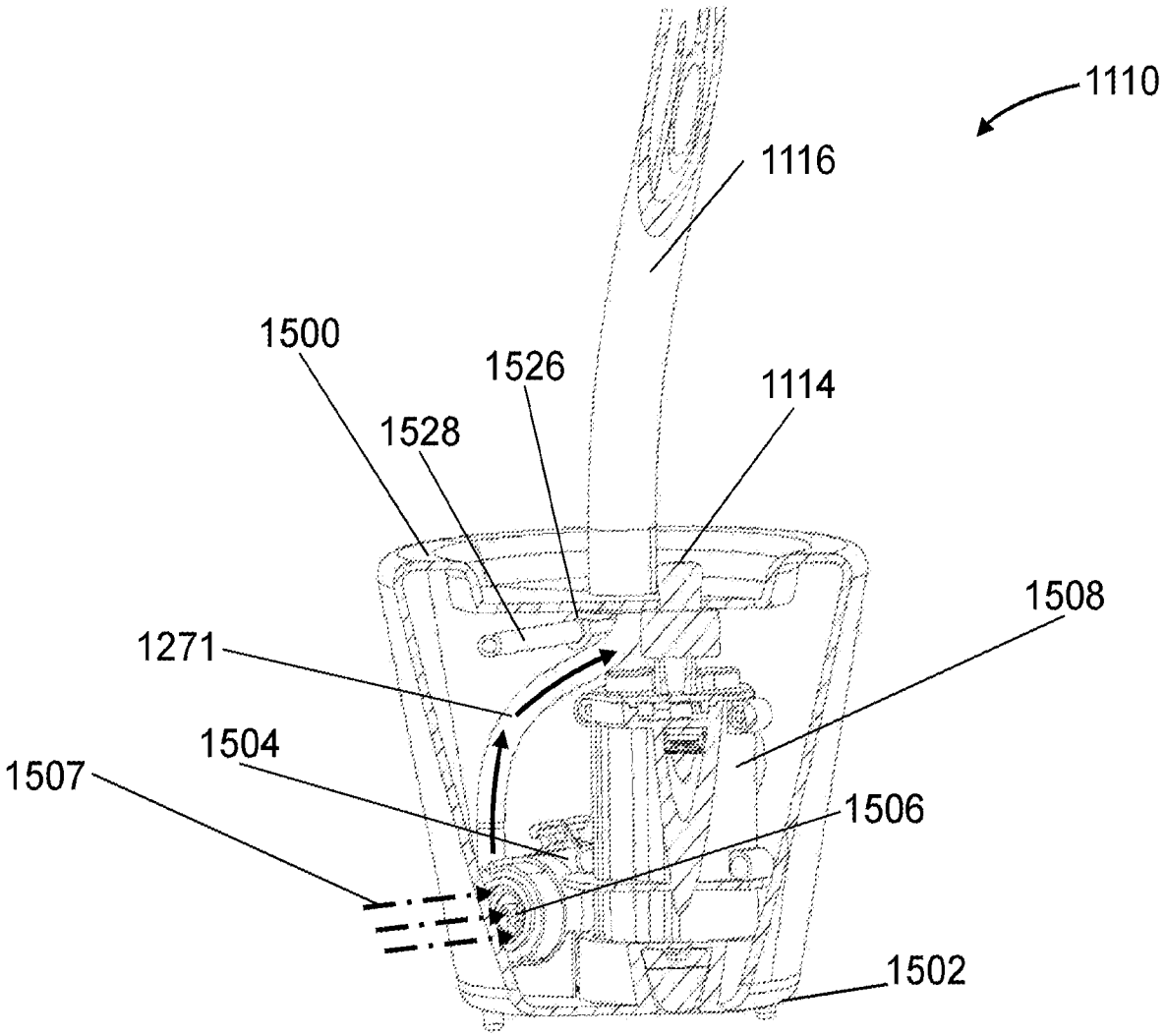
Figure 26C:
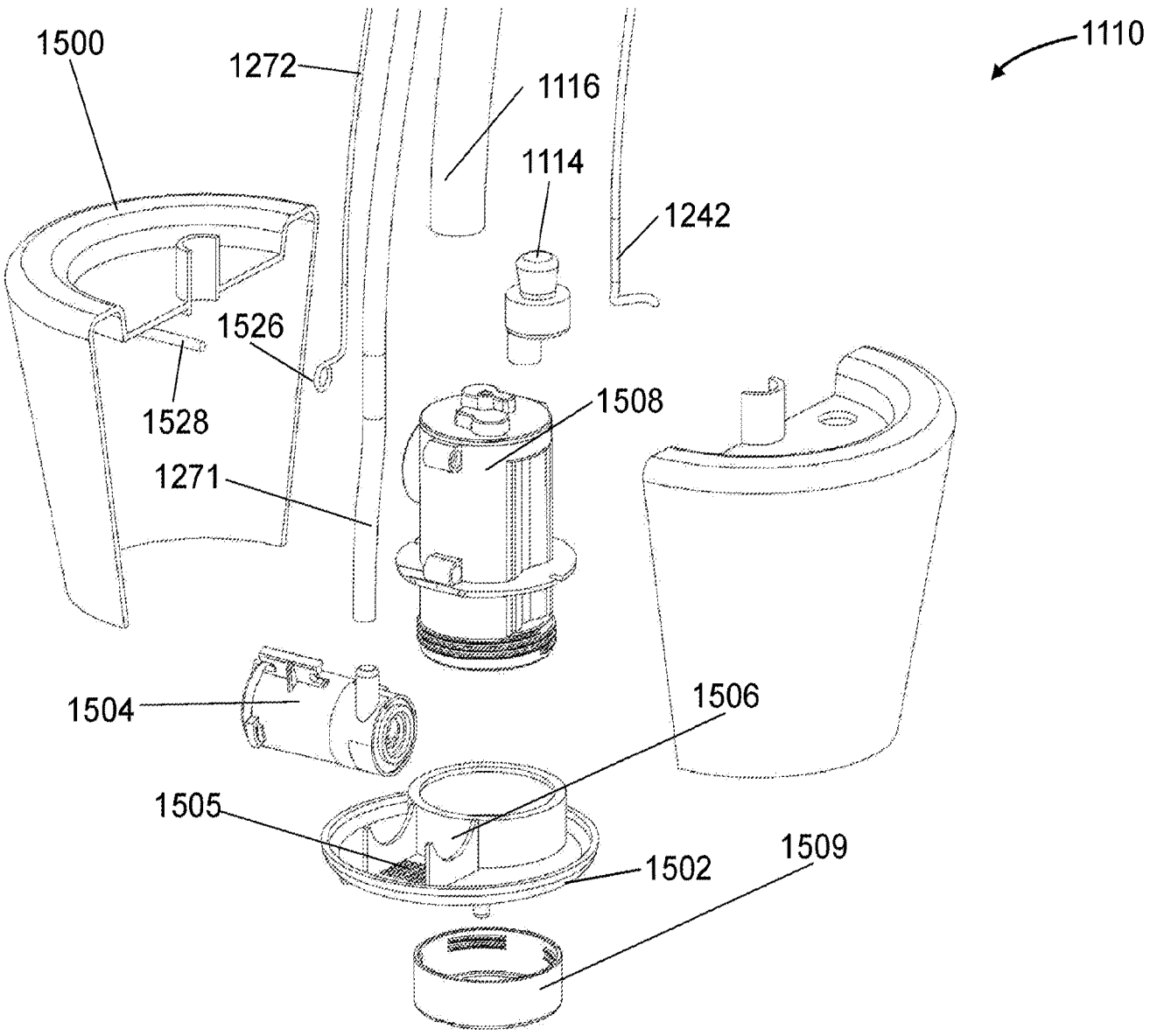
Figure 27:
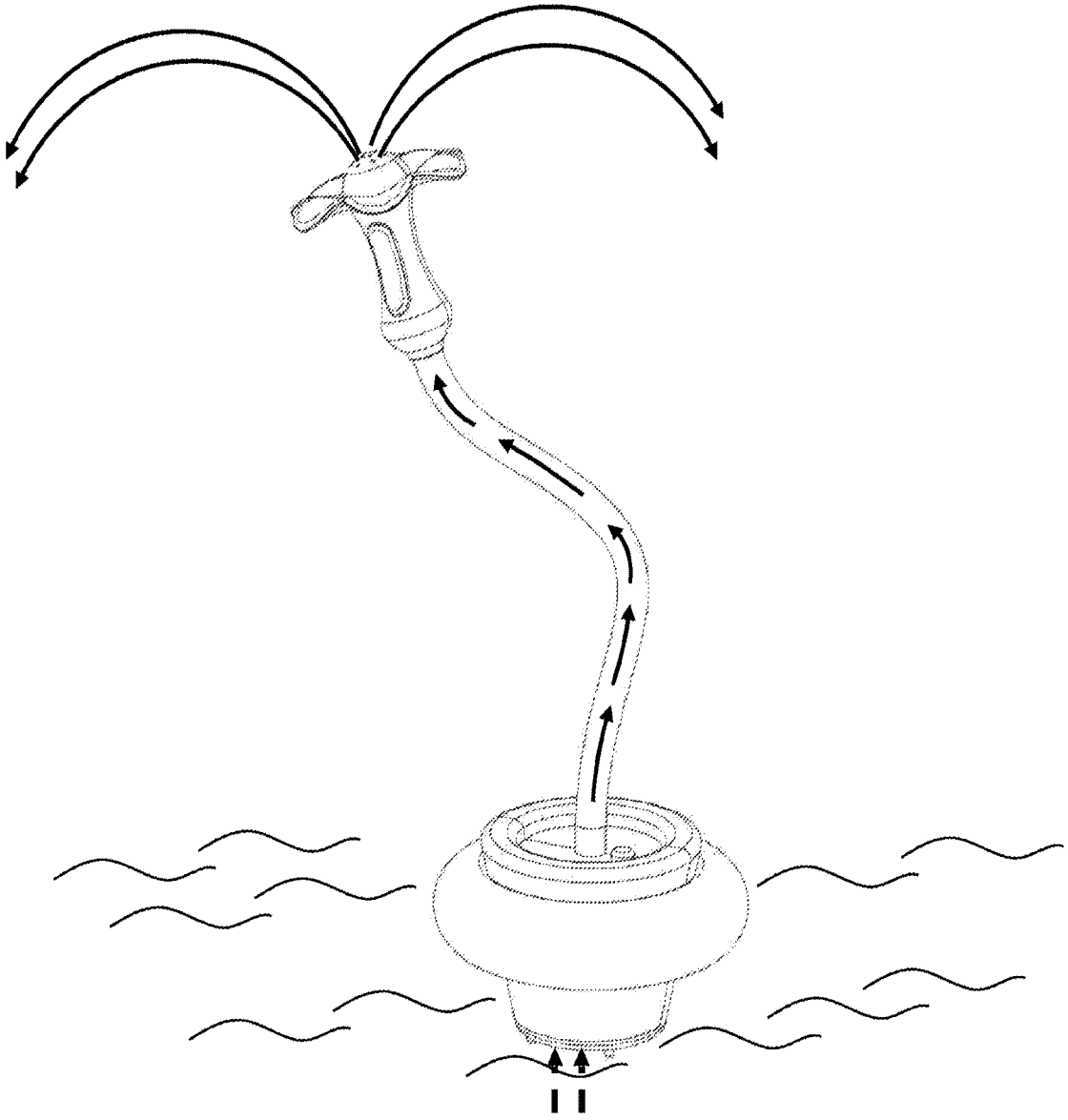
Figure 28A:
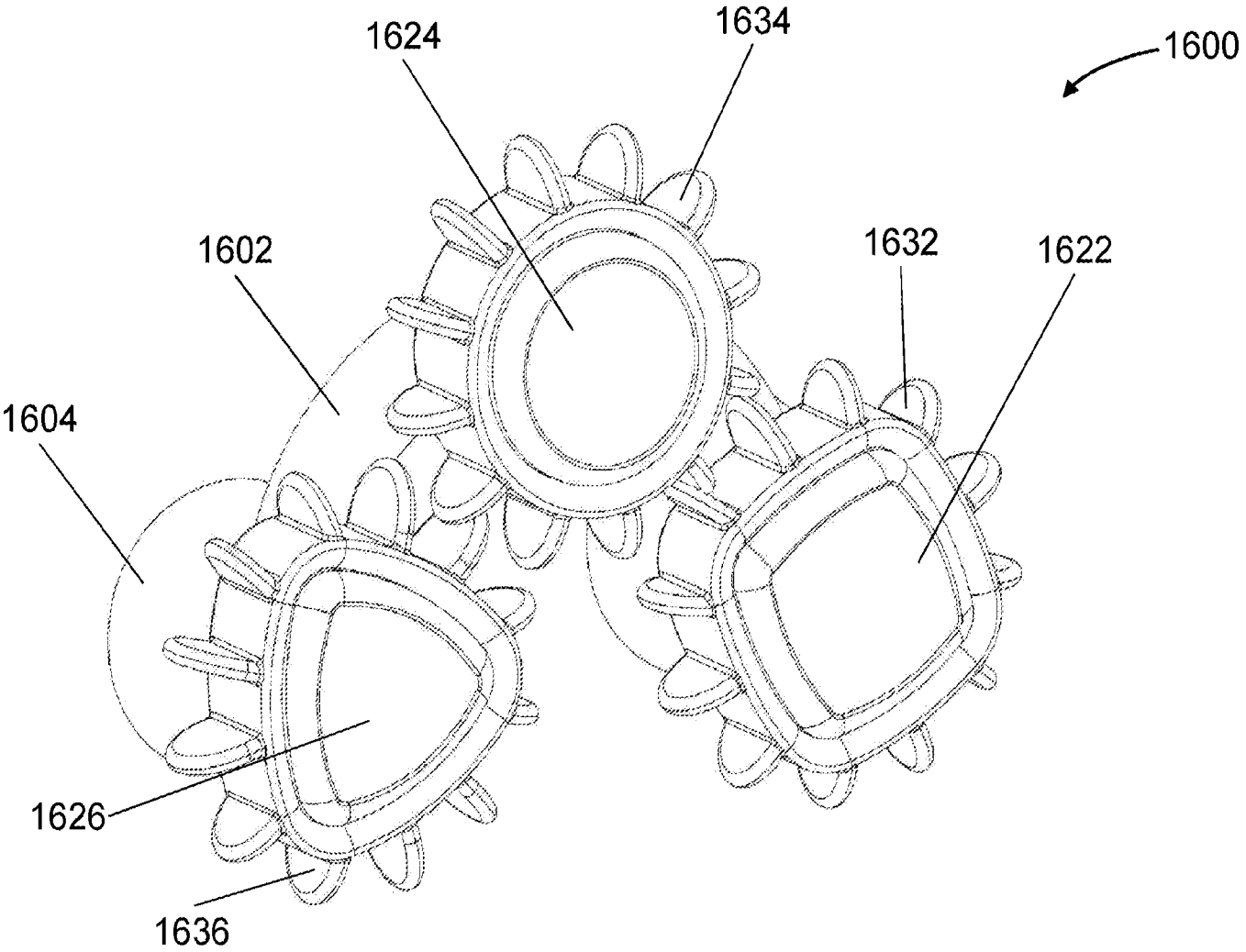
Figure 28B:
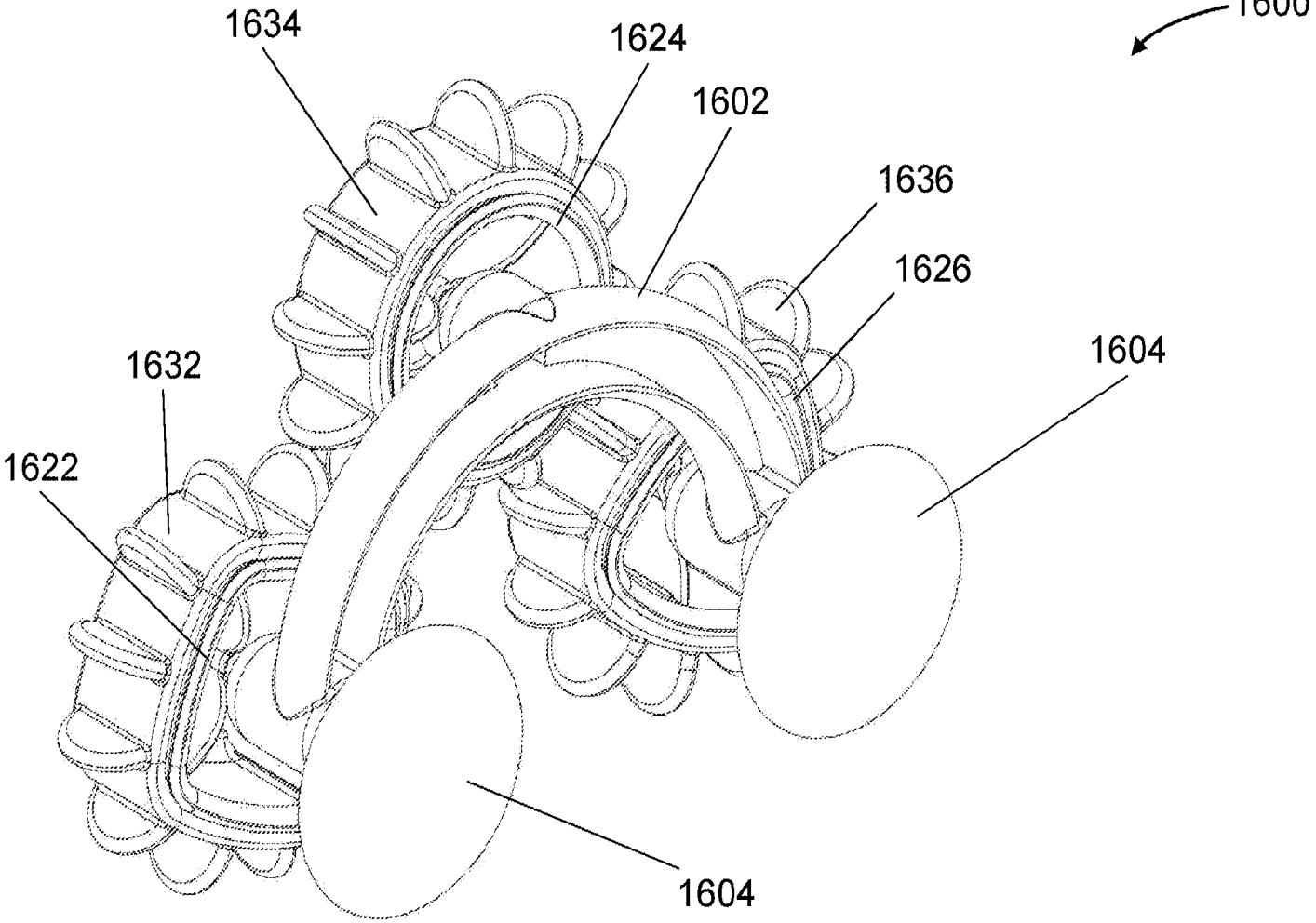
Figure 28C:
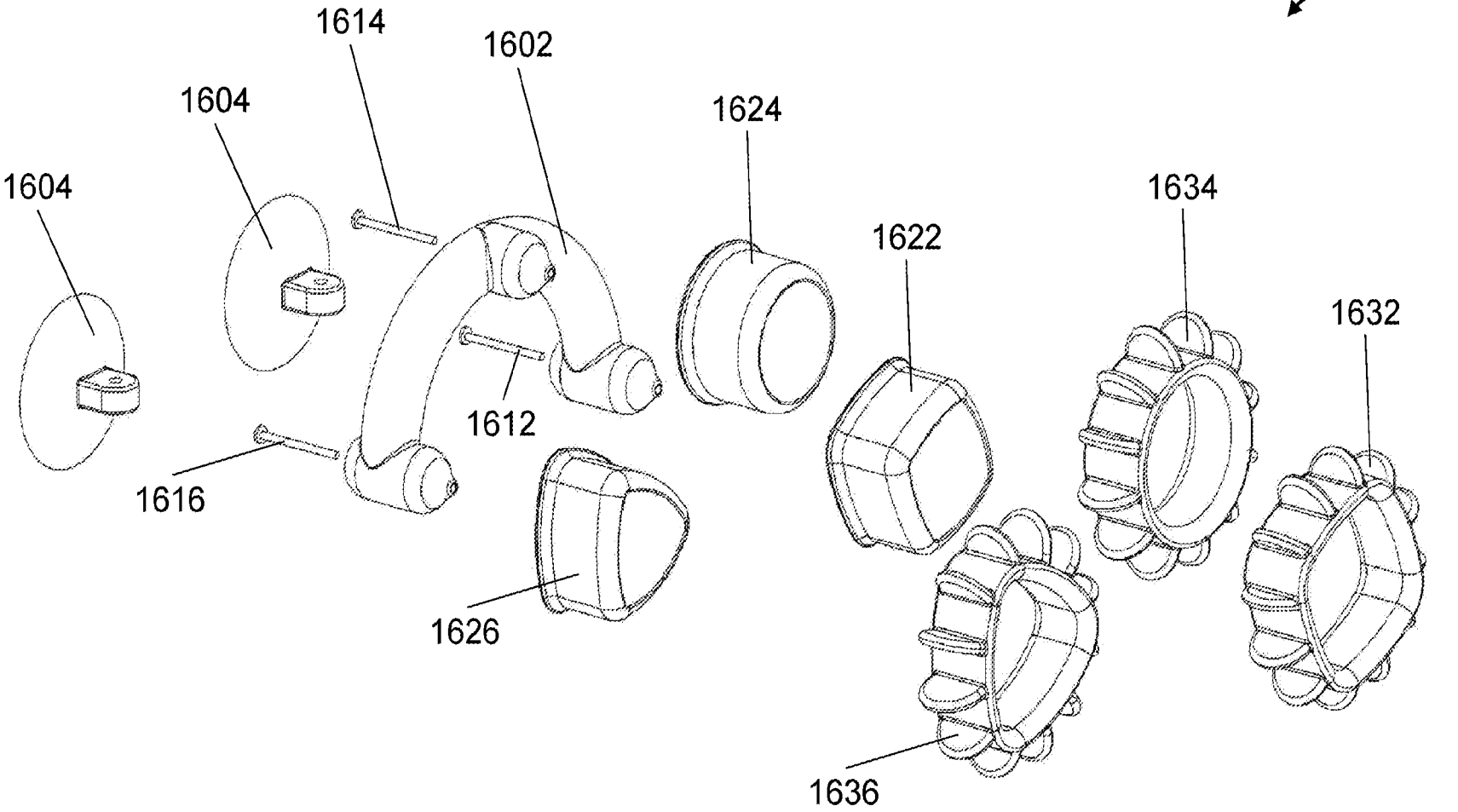
Figure 29A:
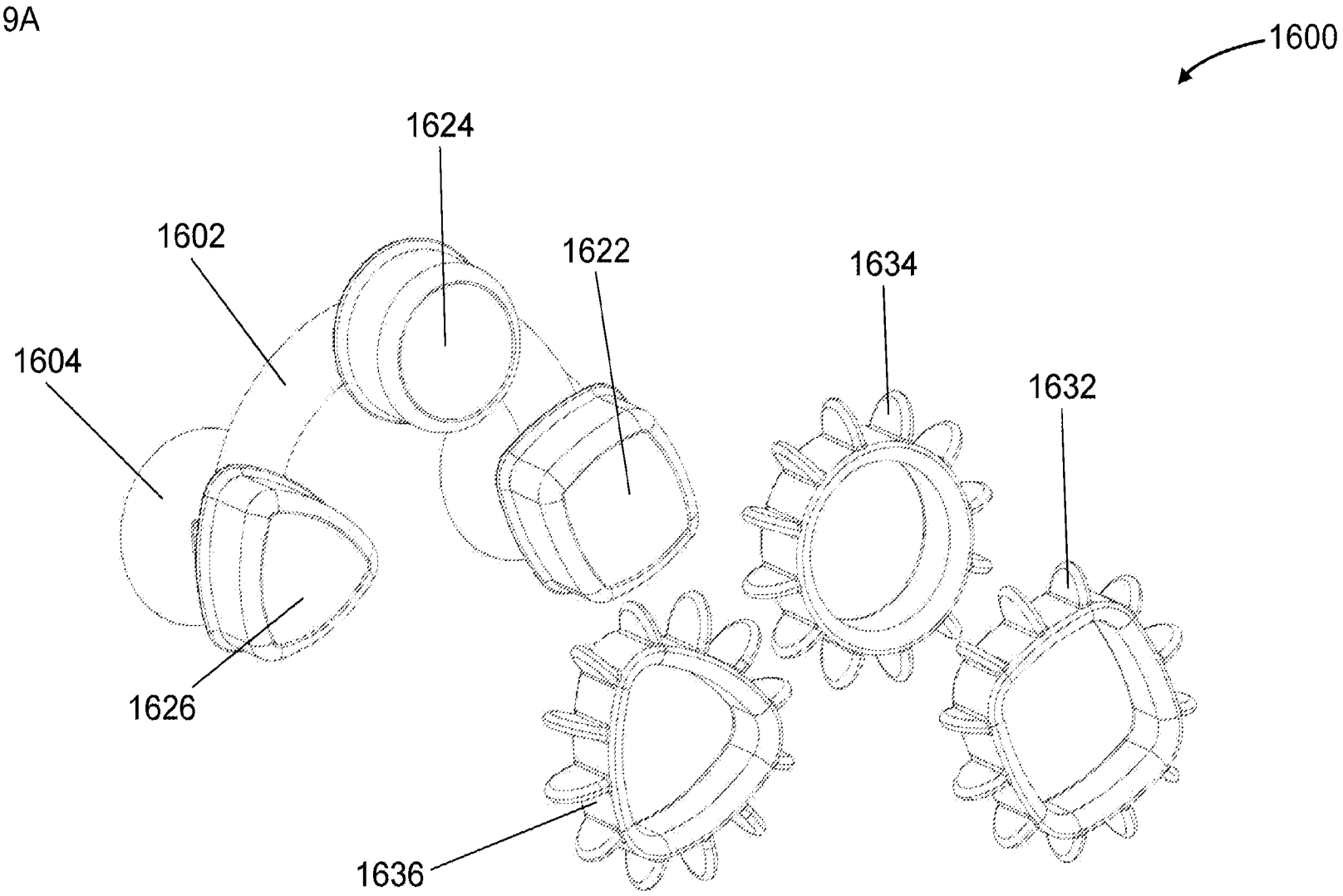
Figure 29B:
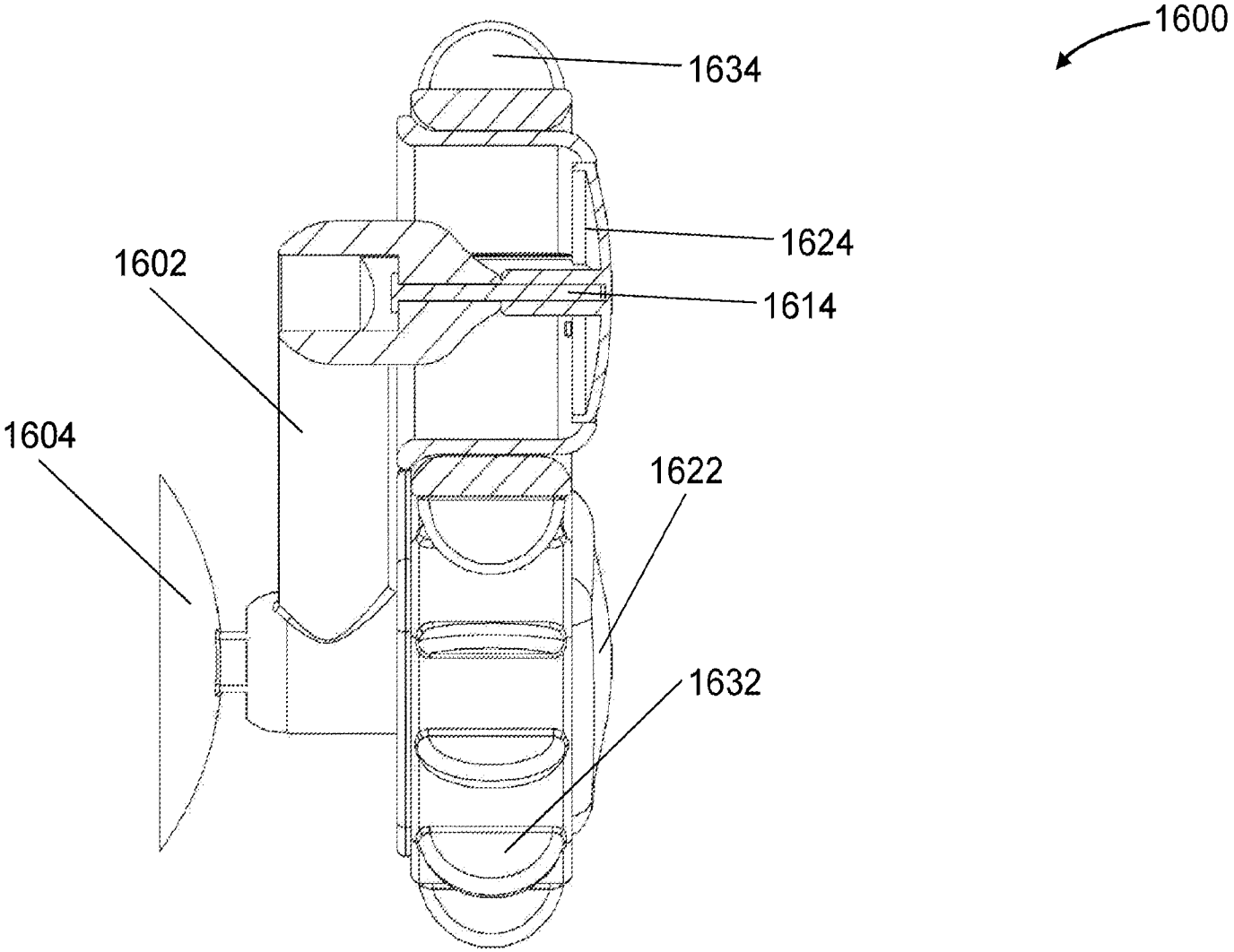
Figures 30A, 30B, 30C, 30D:
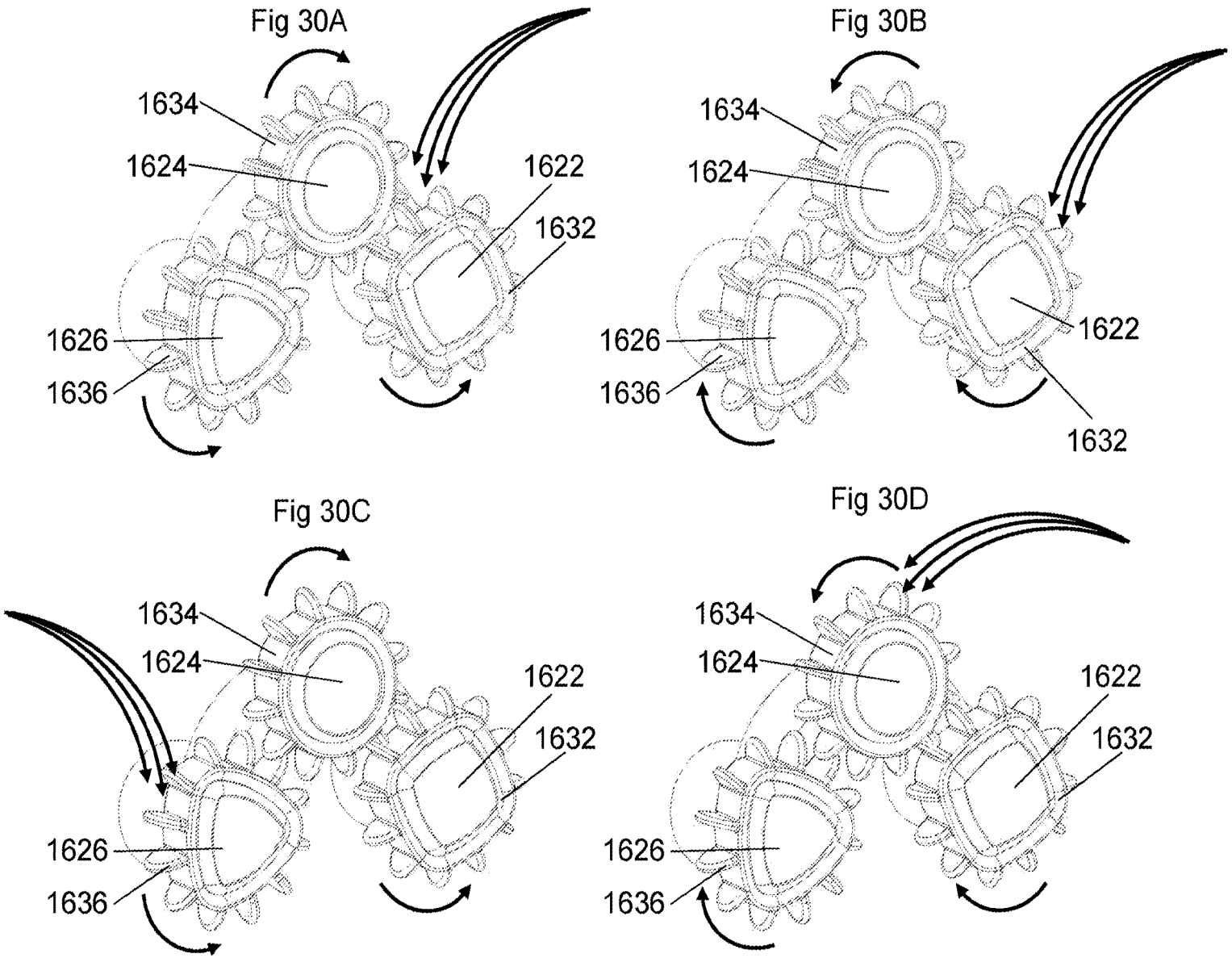
Figure 31A:
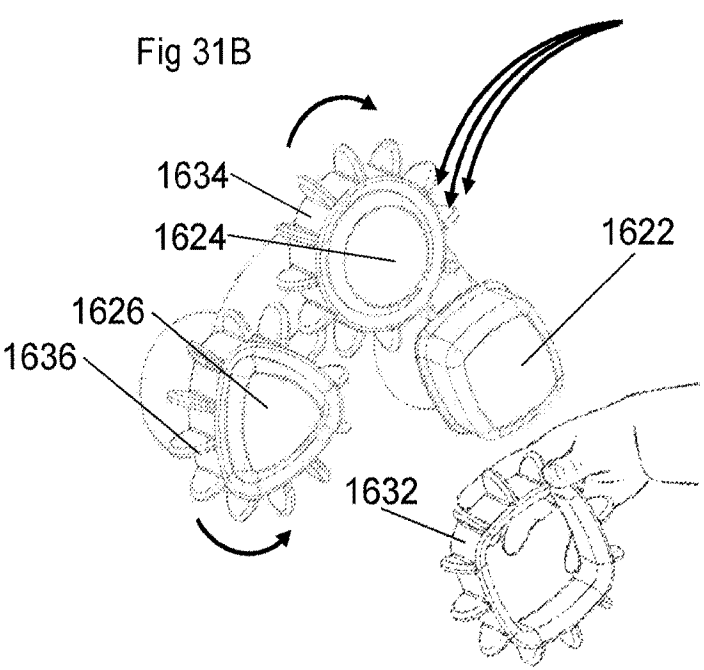
Figure 31B:
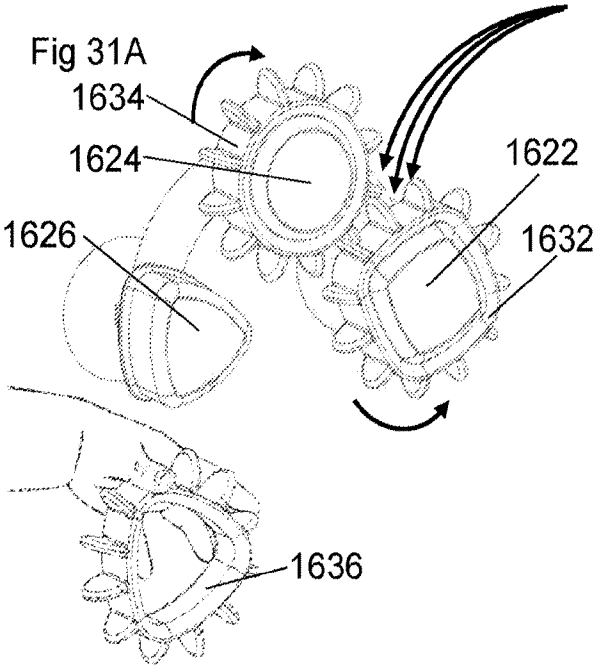
Figure 31C:
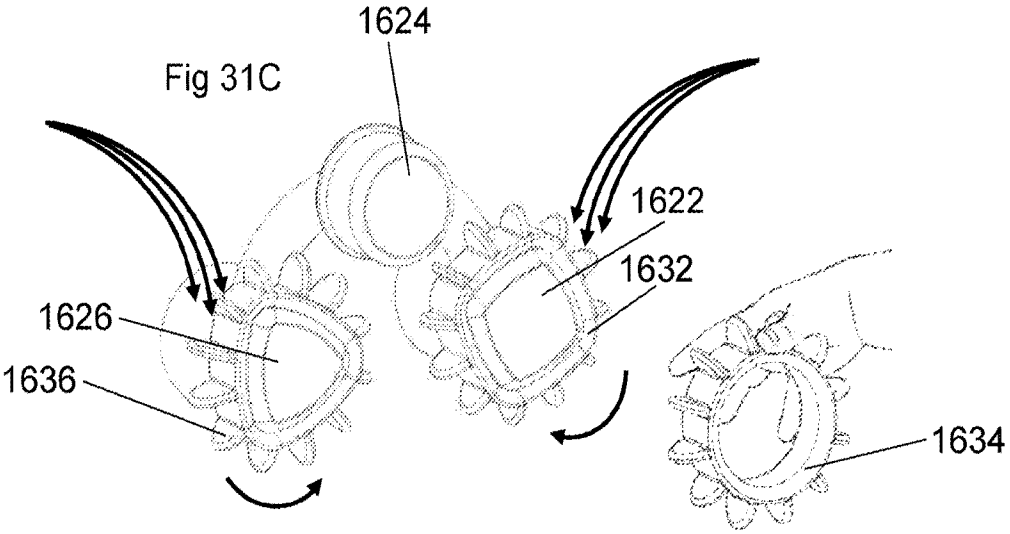
Figure 32:
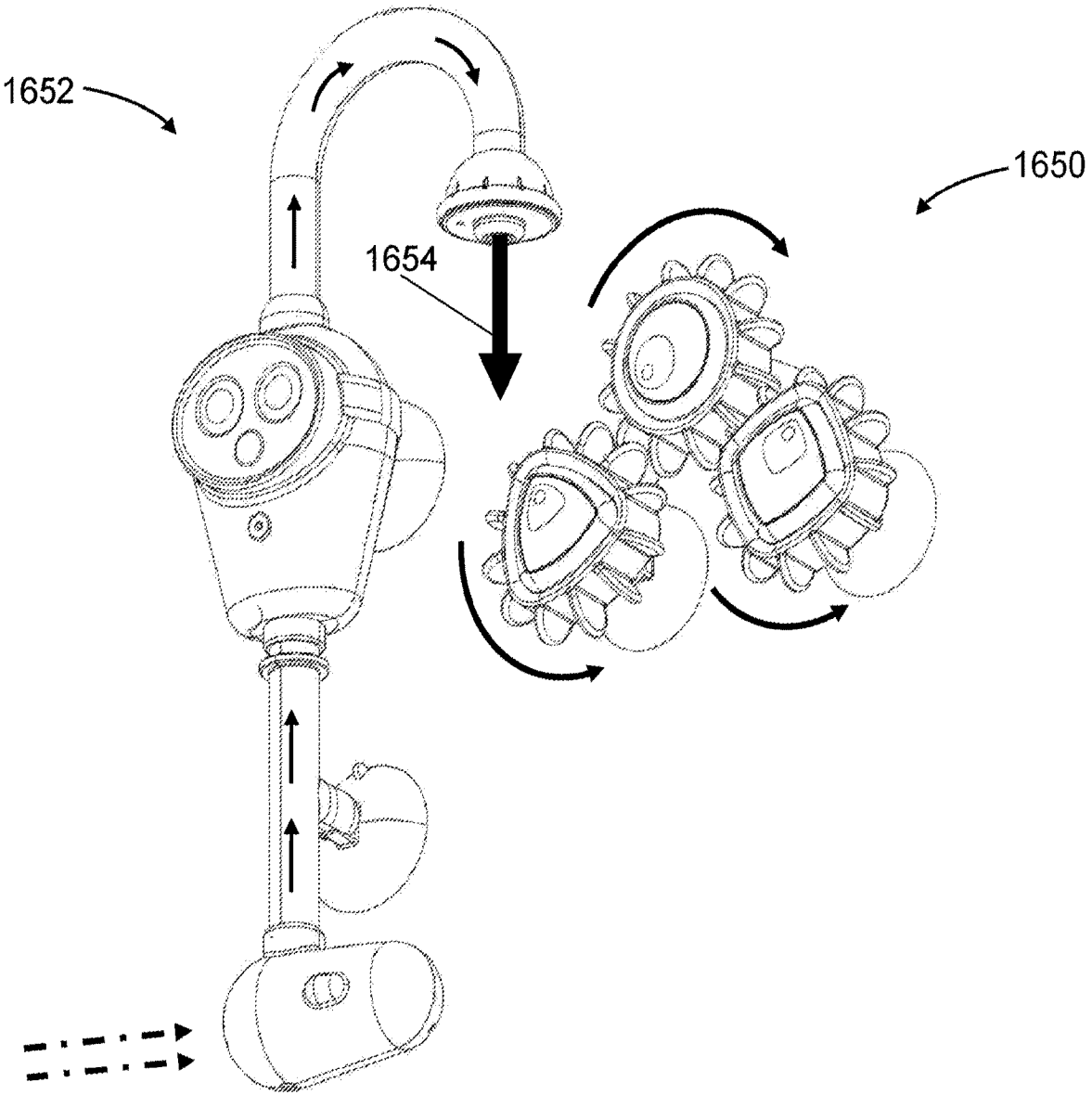
Figure 33B:
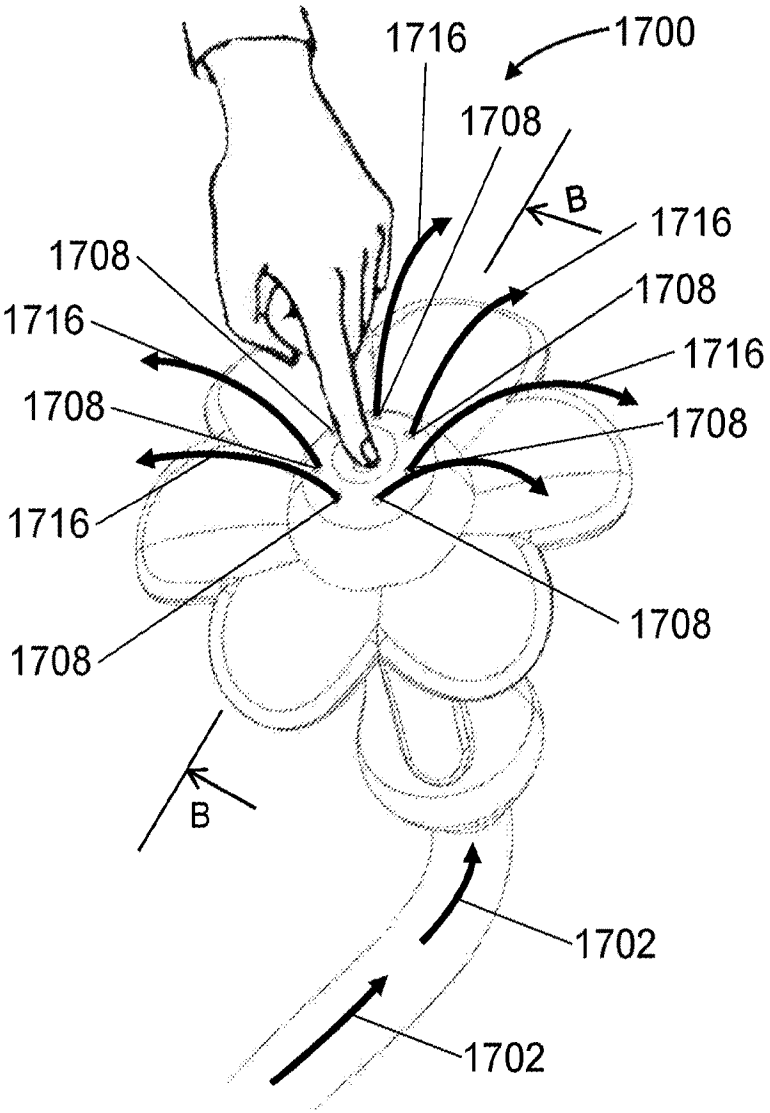
Figure 33A:
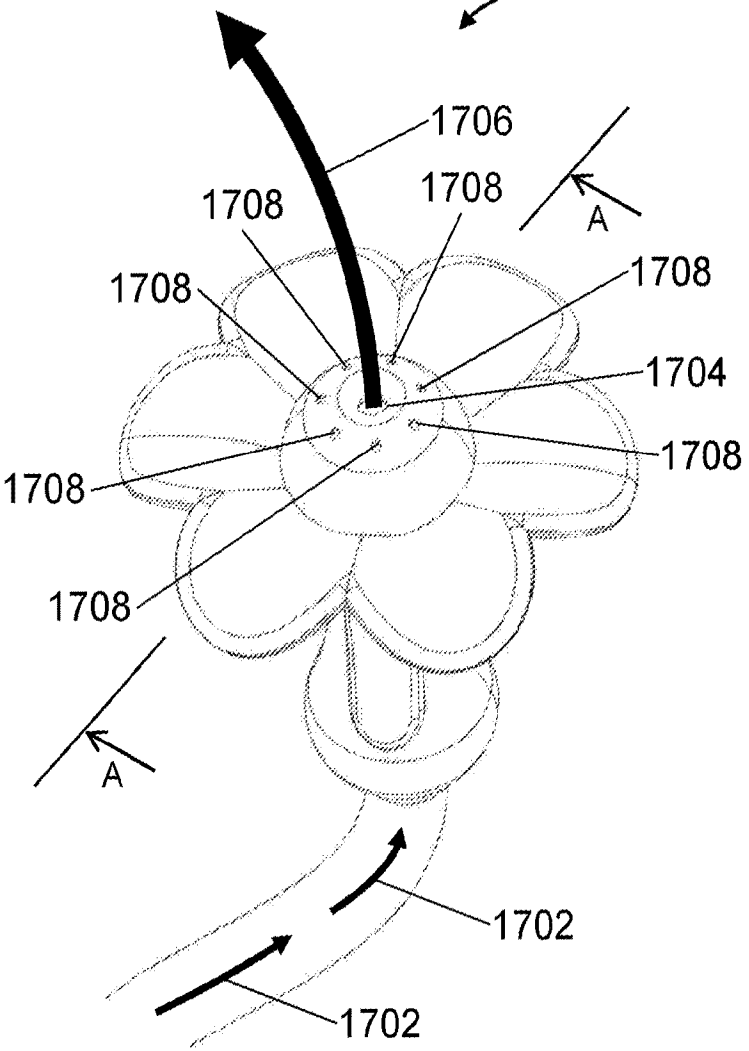
Figure 34A:
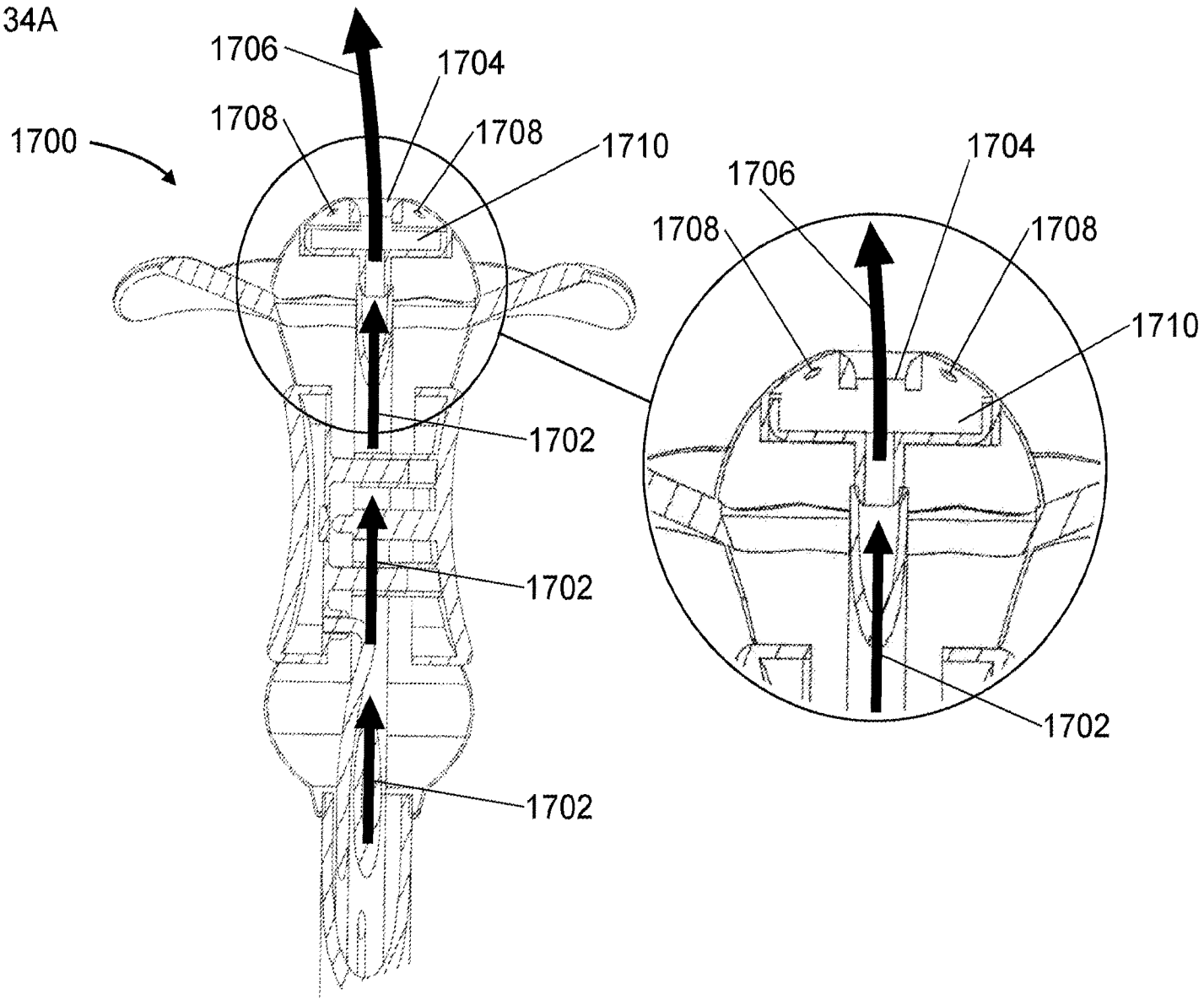
Figure 34B:
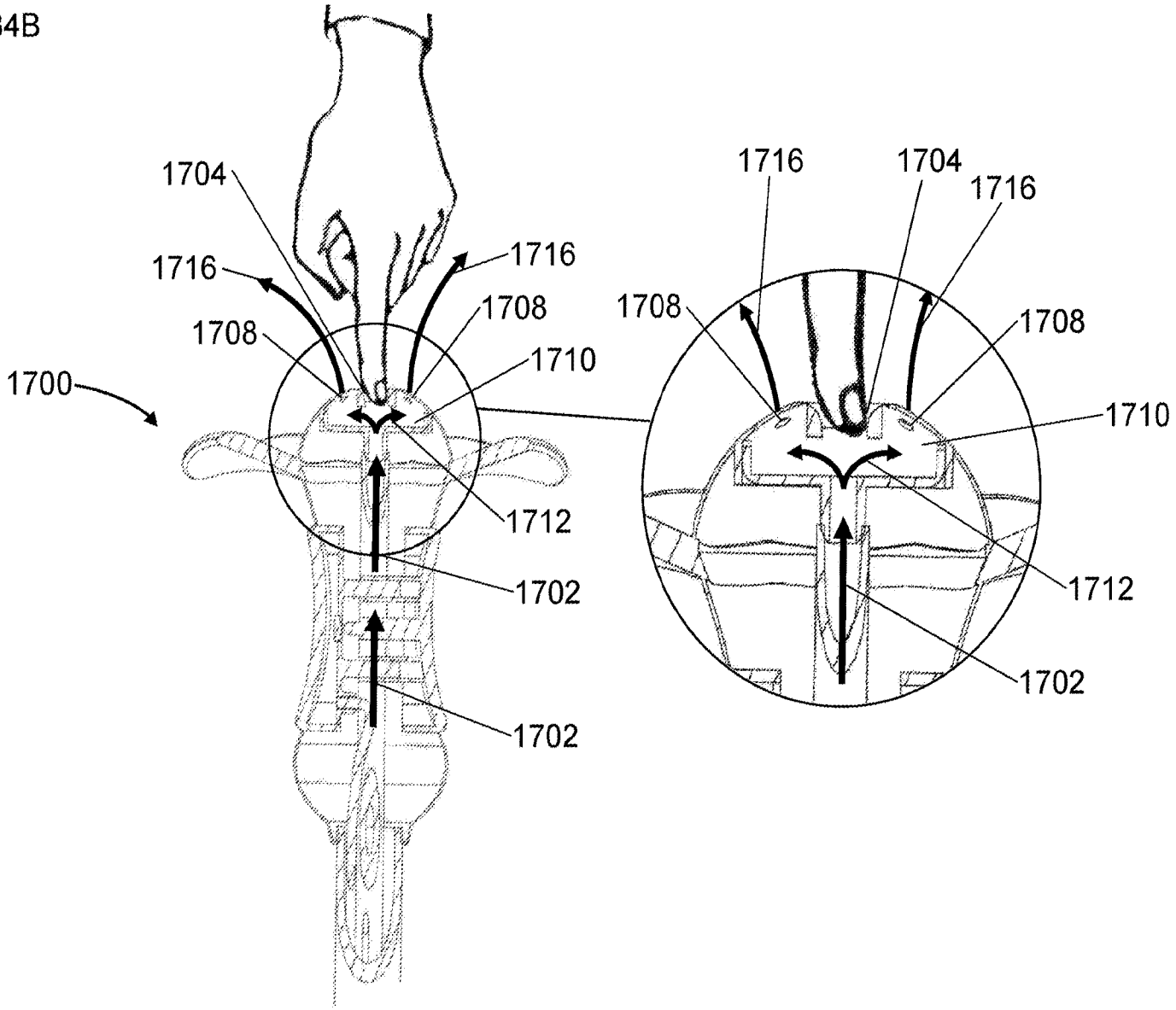
Figure 35B:
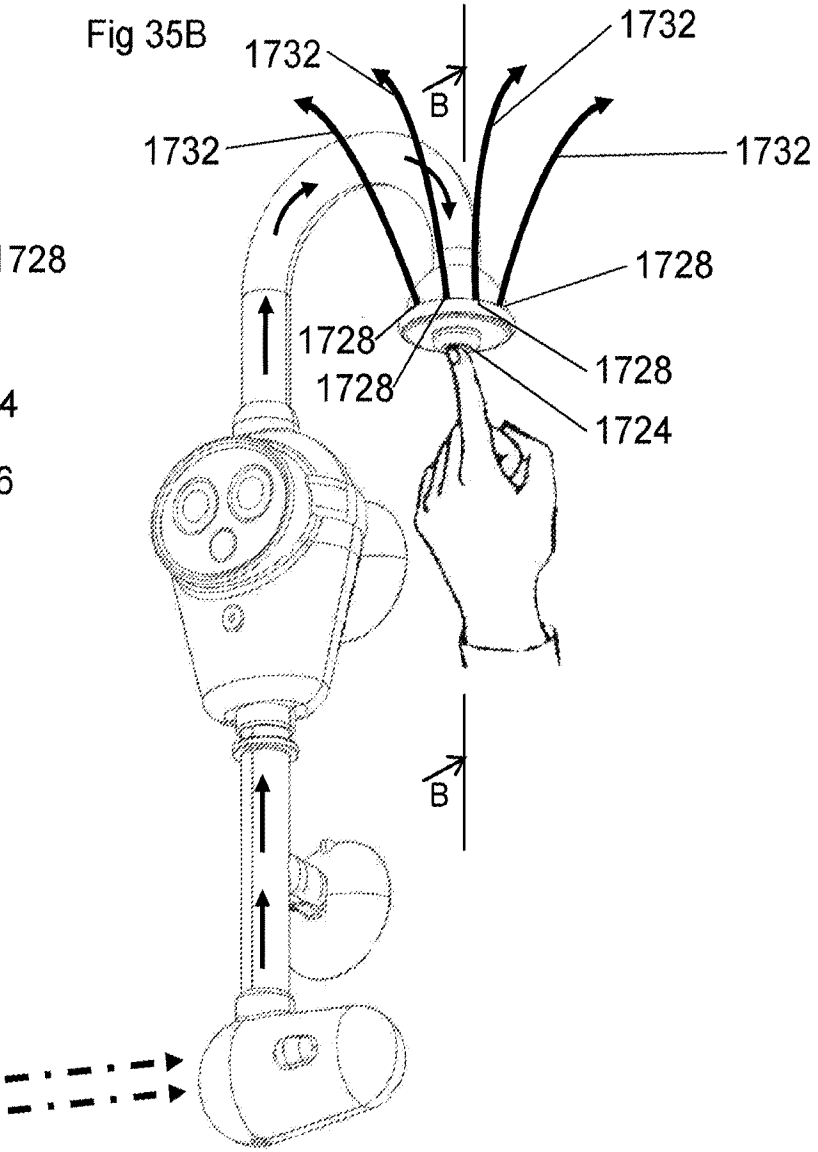
Figure 35A:
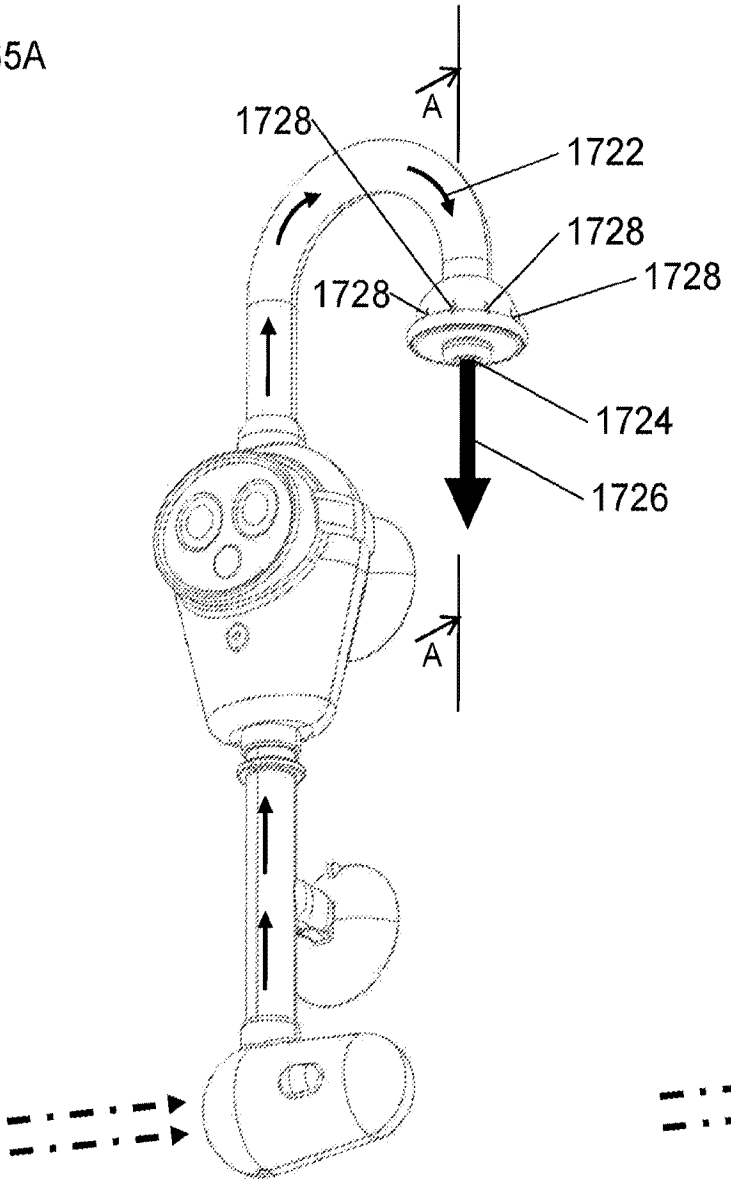
Figure 36B:
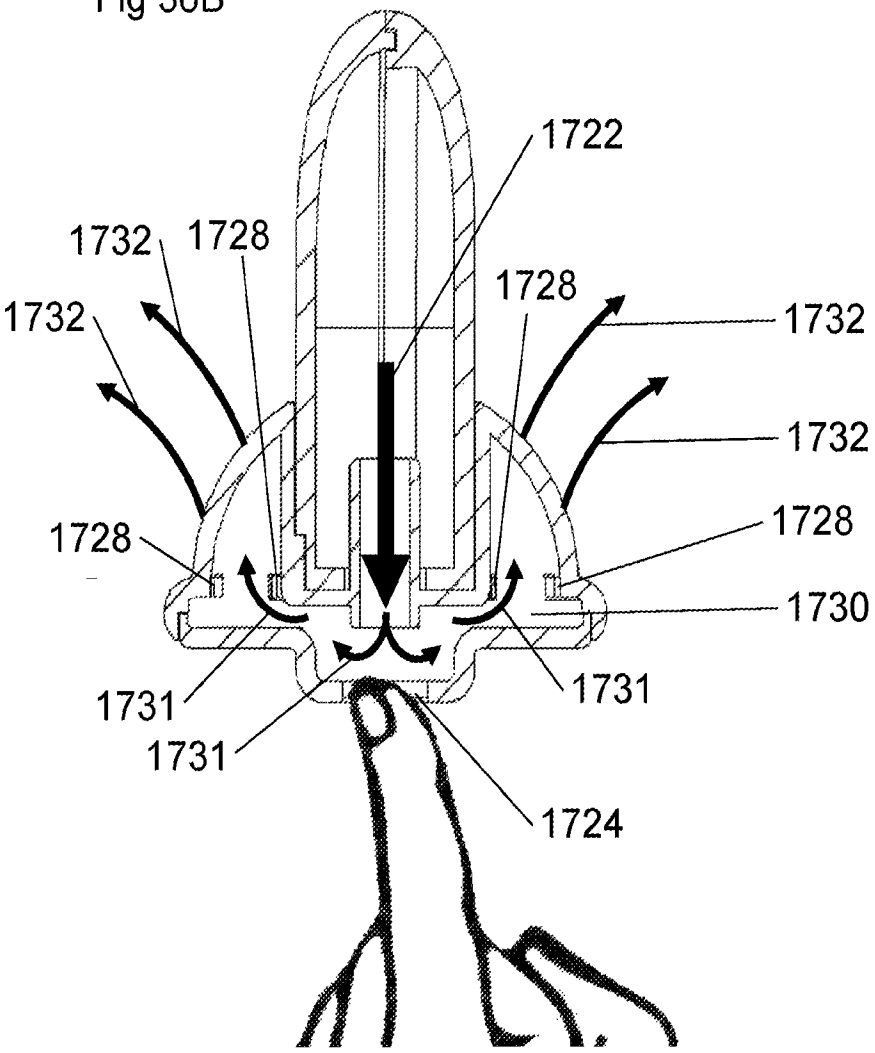
Figure 36A:
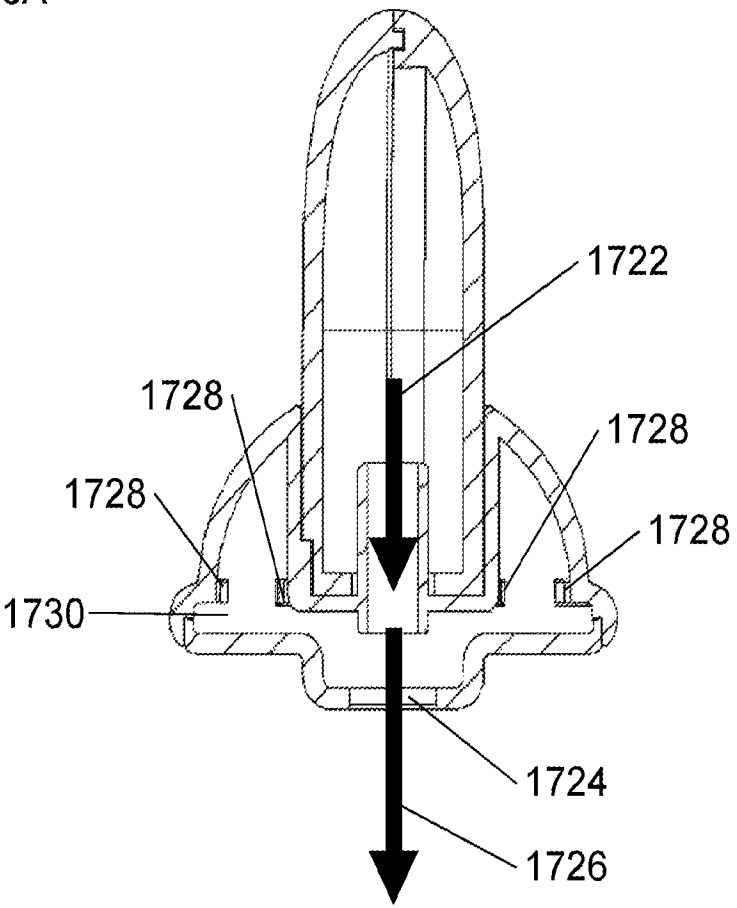
Figures 37A, 37B, 37C:
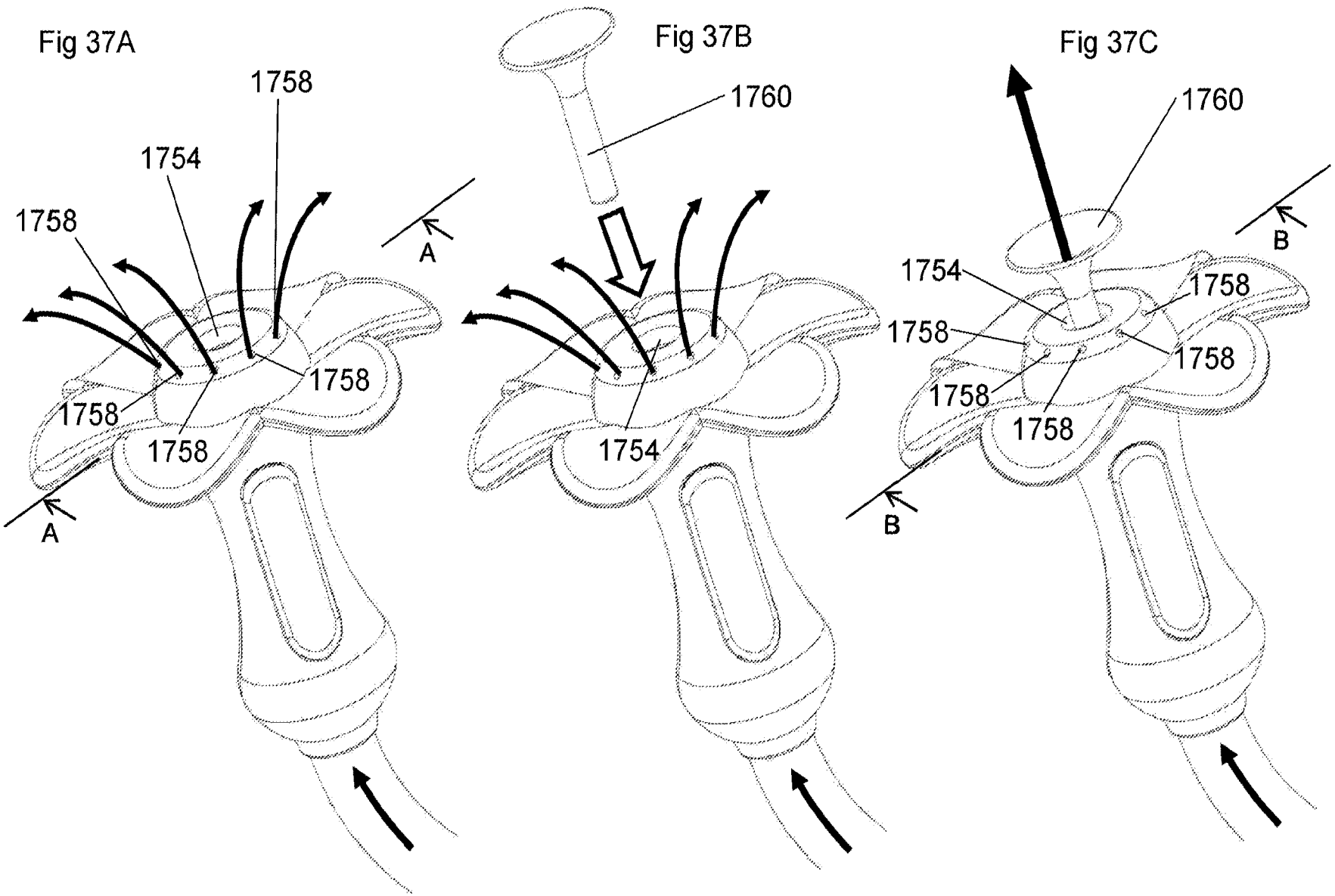
Figure 38:
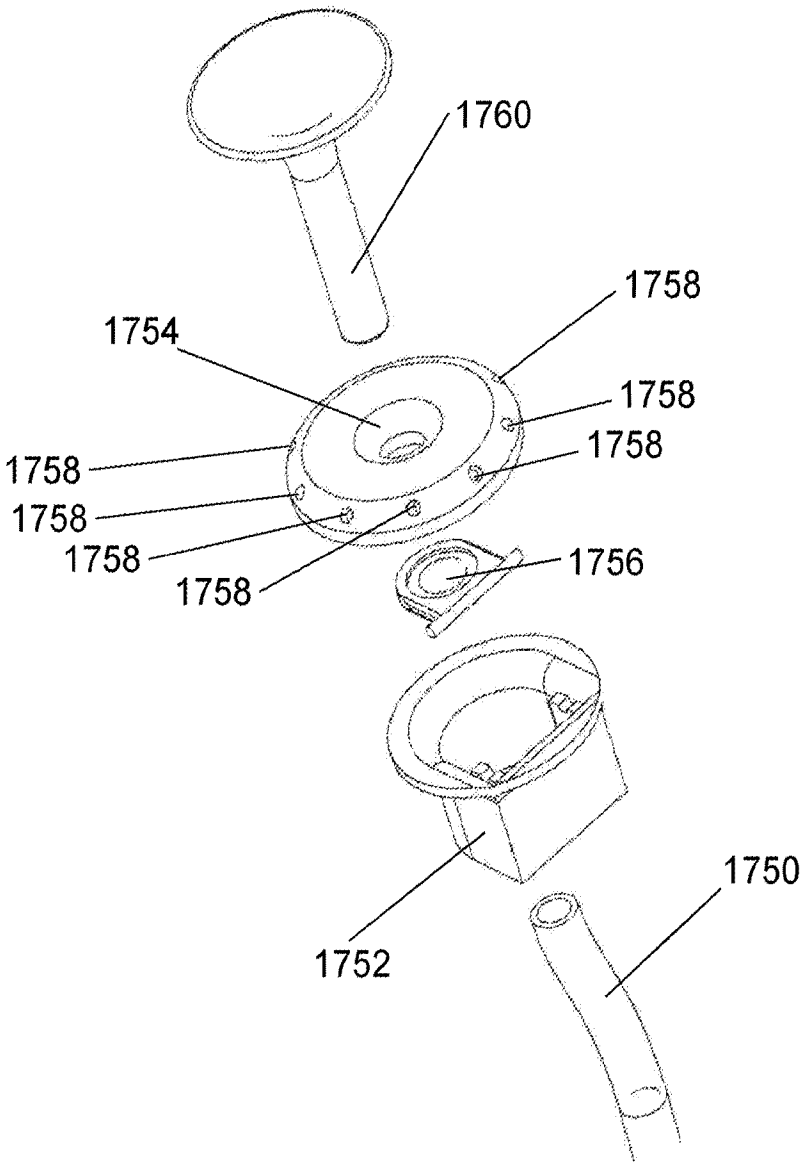
Figure 39A:
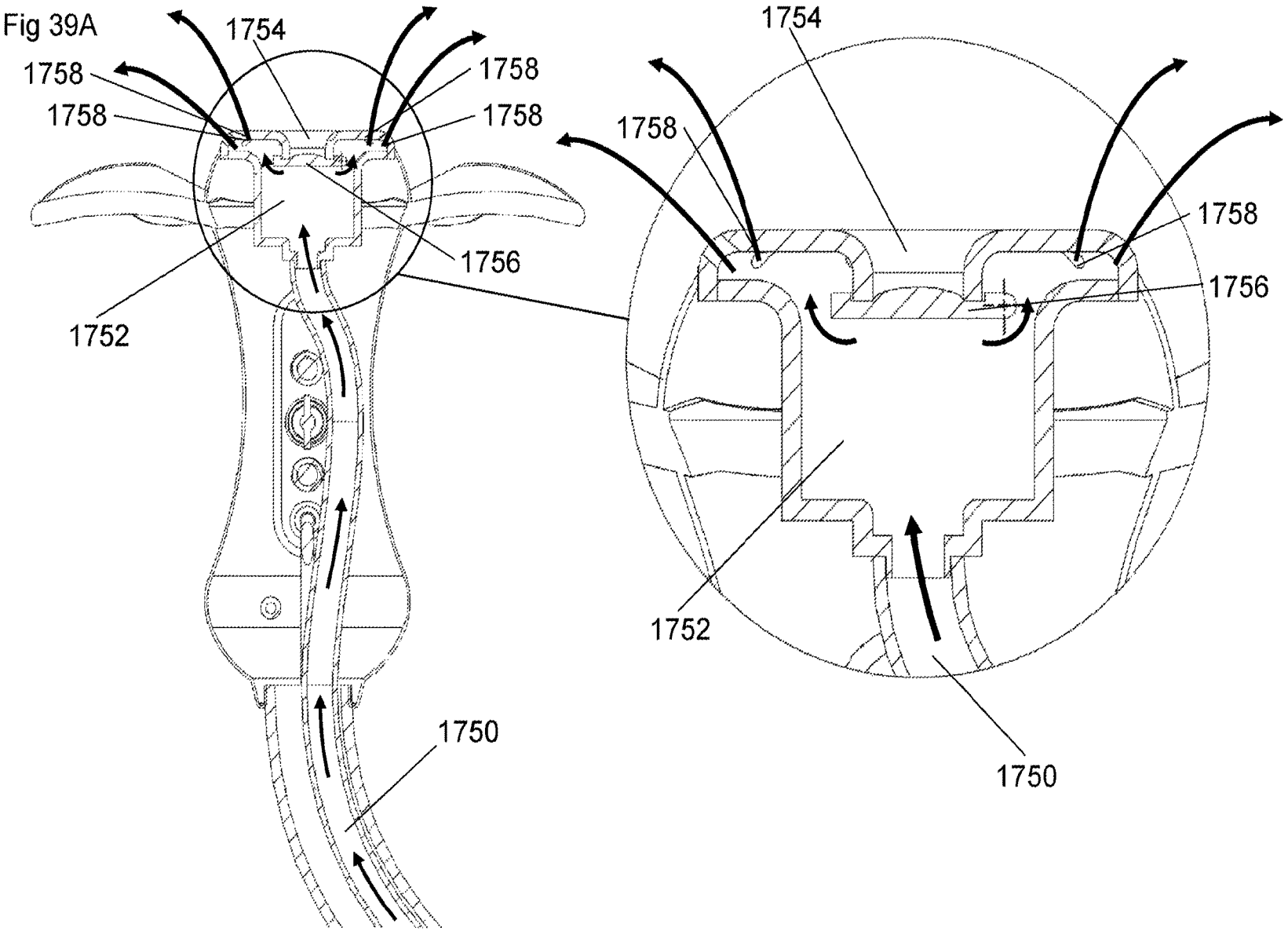
Figure 39B:
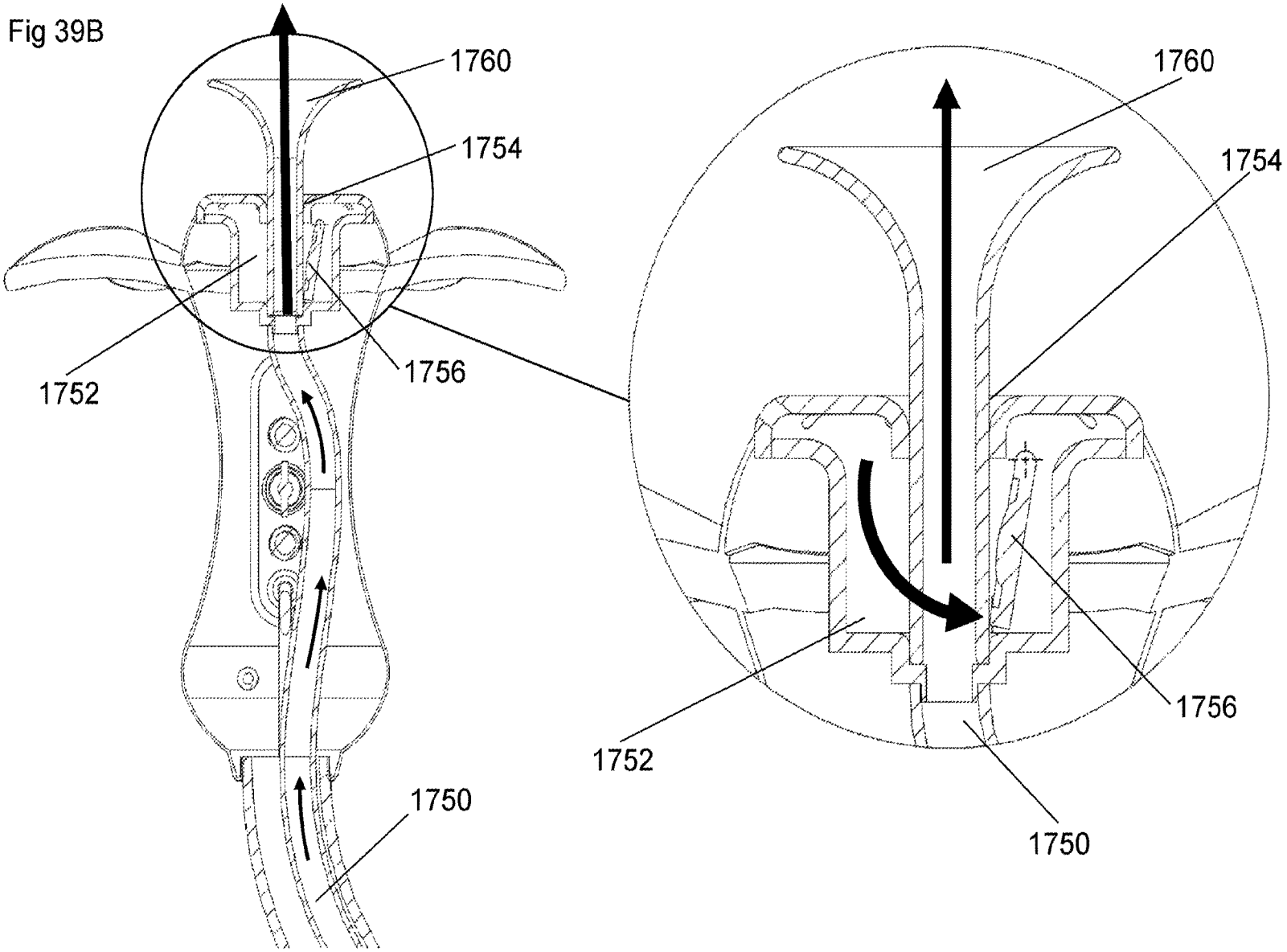
Figures 40A, 40B, 40C:
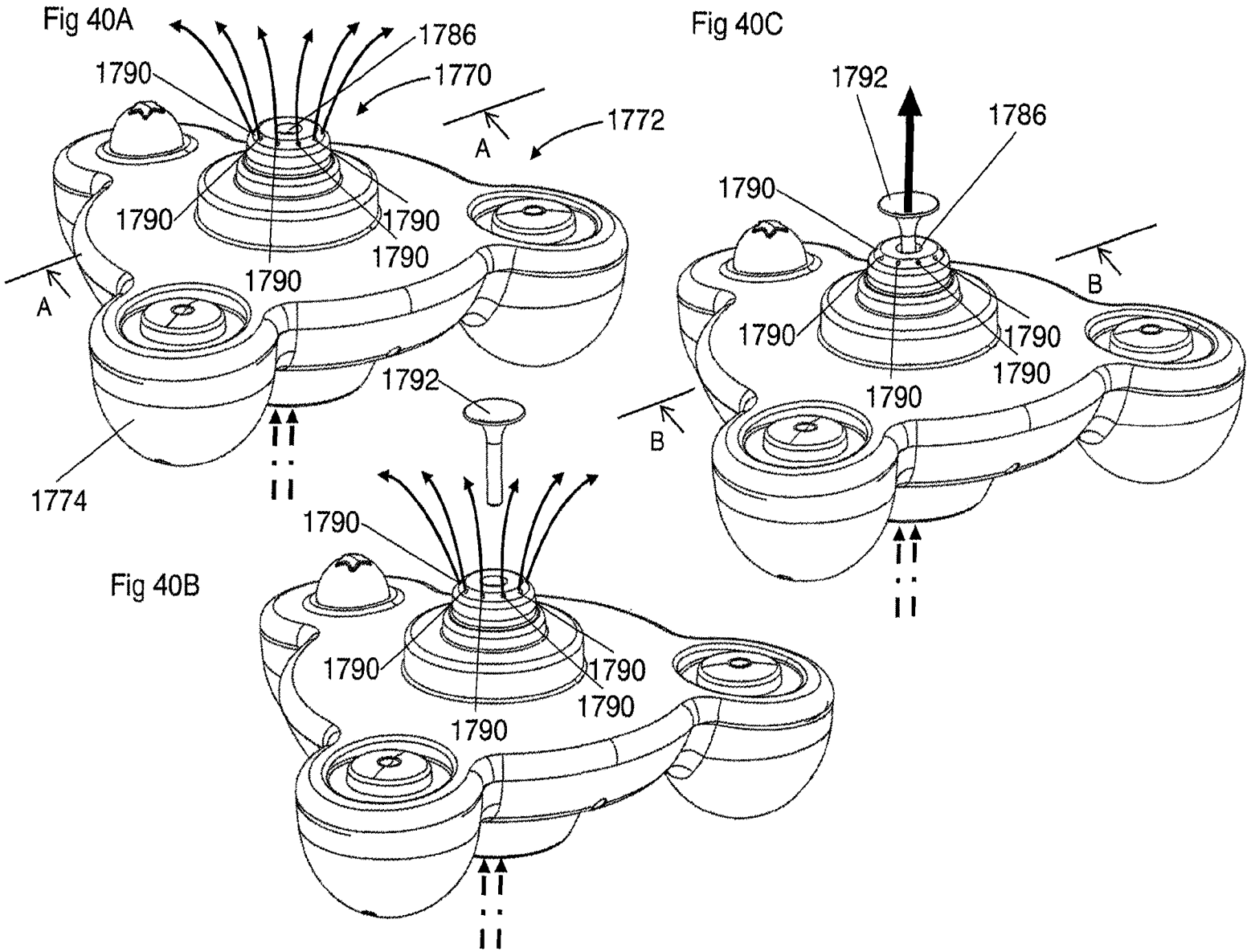
Figure 41A:
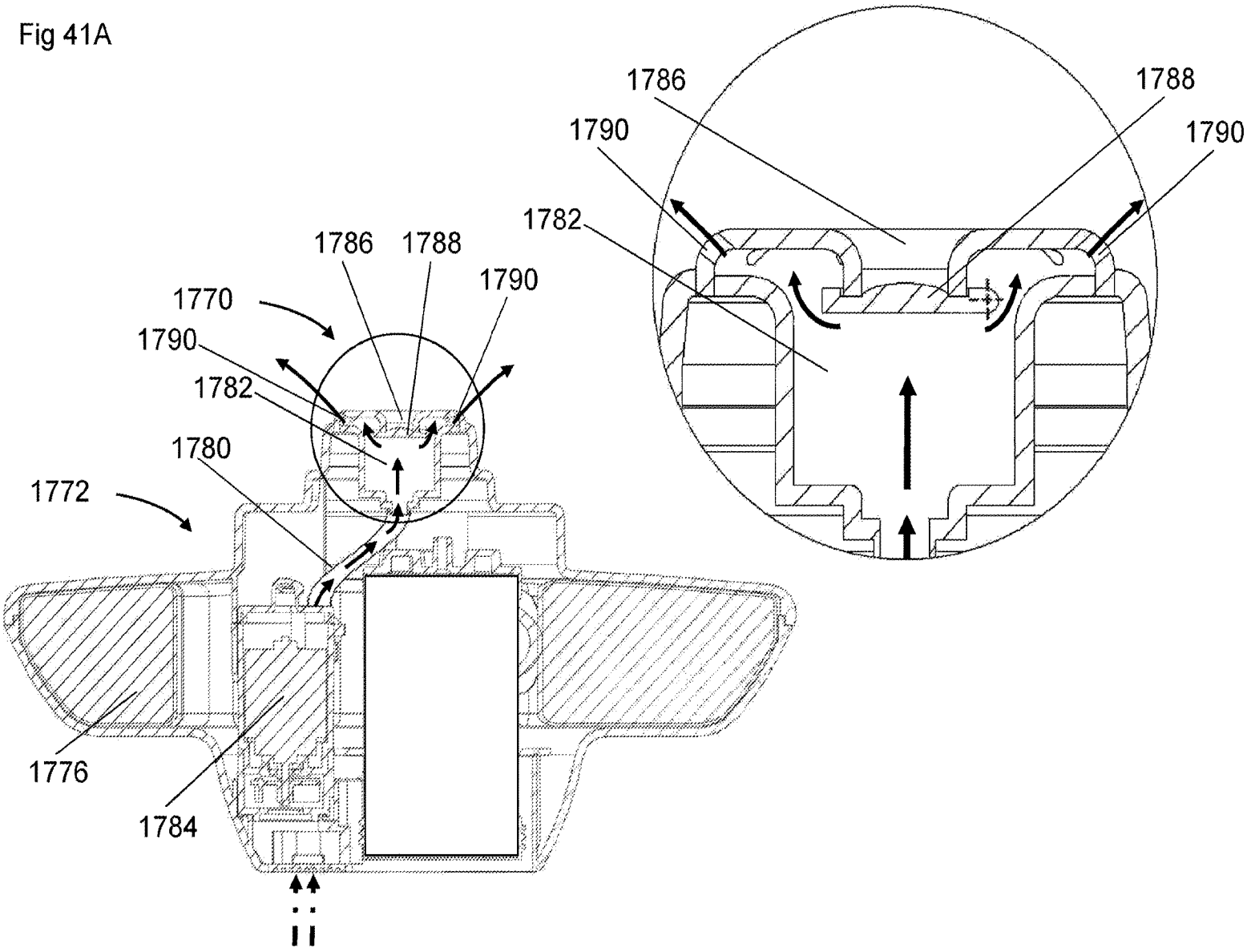
Figure 41B:
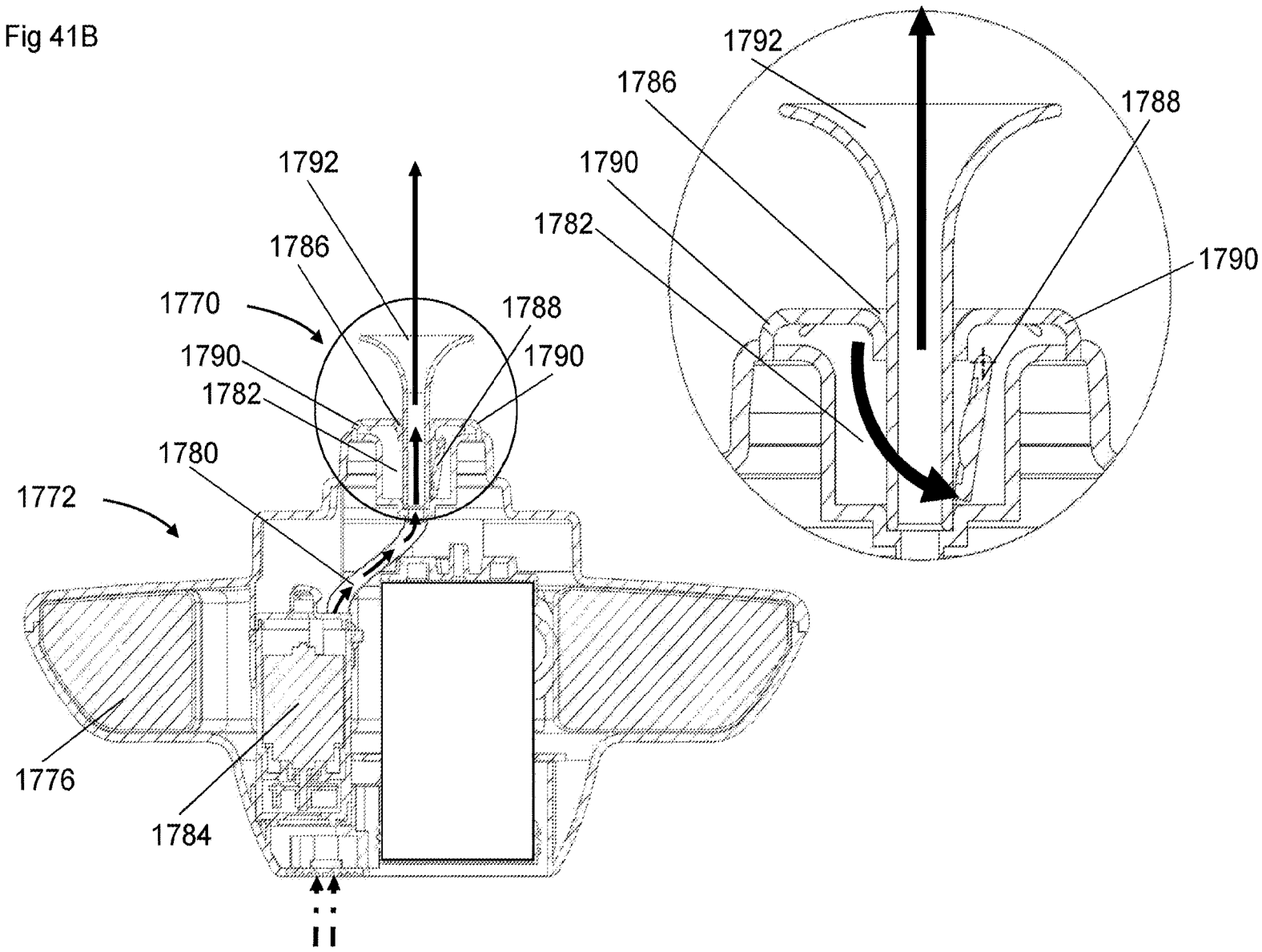

19, taken along lines B-B in FIG. 19, and a simplified exploded view illustration of the pump portion of FIGS. 26A and 26B;

FIG. 27 is a simplified pictorial illustration of the pump portion of the embodiment of FIGS. 19-26C in a floating operative orientation;

FIGS. 28A, 28B and 28C are respective simplified front and back view assembled illustrations and an exploded view illustration of a spray driven turbine water toy, which may be used in cooperation with a pump and nozzle as shown in any of the embodiments of FIGS. 1-27 or without a pump;

FIGS. 29A and 29B are respectively a simplified pictorial illustration of a disassembled orientation and a simplified partially cut-away side view illustration showing that differently shaped turbine portions may be selectably removable and replaceable on correspondingly differently shaped hubs as in the embodiment of FIGS. 28A-28C, to provide a shape matching play experience;

FIGS. 30A, 30B, 30C and 30D are simplified pictorial illustrations illustrating rotation patterns realizable by the toy of the embodiment of FIGS. 28A-29B in response to differently directed water sprays thereon;

FIGS. 31A, 31B and 31C illustrate three examples of removal of wheels from hubs in the embodiment of FIGS. 28A-30D;

FIG. 32 is a simplified illustration of operation of a toy similar to that shown in FIGS. 28A-31C by a bathtub mountable pump assembly;

FIGS. 33A and 33B illustrate two operative orientations of a finger modulated spray nozzle, which may be incorporated, for example, in the embodiment of FIGS. 19-27;

FIGS. 34A and 34B are simplified sectional illustrations illustrating water flows corresponding to the two operative orientations of FIGS. 33A and 33B;

FIGS. 35A and 35B illustrate two operative orientations of a finger modulated spray nozzle, which may be incorporated, for example in the bathtub mountable pump assembly of FIG. 32;

FIGS. 36A and 36B are simplified sectional illustrations illustrating water flows corresponding to the two operative orientations of FIGS. 35A and 35B;

FIGS. 37A, 37B and 37C illustrate three operative orientations of a nozzle element modulated spray nozzle, which may be incorporated, for example in the embodiment of FIGS. 19-27;

FIG. 38 is a simplified exploded view illustration of a portion of the nozzle element modulated spray nozzle of FIGS. 37A-37C;

FIGS. 39A and 39B are simplified sectional illustrations illustrating water flows corresponding to the operative orientations of FIGS. 37A and 37C;

FIGS. 40A, 40B and 40C illustrate three operative orientations of a nozzle element modulated spray nozzle forming part of a floating water toy; and FIGS. 41A and 41B are simplified sectional illustrations illustrating water flows corresponding to the operative orientations of FIGS. 40A and 40C.

DETAILED DESCRIPTION OF PREFERRED EMBODIMENTS

Figure 1:
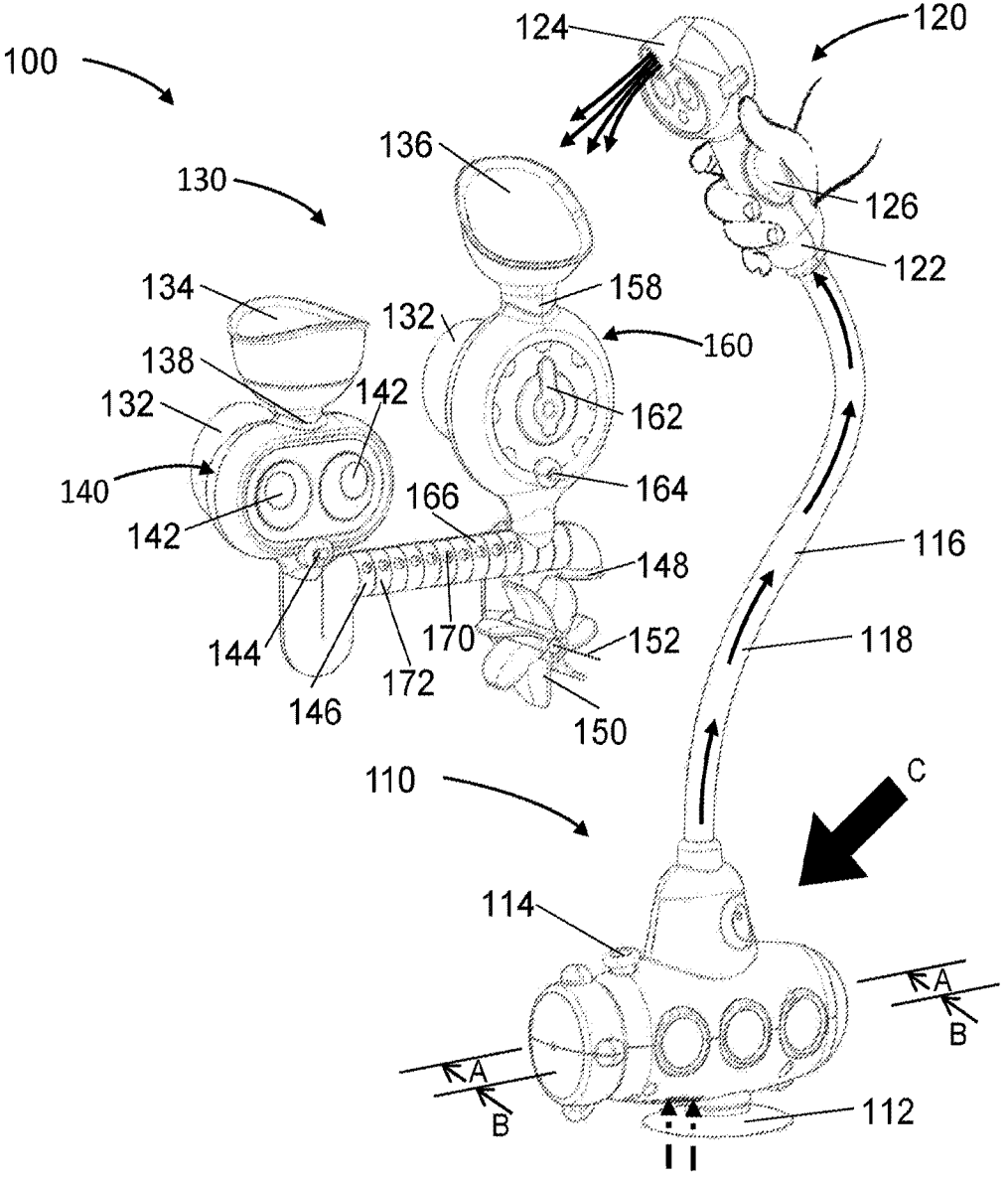
FIG. 1 is a simplified pictorial illustration of a combination pumped flow and gravitational flow bath toy system constructed and operative in accordance with a preferred embodiment of the present invention.

Reference is now made to FIG. 1, which is a simplified pictorial illustration of a combination pumped flow and gravitational flow bath toy system 100 constructed and operative in accordance with a preferred embodiment of the present invention.

As seen in FIG. 1, the combination pumped flow and gravitational flow bath toy system 100 includes a pump portion 110, typically in the fanciful form of a submarine, which is adapted to be immersed in water, such as in a bath, and may be removably secured to a bottom of a bathtub (not shown) as by a vacuum cup 112. Pump portion 110 preferably includes an ON/OFF switch 114 and is coupled via a flexible conduit 116, preferable enclosing a pressurized water conduit and an electrical switch actuation electrical conduit 118, with a nozzle portion 120. Pump portion 110 is preferably formed in a fanciful shape, such as the illustrated shape of a submarine, wherein the flexible conduit 116 may be envisioned as a flexible periscope extending upwardly from the submarine.

Nozzle portion 120 preferably includes a nozzle housing 122, which is securely coupled to flexible conduit 116 and which defines a pumped pressurized spray output nozzle 124. It is a particular feature of the illustrated embodiment of the present invention that there is provided a spray control switch assembly, which can be operated by a very young child, even a child under the age of one year.

The spray control switch assembly is preferably realized in the illustrated embodiment by a pair of push buttons 126, which are mounted in nozzle housing 122, and which may be simultaneously grabbed by the hand of a young child. The spray control switch assembly preferably may be actuated by a young child who squeezes the push buttons 126 towards each other. According to a preferred embodiment of the present invention, squeezing of either or both of the push buttons 126 by even a very young child is sufficient to actuate a spray output from the nozzle 124.

Preferably the nozzle portion 120 and the nozzle housing 122 are configured to have a fanciful appearance, such as that of a face, in the illustrated embodiment.

The combination pumped flow and gravitational flow bath toy system 100 preferably also includes a multi-directional mutually-intersecting gravitational flow portion 130, which is adapted to receive water sprayed from nozzle 124, when actuated by even a very young child. The multi-directional mutually-intersecting gravitational flow portion 130 preferably is adapted to be mounted on a generally vertical surface, such as a side wall or end wall of a bathtub (not shown) and preferably is provided with suction cups 132 for this purpose.

In accordance with a preferred embodiment of the present invention, the multi-directional mutually-intersecting gravitational flow portion 130 preferably includes at least two water receiving receptacles 134 and 136, which are adapted to receive water from a water spray directed thereat from nozzle 124 by, even a very young child, operating push buttons 126 of nozzle portion 120.

Water receiving receptacle 134 is preferably coupled to a first generally vertical gravitational water flow conduit 138 which supplies water by gravitational flow to at least one first gravity flow water-driven turbine 140, which produces visually sensible rotational motion of a pair of rotating objects 142, here fancifully rendered as googly eyes, in mutually opposite rotational directions. The at least one first gravity flow water-driven turbine 140 preferably has an outlet 144. Water flowing by gravity from turbine 140 is directed via a generally horizontal conduit 146 which extends transversely to an outlet 148, which directs the water into driving engagement with a second gravity flow water-drive turbine 150, typically in the shape of a pinwheel, which rotates about an axis 152, which extends generally perpendicularly to generally horizontal conduit 146.

Water receiving receptacle 136 is preferably coupled to a second generally vertical gravitational water flow conduit 158 which supplies water by gravitational flow to a third gravity flow water-driven turbine 160, which produces visually sensible rotational motion of a rotating object 162, here fancifully rendered as a clock dial. Third gravity flow water-driven turbine 160 preferably has an outlet 164. Water flowing by gravity from water receiving receptacle 136 through conduit 158 is directed via a generally horizontal conduit 166 which extends transversely and parallel to generally horizontal conduit 146. Generally horizontal conduit 166 preferably is formed with a linear, generally horizontal array of spray outlets 170.

It is a particular feature of an embodiment of the invention that generally horizontal conduit 146 and generally horizontal conduit 166 are together constructed to have a common outer housing 172, which in fact defines two generally horizontal water conduits arranged to accommodate two separate gravitationally driven flows in mutually opposite generally horizontal directions. It is appreciated that the gravitationally driven transverse water flow from receptacle 134 through generally horizontal conduit 146 extends horizontally beyond the gravitationally driven vertical flow of water from receptacle 136 via generally vertical conduit 158 into generally horizontal conduit 166 and thus gives the appearance that the flows intersect, even though this is not the case.

Figure 2:
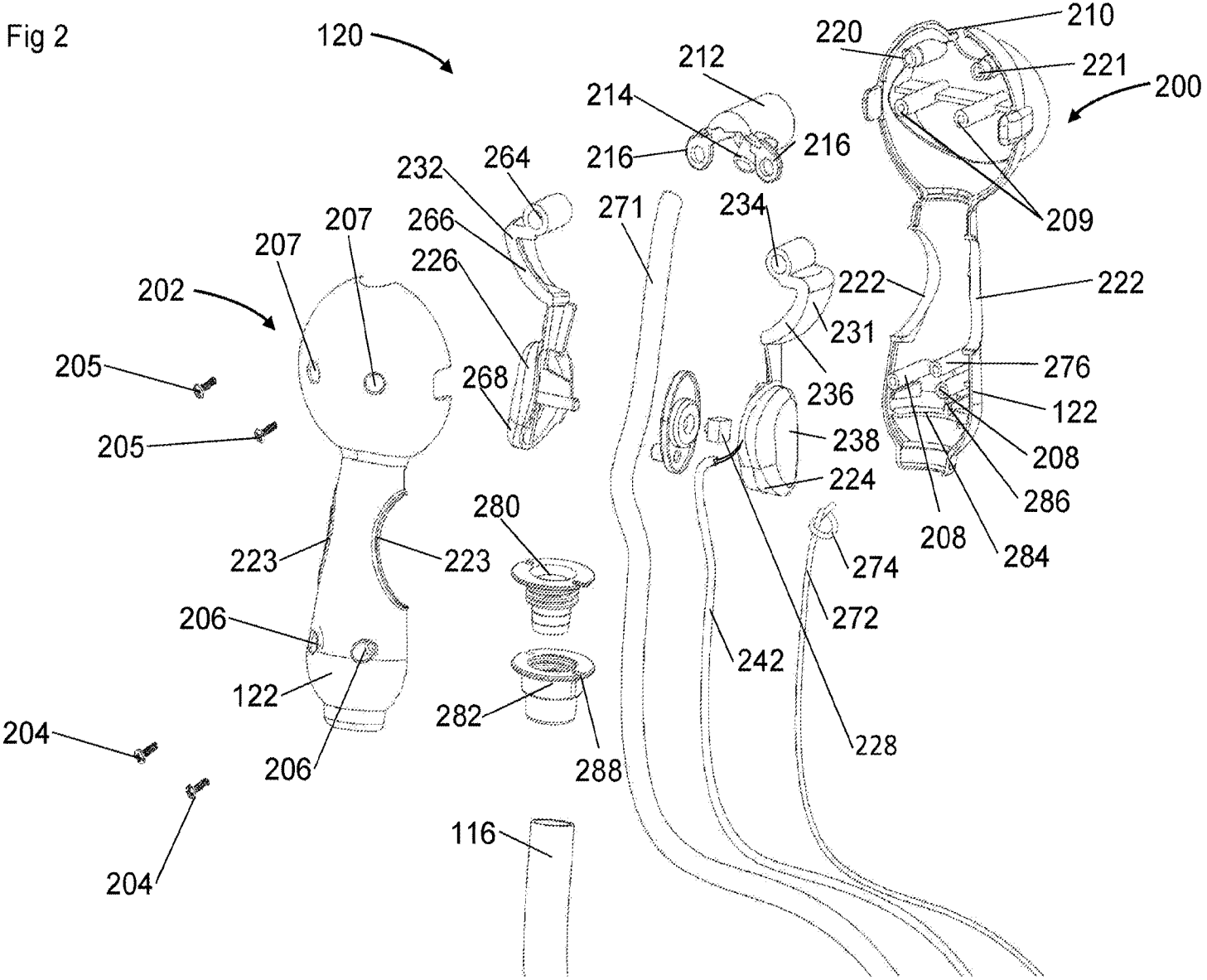
FIG. 2 is a simplified exploded view illustration of a nozzle and conduit portion of the combination pumped flow and gravitational flow bath toy system of FIG. 1.
Figure 3B:
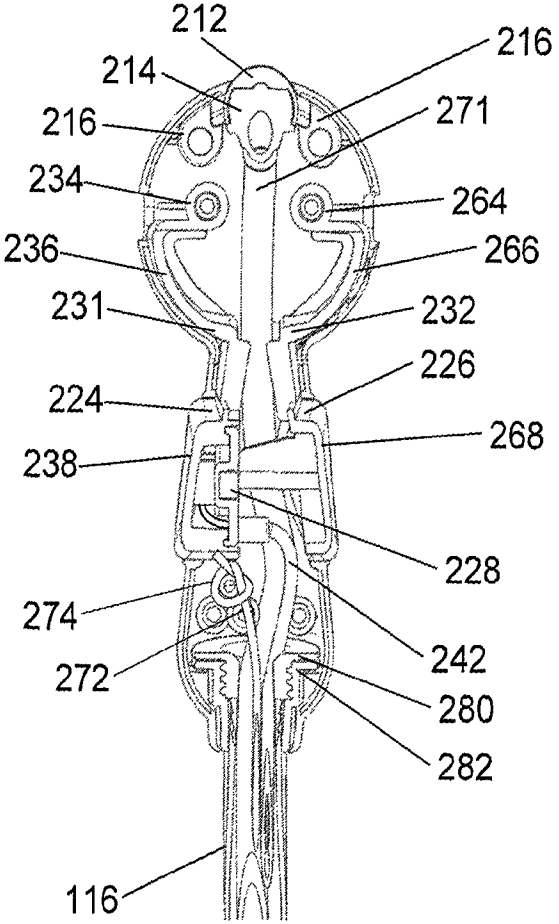
FIGS. 3A and 3B are simplified pictorial and cut-away pictorial view illustrations of a forward nozzle housing element forming part of the nozzle and conduit portion of FIG. 2.
Figure 3A:
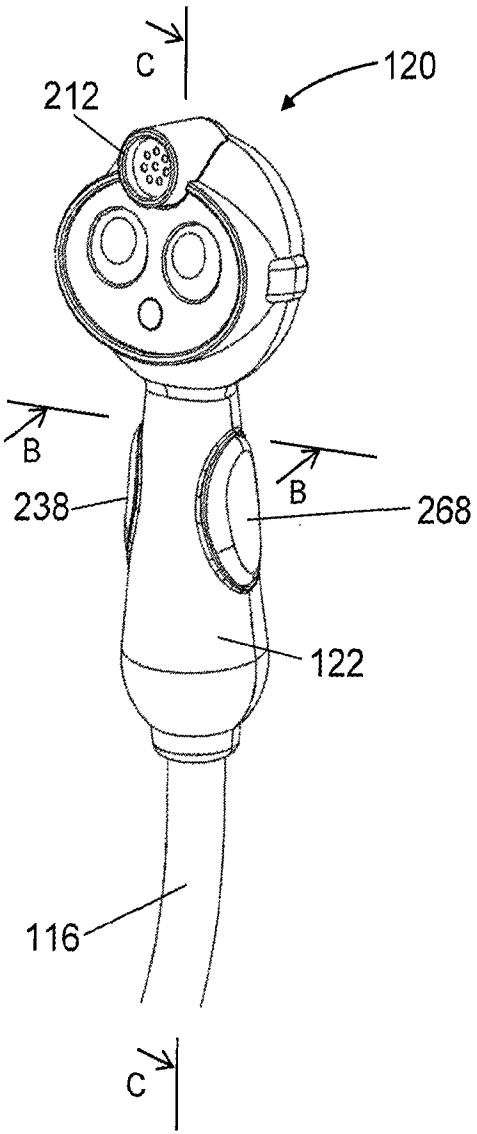
Figure 4B:
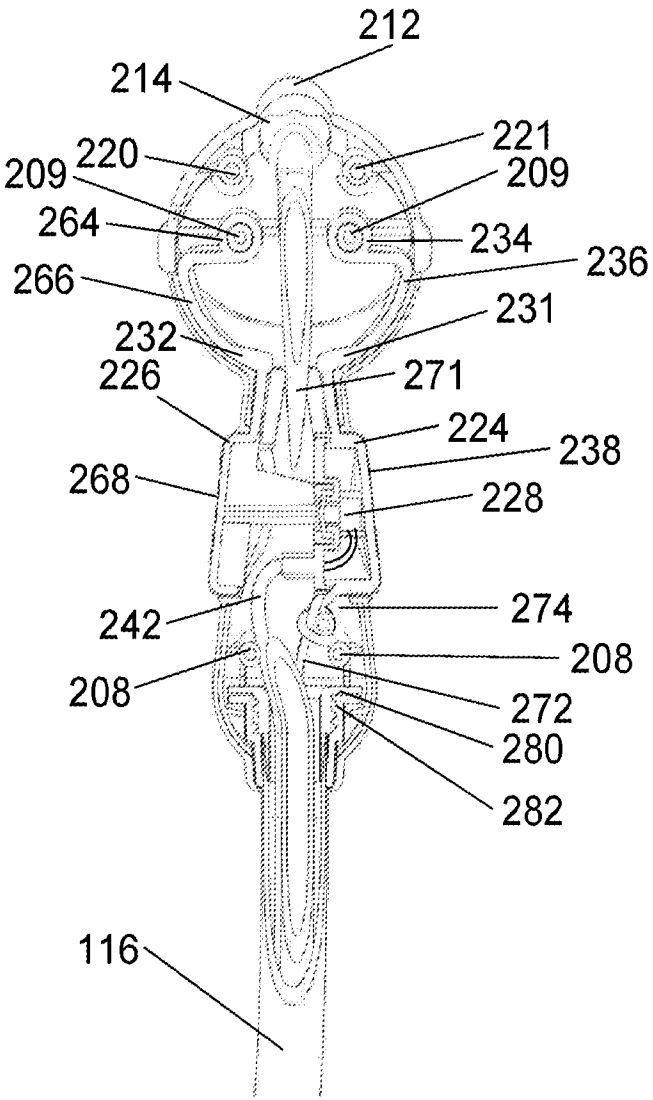
FIGS. 4A and 4B are simplified pictorial and cut-away pictorial view illustrations of a rearward nozzle housing element forming part of the nozzle and conduit portion of FIG. 2.
Figure 4A:
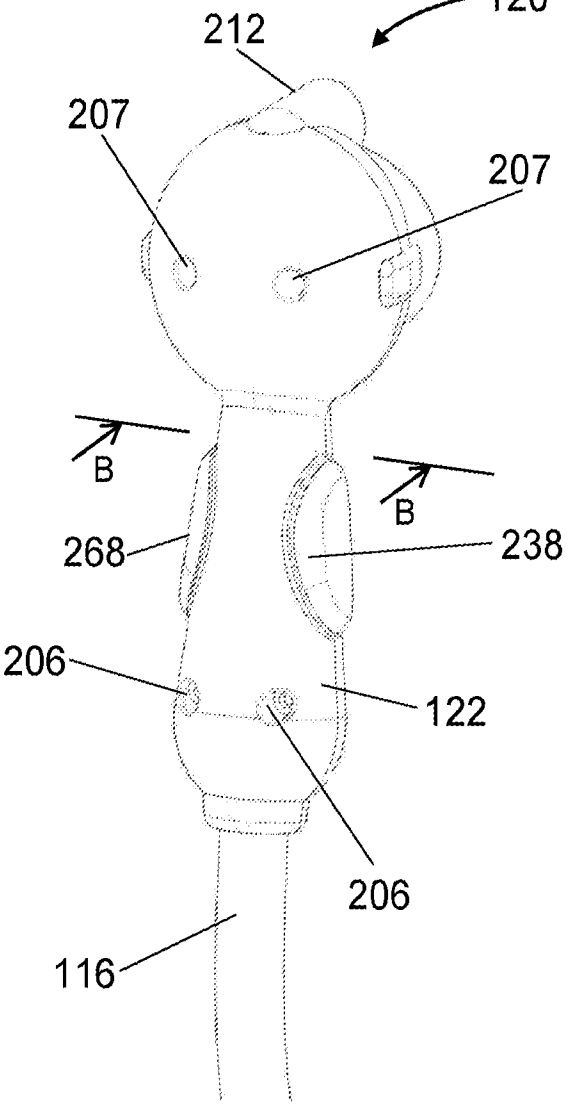
Figure 5A:
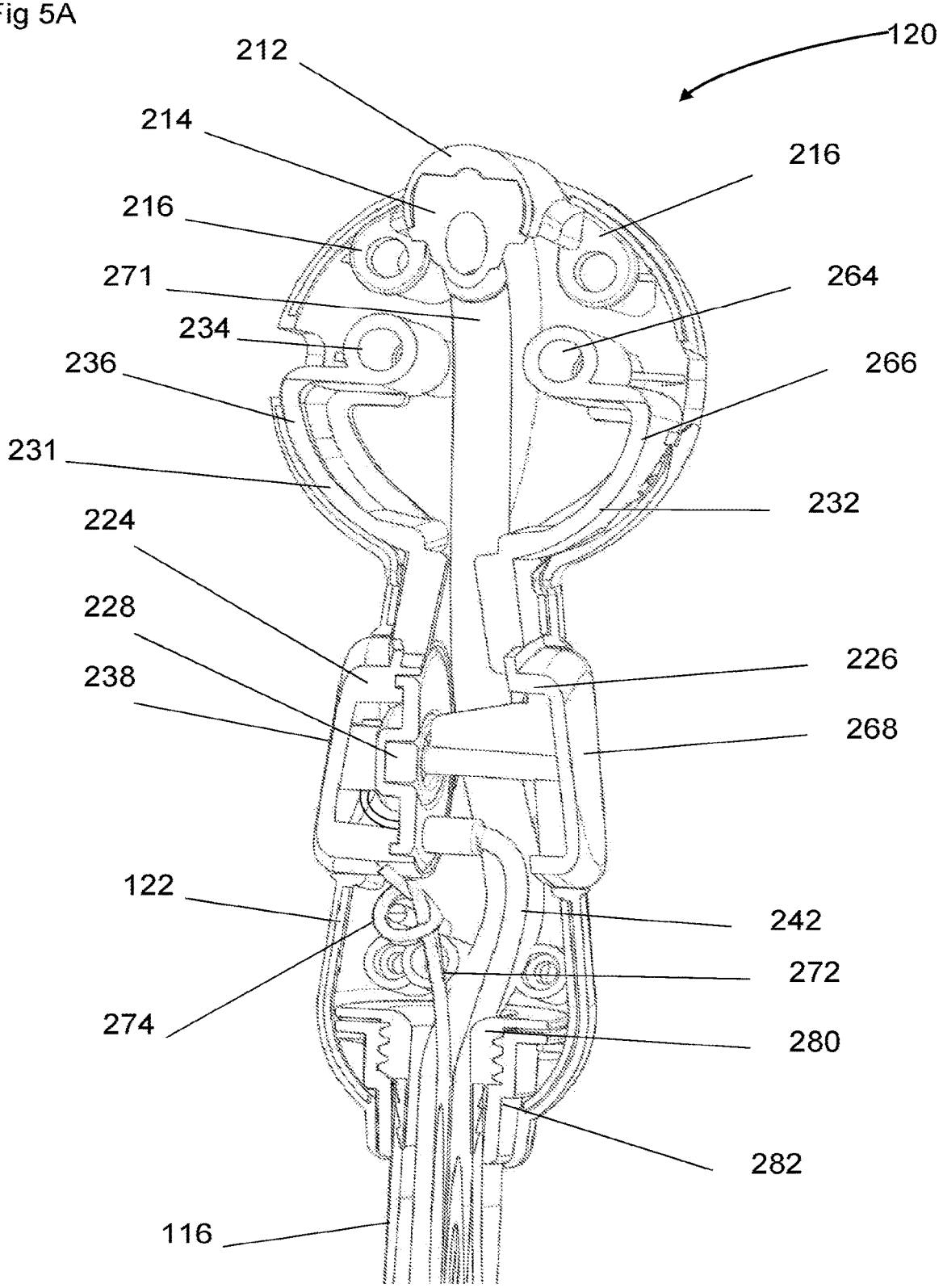
FIG. 5A is a simplified illustration of the interior of the nozzle and conduit portion of FIGS. 2-4B.
Figure 5B:
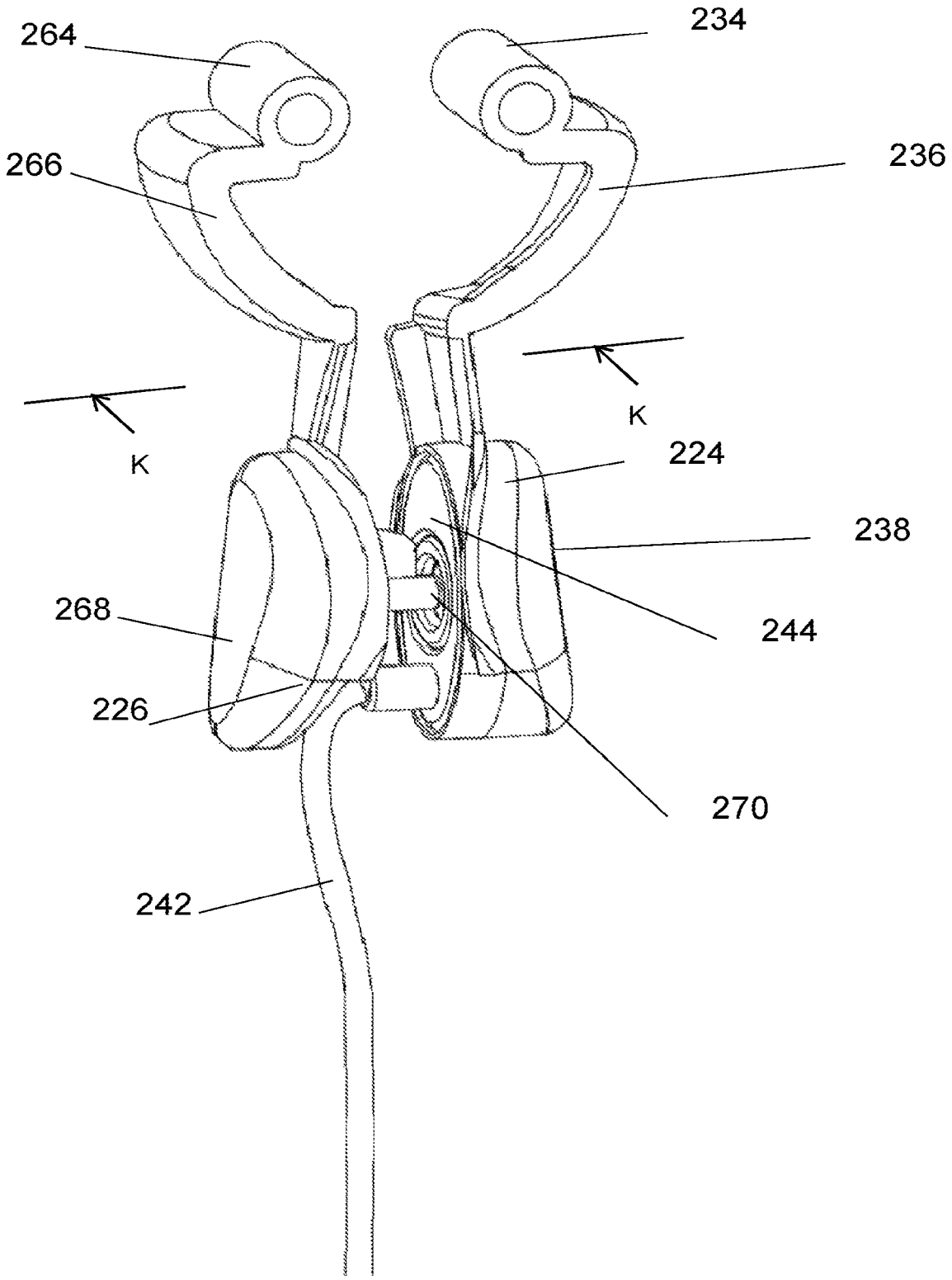
FIG. 5B is a simplified illustration of a spray control switch assembly forming part of the nozzle and conduit portion of FIGS. 2 and 5A.
Figure 5C:
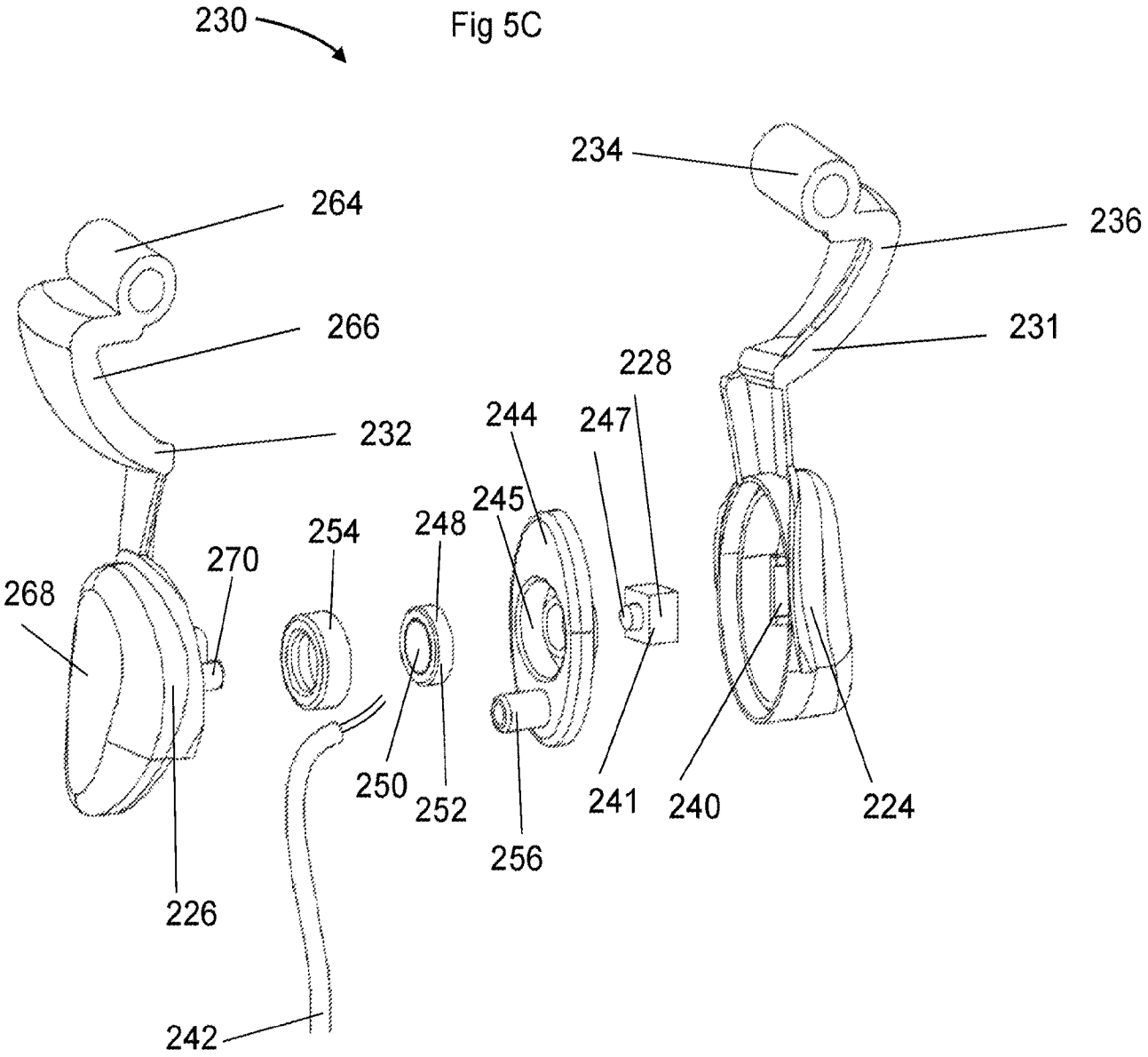
FIG. 5C is a simplified exploded view illustration of the spray control switch assembly of FIG. 5B.
Figure 5F:
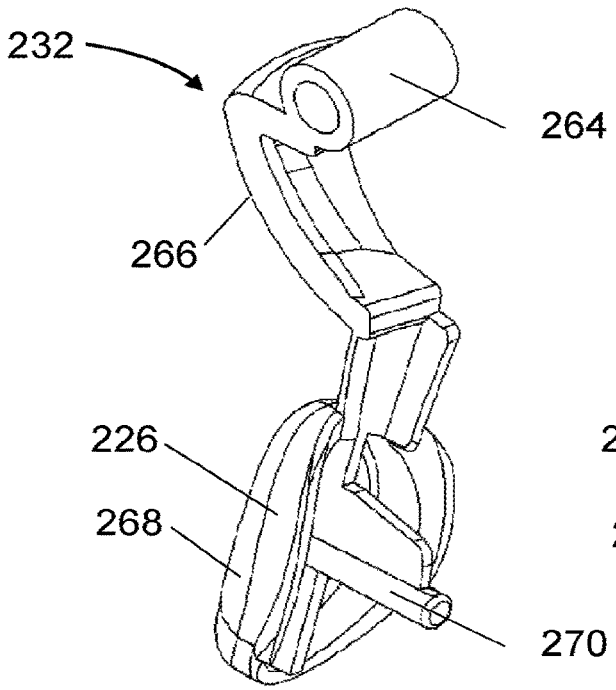
FIGS. 5F and 5G are simplified illustrations of a second push button element forming part of the spray control switch assembly of FIGS. 5B and 5C.
Figure 5D:
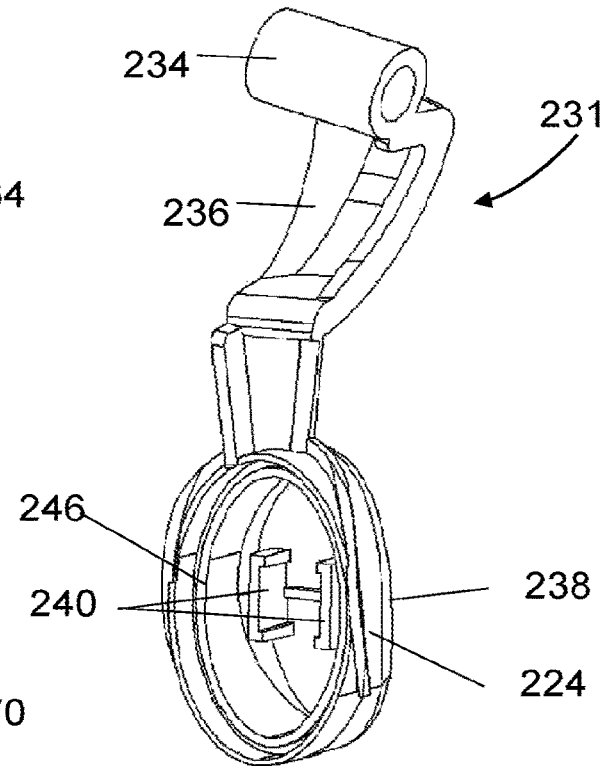
FIGS. 5D and 5E are simplified illustrations of a first push button element forming part of the spray control switch assembly of FIGS. 5B and 5C.
Figure 5G:
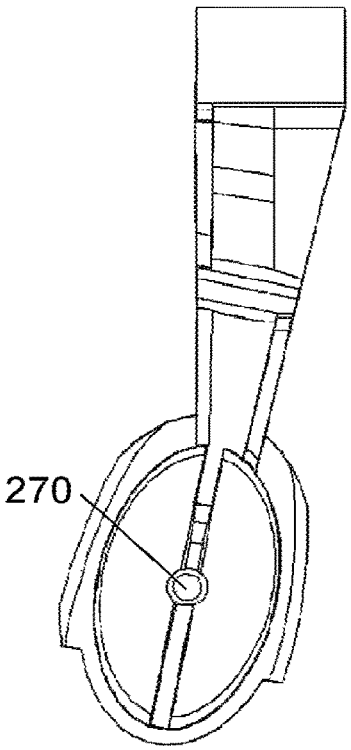
Figure 5E:
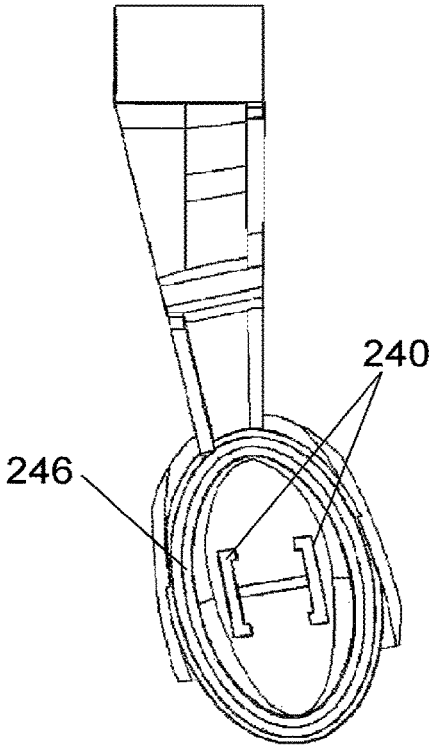
Figure 5I:
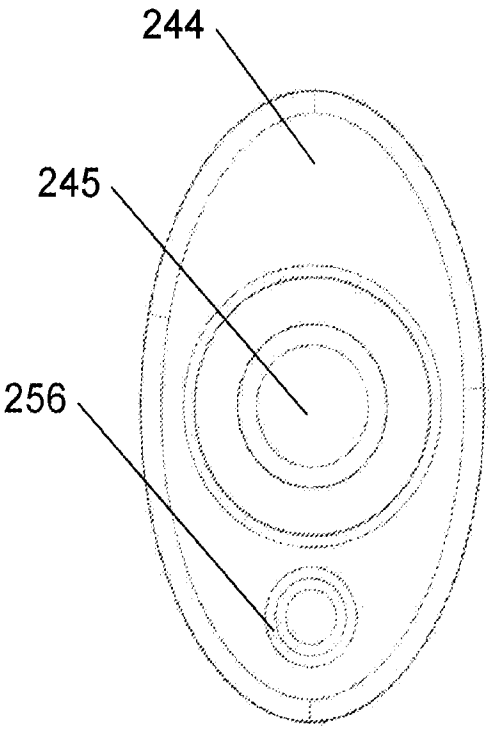
FIGS. 5H and 5I are simplified respective pictorial illustrations of opposite sides of a microswitch retaining and sealing element, forming part of the spray control switch assembly of FIGS. 5B and 5C.
Figure 5J:
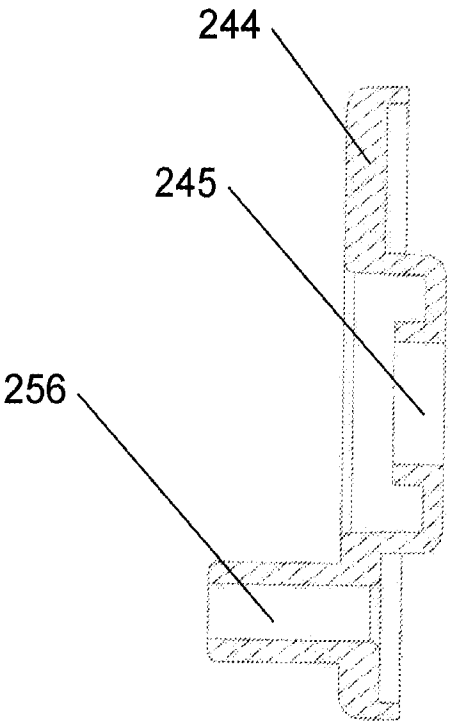
FIG. 5J is a simplified sectional illustration of the microswitch retaining element of FIGS. 5H and 5I, taken along lines J-J in FIG. 5H.
Figure 5H:
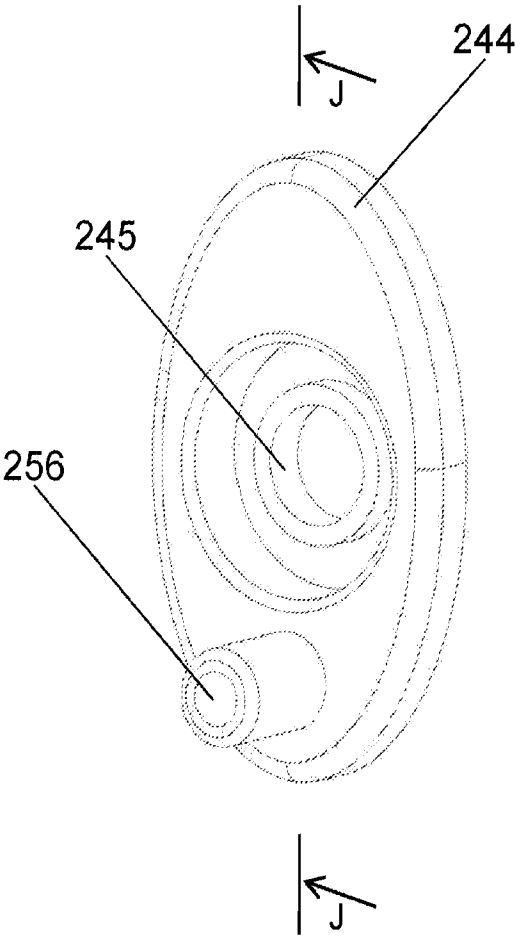
Figure 5K:
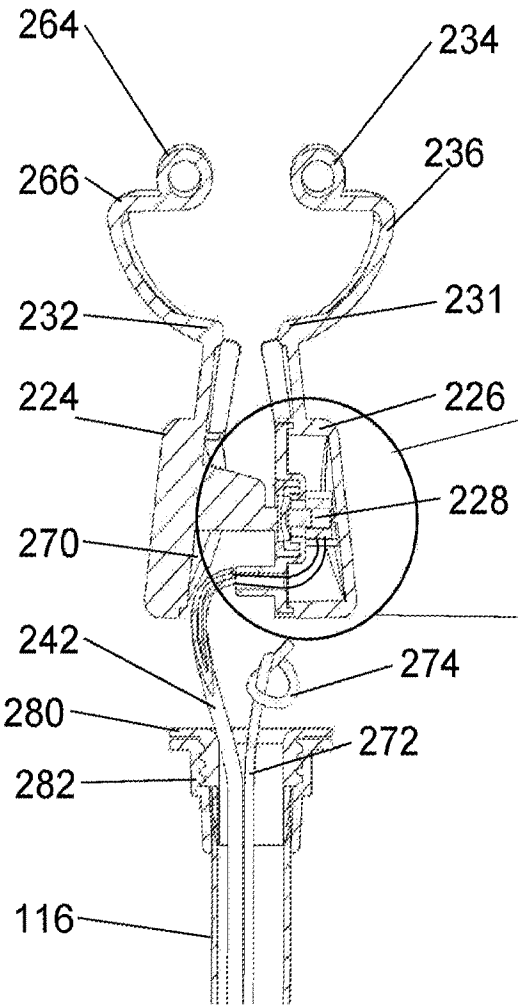
FIGS. 5K and 5L are simplified sectional illustrations, taken along lines K-K in FIG. 5B, each with an enlargement showing two operative orientations of the spray control switch assembly of FIGS. 5B-5J.
Figure 5L:
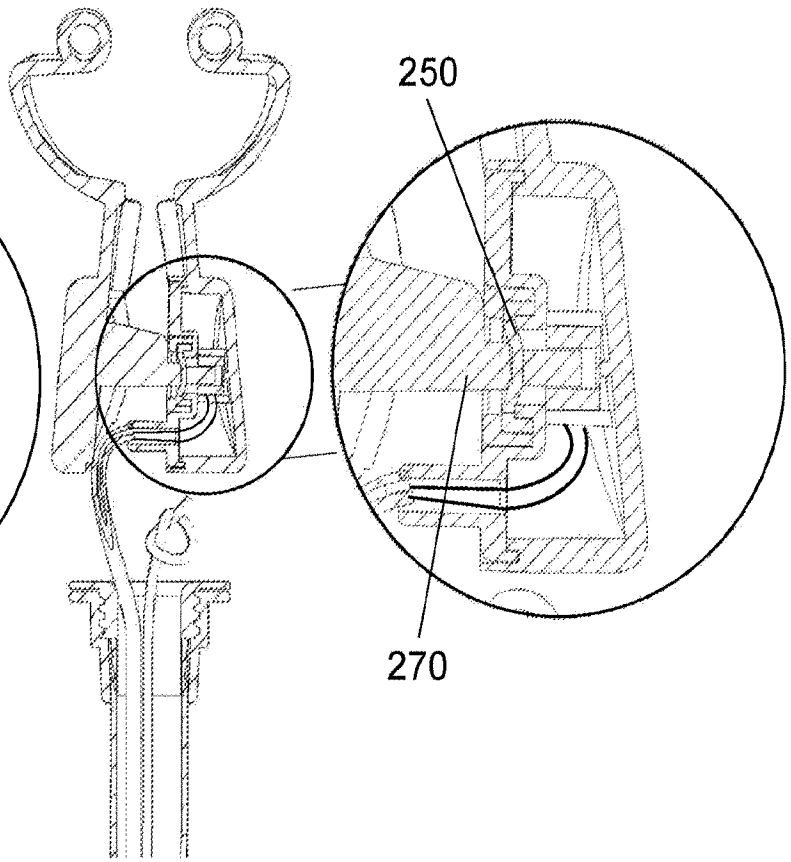
Figure 6B:
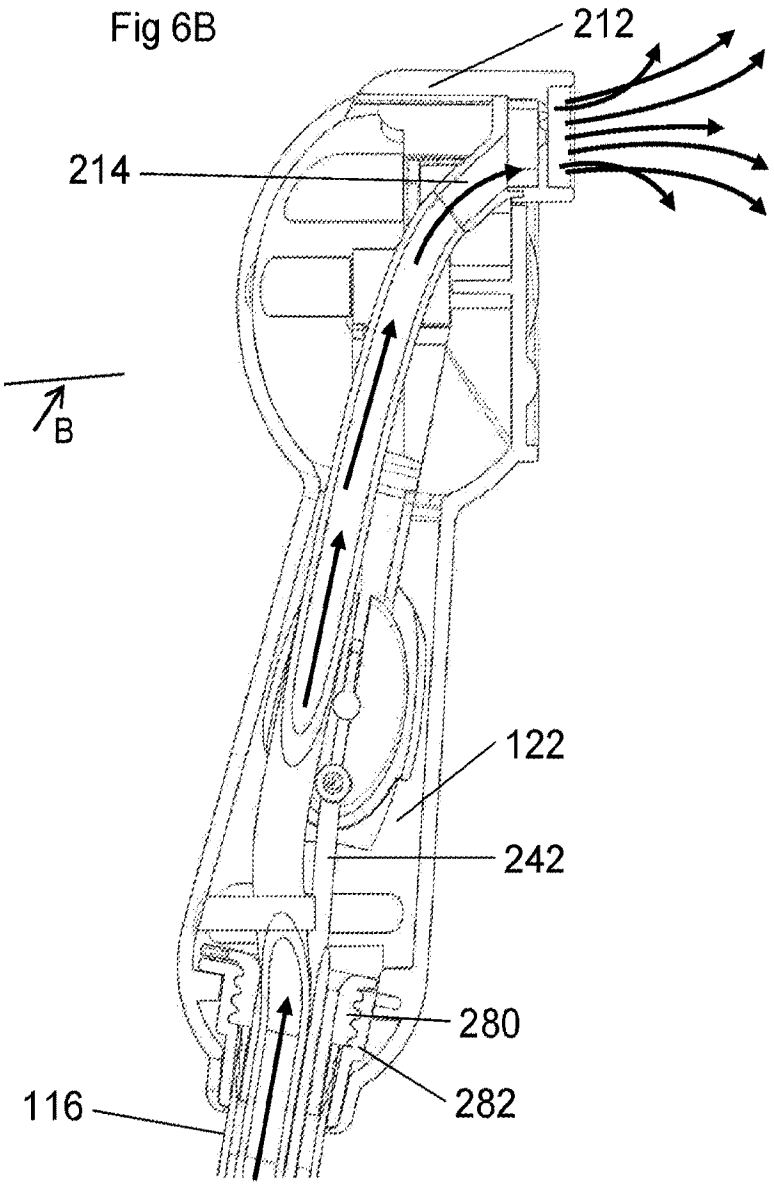
FIGS. 6A and 6B are simplified respective pictorial and sectional assembled view illustrations of a nozzle outlet element forming part of the nozzle and conduit portion of FIG. 2, FIG. 6B being taken along lines B-B in FIG. 6A.
Figure 6A:
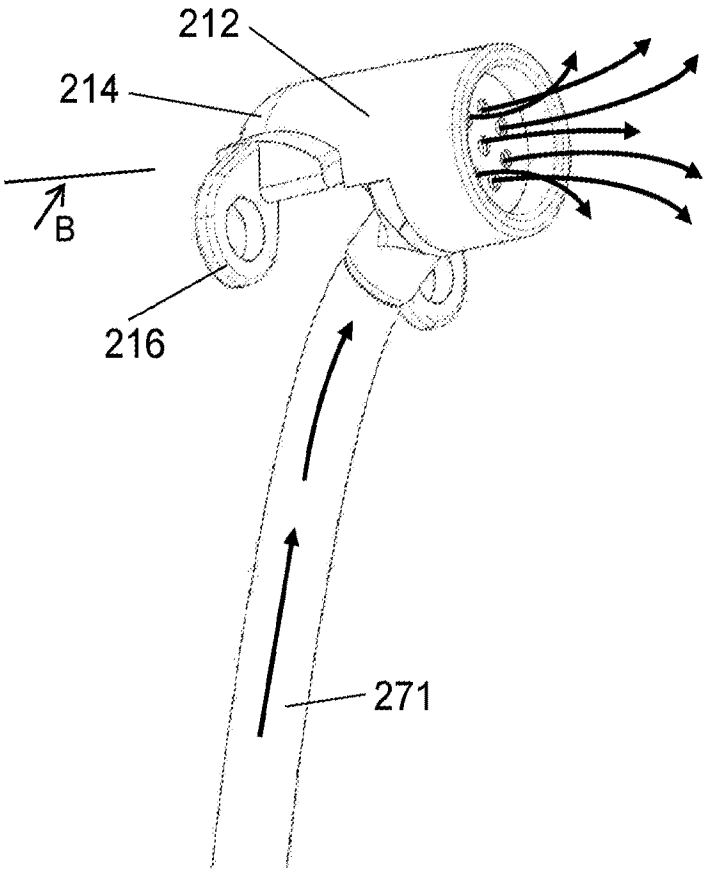

Reference is now made to FIG. 2, which is a simplified exploded view illustration of a nozzle and conduit portion of the combination pumped flow and gravitational flow bath toy system of FIG. 1, to FIGS. 3A and 3B, which are simplified pictorial and cut-away pictorial view illustrations of a forward nozzle housing element forming part of the nozzle conduit portion of FIG. 2, to FIGS. 4A and 4B, which are simplified pictorial and cut-away pictorial view illustrations of a rearward nozzle housing element forming part of the nozzle conduit portion of FIG. 2, to FIGS. 5A-5L, which illustrate a spray control switch assembly forming part of the nozzle conduit portion of FIG. 2, and to FIGS. 6A and 6B, which are simplified pictorial view and sectional view illustrations of a nozzle outlet element forming part of the nozzle conduit portion of FIG. 2.

As seen in FIGS. 2-6B, the nozzle and conduit portion includes nozzle portion 120, including nozzle housing 122, which is securely coupled to flexible conduit 116. Nozzle housing 122 includes a forward nozzle housing portion 200 and a rearward nozzle housing portion 202, which are preferably held together by a pair of lower screws 204 and a pair of upper screws 205, which extend through lower apertures 206 and upper apertures 207, respectively, in rear housing portion 200 and engage respective corresponding interiorly threaded lower bosses 208 and upper bosses 209 in forward housing portion 200.

Disposed within nozzle housing 122 and extending through an aperture 210 in front housing portion 200 is a nozzle outlet element 212, which preferably includes a pressurized water inlet 214 and a pair of mounting apertures 216, which enable mounting of the nozzle outlet element 212 onto the forward nozzle housing portion 200 by engagement with bosses 220 and 221 in forward housing portion 200.

Forward nozzle housing portion 200 and rearward nozzle housing portion 202 are each formed with a pair of mutually oppositely located side cut outs, designated respectively by reference numerals 222 and 223, which accommodate nozzle flow control push buttons 224 and 226, which together with an electrical nozzle flow control switch 228 and other elements described hereinbelow, define a spray control switch assembly 230, which will now be described in detail with particularly reference to FIGS. 5B-5L.

Nozzle flow control push buttons 224 and 226 form part of corresponding pivotably mounted push button elements, respectively designated by reference numerals 231 and 232.

Pivotably mounted push button element 231 preferably includes a pivotable mounting collar portion 234, which is arranged for pivotable mounting about a boss 209 in the forward housing portion 200. Collar portion 234 is coupled to a curved arm portion 236 from which extends push button 224. Push button 224 includes an outer-facing child hand engageable outer surface 238 and an inner, generally concave surface which partially defines an enclosure and includes pair of inner-facing protrusions 240, which define a seat for a microswitch 241, which is coupled to a electrical cable 242.

A microswitch retaining and sealing element 244 retains and seals microswitch 241 within the enclosure partially defined by the inner, generally concave surface of push button 224 and is sealingly seated within an inner circumferential recess 246 therein. Microswitch 241 includes a microswitch actuation button 247 and is preferably a part TS-2037, commercially available Hongkong Leader Industrial Company of 126 Yee Kuk Street, Sham Shui Po, Kowloon.

As seen particularly in FIG. 5C, microswitch retaining and sealing element 244 is a generally planar element having a central recess 245 for receiving a sealed flexible microswitch actuation assembly 248, including a flexible water-impermeable web portion 250, which is mounted in a ring mount 252. Sealed flexible microswitch actuation assembly 248 is preferably sealingly retained in central recess 245 by a retaining ring 254.

Microswitch retaining and sealing element 244 preferably includes a electrical cable conduit portion 256, which sealingly accommodates electrical cable 242.

Pivotably mounted push button element 232 preferably includes a pivotable mounting collar portion 264, which is arranged for pivotable mounting about a second boss 209 in the forward housing portion 200. Collar portion 264 is coupled to a curved arm portion 266 from which extends push button 226. Push button 226 includes an outer-facing child hand engageable outer surface 268 and an inner, facing protrusion 270 which, depending on the relative orientations of push button elements 231 and 232, may pushingly engage web portion 250 mounted onto microswitch retaining and sealing element 244 for actuating microswitch actuation button 247, as will be described hereinbelow in detail.

FIG. 5K illustrates a relative operative orientation of pivotably mounted push button elements 231 and 232 wherein neither of pushbuttons 224 and 226 is pressed. It is seen that protrusion 270 does not pushingly engage web portion 250 and does not actuate microswitch actuation button 247 and thus, preferably the switch is closed and no spray is provided.

FIG. 5L illustrates a relative operative orientation of pivotably mounted push button elements 231 and 232 wherein either or both of push buttons 224 and 226 is pressed. It is seen that protrusion 270 pushingly engages web portion 250 and actuates microswitch actuation button 247 and thus, preferably the switch is open and a spray is produced. It is appreciated, that alternatively a microswitch may be employed which provides a variable volume spray, which may vary from no spray to a spray of a maximum volume.

Water inlet 214 of nozzle outlet element 212 is preferably fixedly coupled to a water supply conduit 271, which, together with electrical cable 242, extends through flexible conduit 116. It is a particular feature of an embodiment of the present invention that there is provided a security cable 272, preferably formed of NYLON of diameter 1.5 mm, which is fixedly coupled at a looped end 274 to forward housing portion engagement in engagement with a boss 276 in forward housing portion 200, such as by placement of looped end 274 over boss 276, and serves to prevent disconnection of the flexible conduit 116, as well as electrical cable 242 and water supply conduit 271, from the nozzle housing 122 (FIG. 1) and from the pump portion 110 (FIG. 1).

Flexible conduit 116 is preferably mounted onto both forward and rearward nozzle housing portions 200 and 202 by means of upper and lower mutually threaded coupling elements 280 and 282, which retain an end of flexible conduit 116 under pressure from the threaded engagement therebetween. Lower coupling element 282 is retained within forward and rearward housing portions 200 and 202 by an inner-facing circumferential protrusion 284 formed at the interior of housing portions 200 and 202. Rotation of the lower coupling element 282 and thus of the flexible conduit 116 relative to forward and rearward nozzle housing portions 200 and 202 is prevented by engagement of an internal protrusion 286 of the forward housing portion 200 with a corresponding slot 288 formed in lower coupling element 282.

Reference is now made to FIGS. 7A, 7B, 7C and 7D, which are simplified pictorial view illustrations of four operational states of the spray control switch assembly of housing 120 and to FIGS. 8A, 8B, 8C and 8D, which are simplified sectional illustrations corresponding to FIGS. 7A, 7B, 7C and 7D, taken along section lines B-B in FIG. 4A.

Figure 8A:
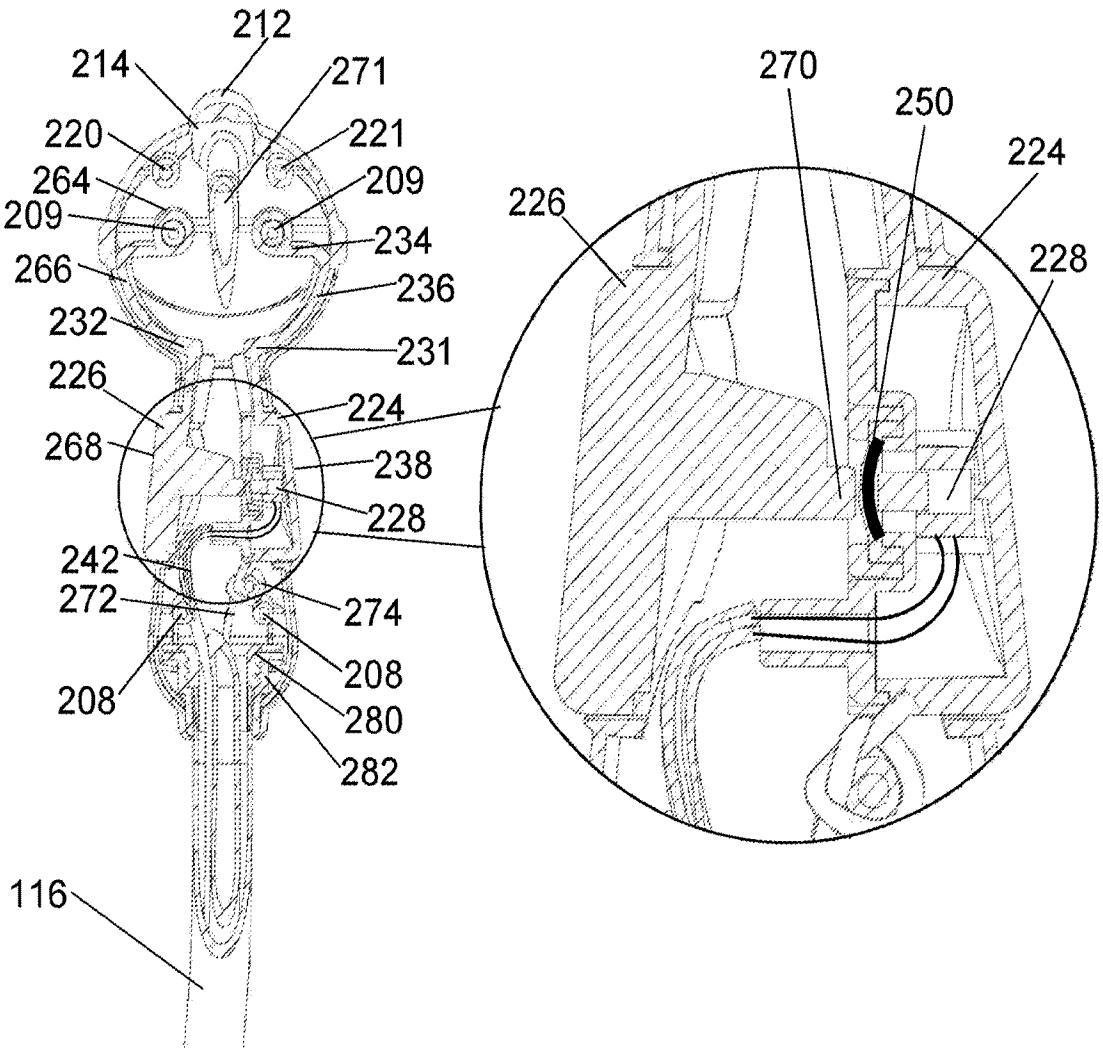
FIGS. 8A, 8B, 8C and 8D are simplified sectional illustrations corresponding to FIGS. 7A, 7B, 7C and 7D.
Figure 7A:
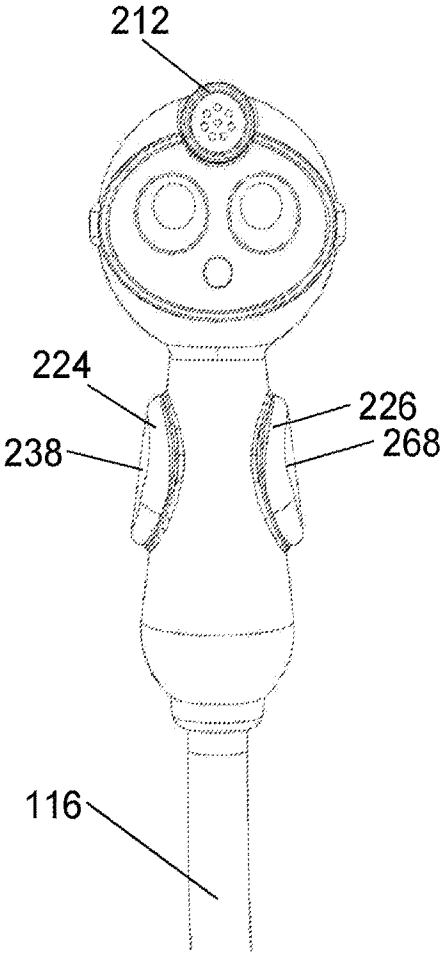
FIGS. 7A, 7B, 7C and 7D are simplified pictorial illustrations of four operational states of the spray control switch assembly of the nozzle portion in the embodiment of FIGS. 1-6B.

FIGS. 7A and 8A illustrate a first operative orientation wherein neither of push buttons 226 and 228 is pressed and the microswitch is not actuated and no spray is produced.

Figure 8B:
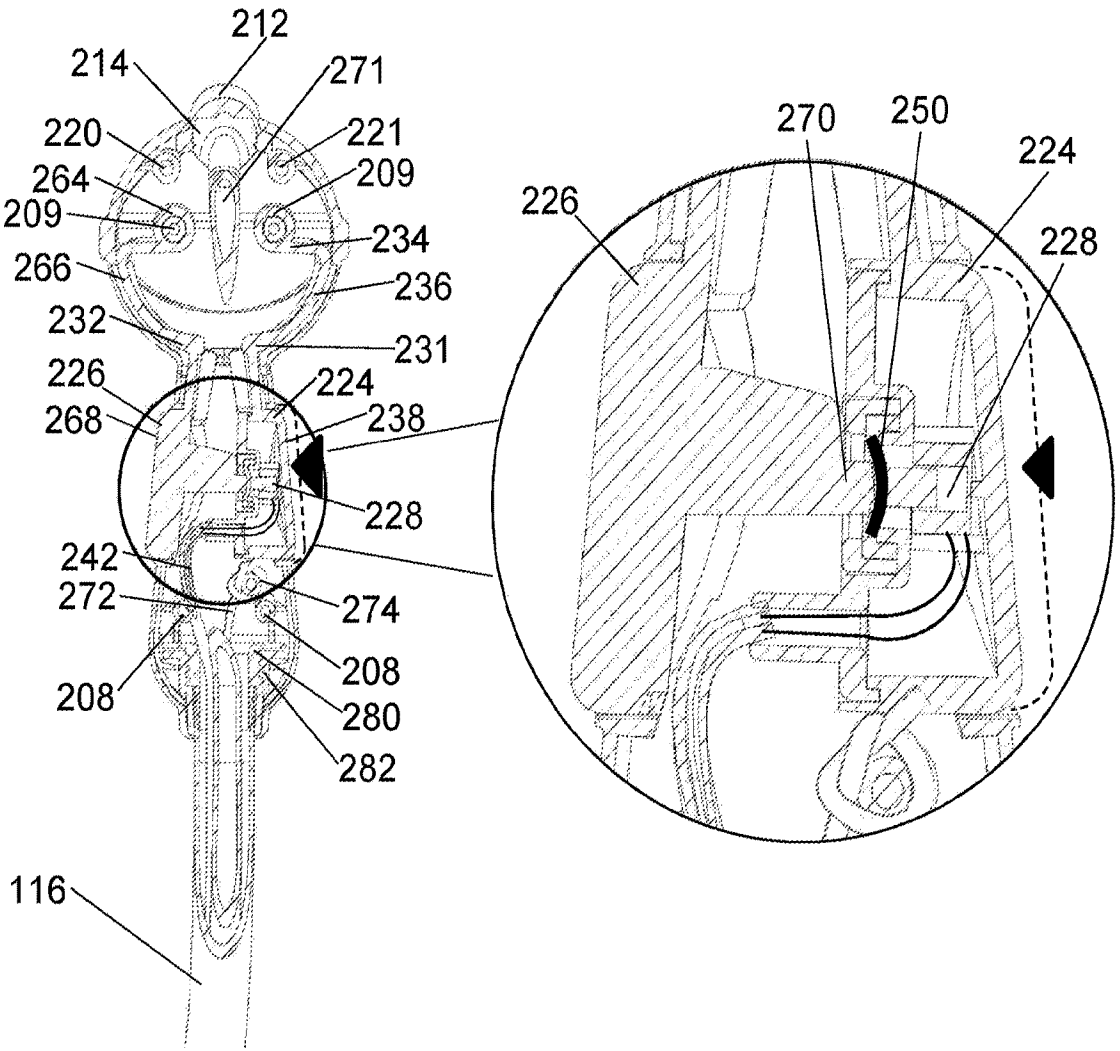
Figure 7B:
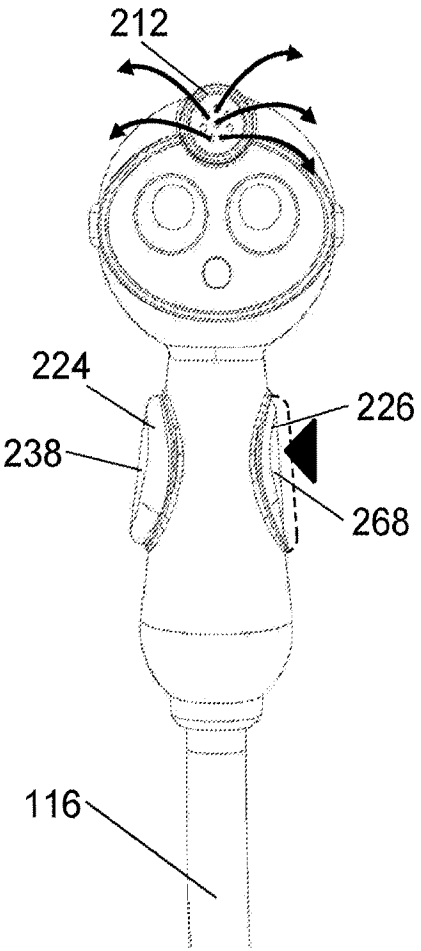

FIGS. 7B and 8B illustrate a second operative orientation wherein push button 226 is pressed, causing protrusion 270 to pushingly engage web portion 250 and actuate microswitch 241, thereby producing a spray.

Figure 8C:
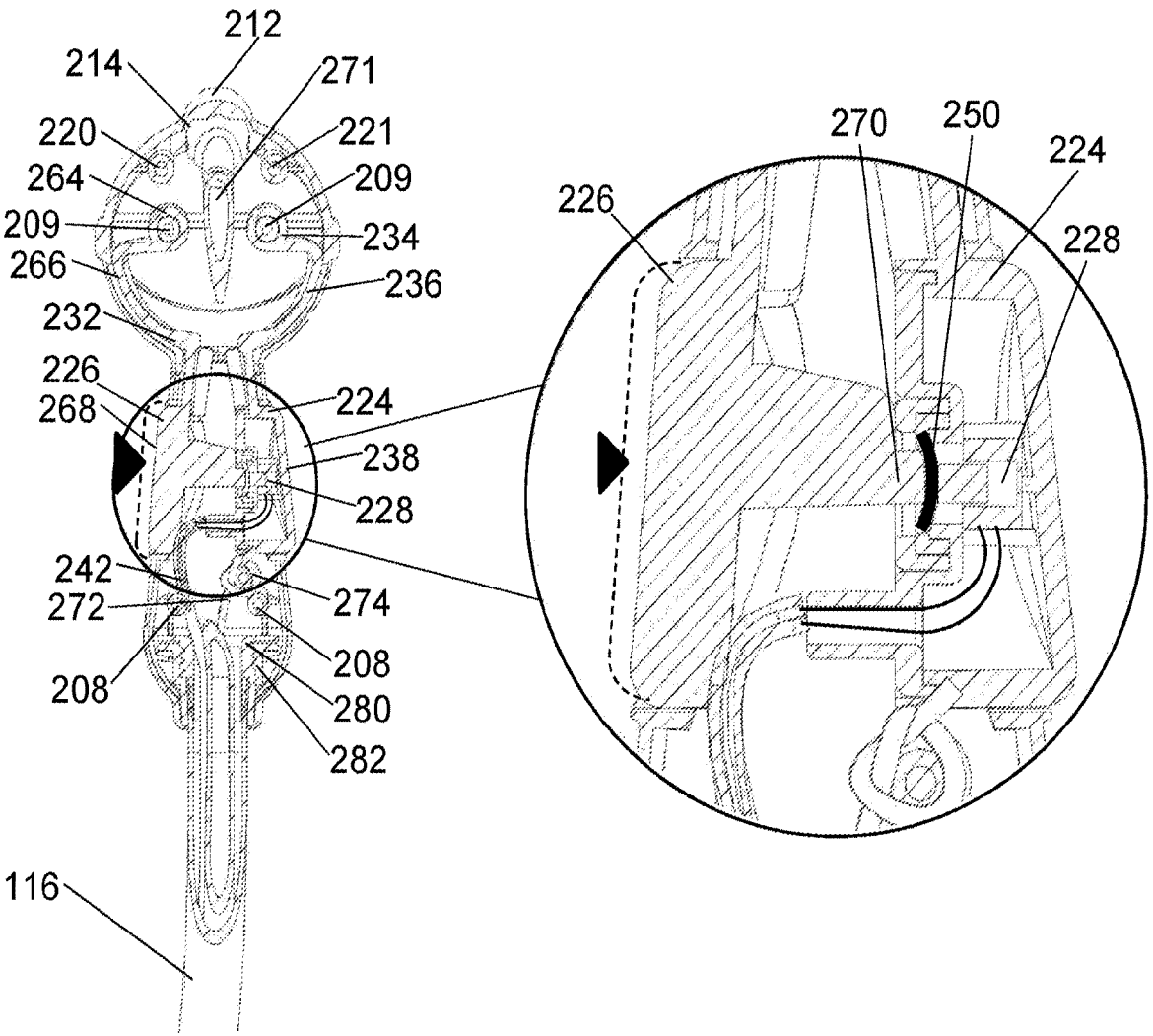
Figure 7C:
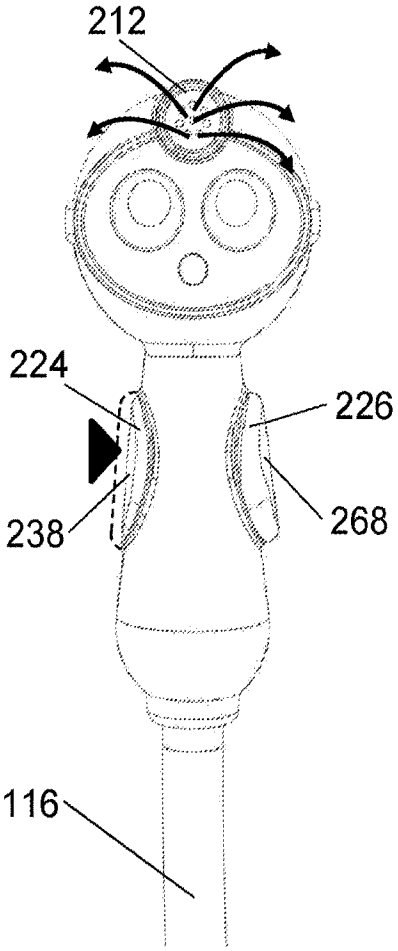

FIGS. 7C and 8C illustrate a third operative orientation wherein push button 224 is pressed, causing protrusion 270 to pushingly engage web portion 250 and actuate microswitch 241, thereby producing a spray.

Figure 8D:
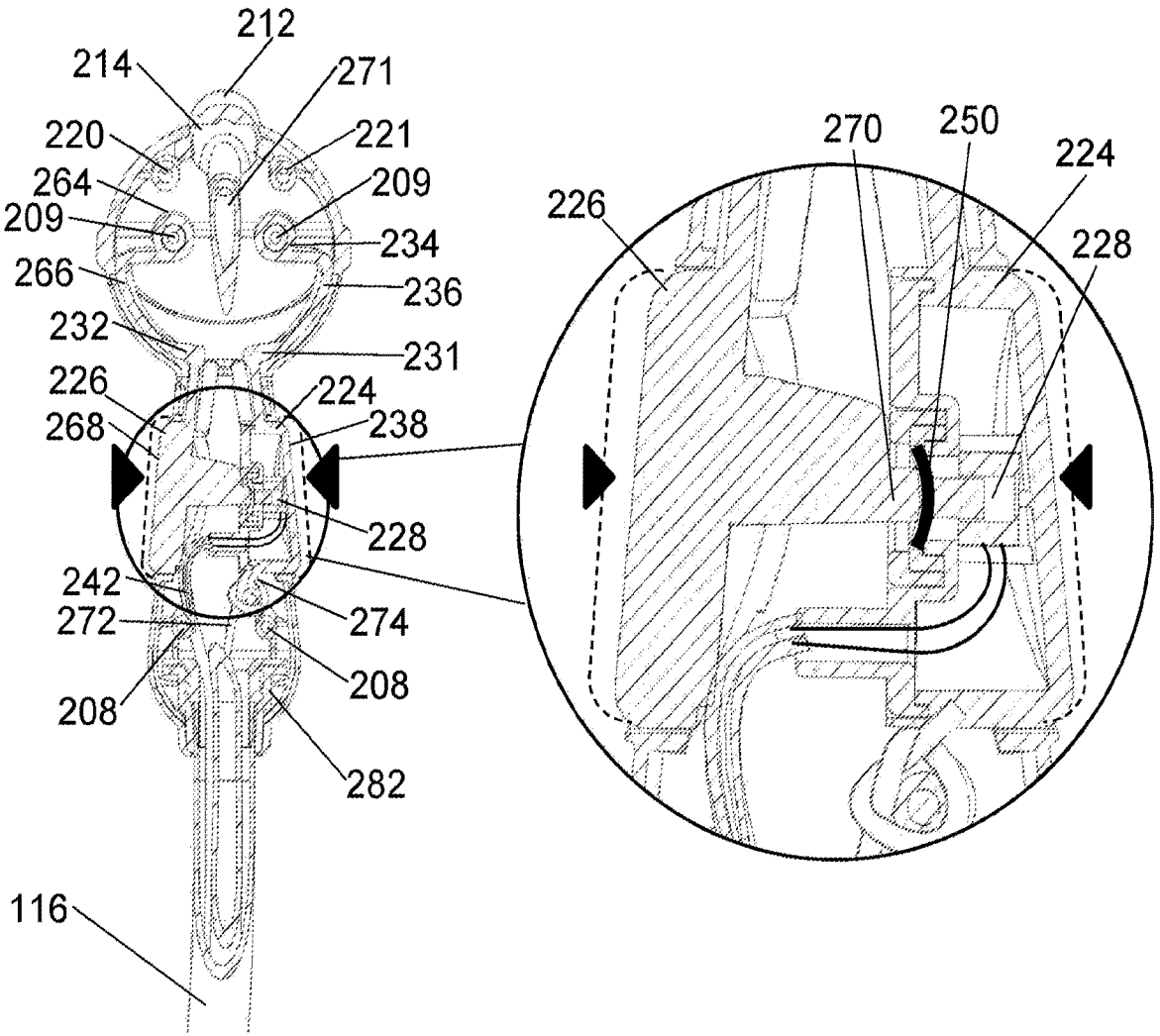
Figure 7D:
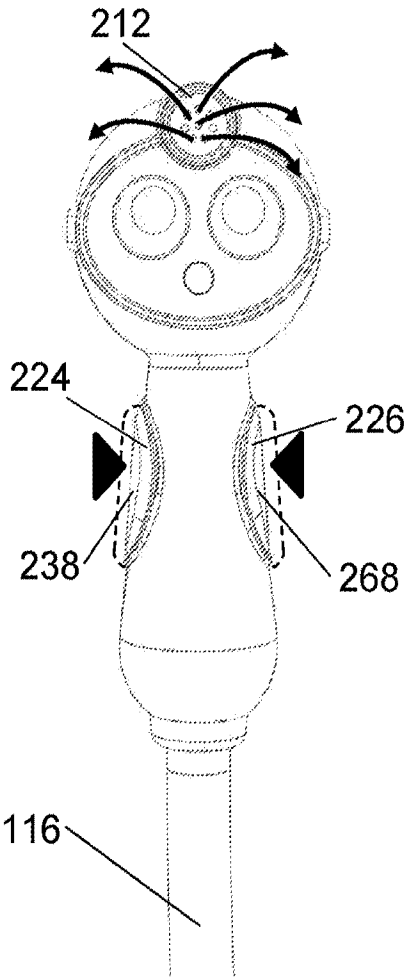

FIGS. 7D and 8D illustrate a fourth operative orientation wherein both push buttons 224 and 226 are simultaneously pressed, causing protrusion 270 to pushingly engage web portion 250 and actuate microswitch 241, thereby producing a spray.

Figure 9A:
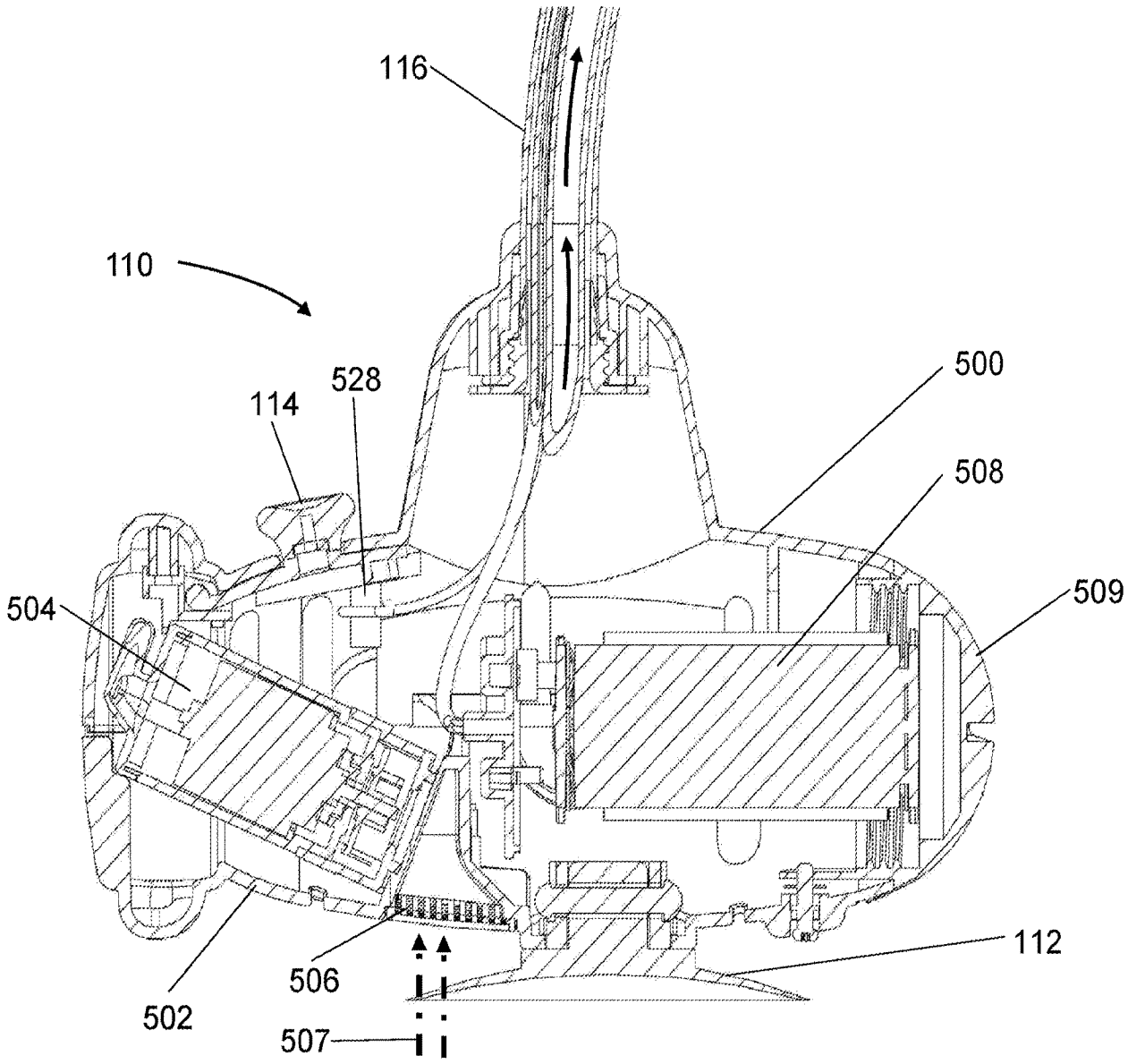
FIGS. 9A, 9B, 9C and 9D are, respectively, a simplified sectional illustration of a pump portion of the combination pumped flow and gravitational flow bath toy system of FIG. 1, taken along lines A-A in FIG. 1, a simplified sectional illustration of a pump portion of the combination pumped flow and gravitational flow bath toy system of FIG. 1, taken along lines B-B in FIG. 1, a simplified partially cut-away illustration of the pump portion taken in a direction indicated by an arrow C in FIG. 1 and a simplified exploded view illustration of the pump portion of FIGS. 9A and 9B.
Figure 9B:
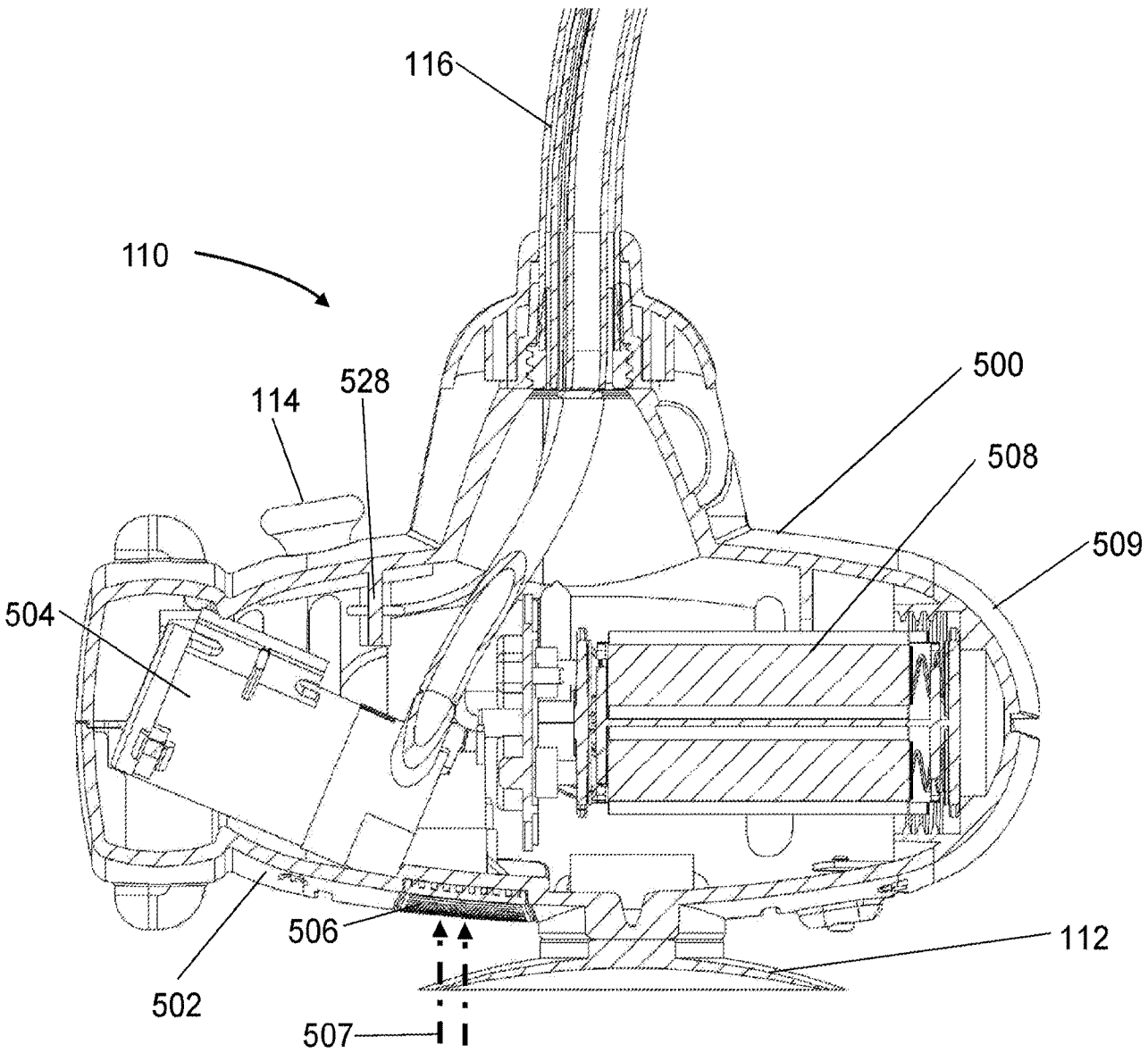
Figure 9C:
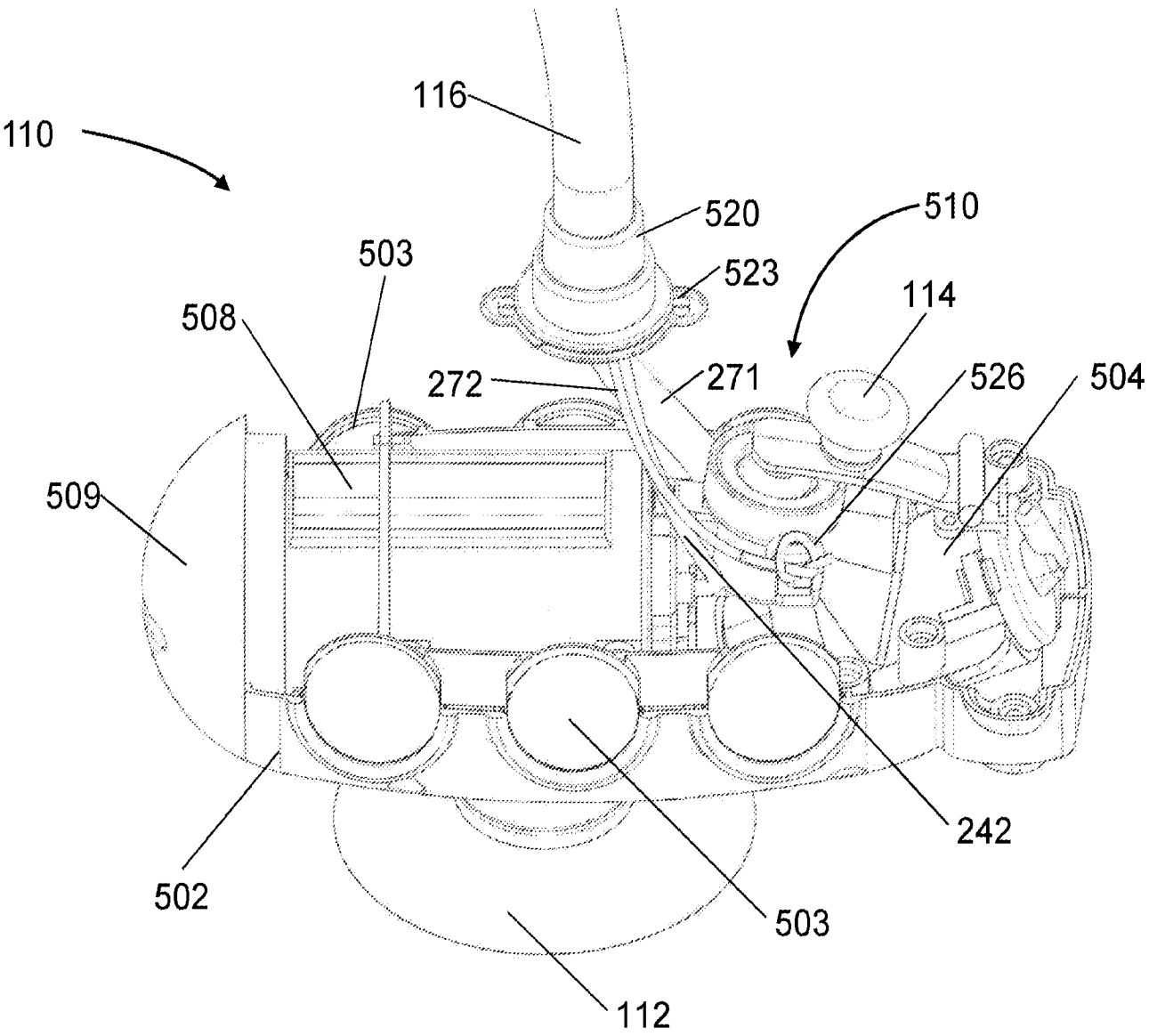
Figure 9D:
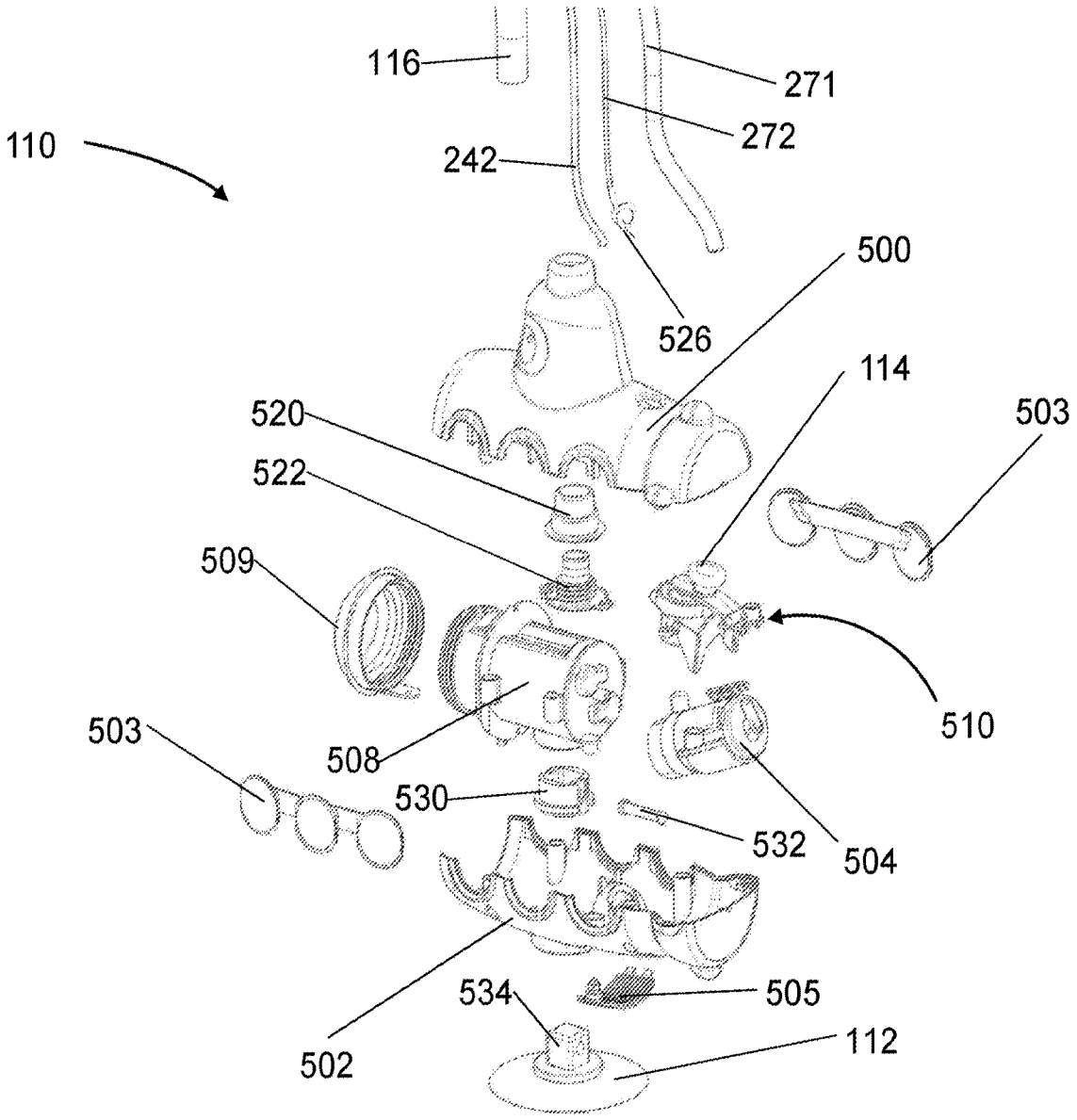

Reference is now made to FIGS. 9A, 9B, 9C and 9D, which are, respectively, a simplified sectional illustration of pump portion 110 of the combination pumped flow and gravitational flow bath toy system of FIG. 1, taken along lines A-A in FIG. 1, a simplified sectional illustration of pump portion 110 of the combination pumped flow and gravitational flow bath toy system of FIG. 1, taken along lines B-B in FIG. 1, a simplified partially cut-away illustration of the pump portion 110, taken in a direction indicated by an arrow C in FIG. 1, and a simplified exploded view illustration of the pump portion of FIGS. 9A and 9B.

As seen in FIGS. 9A-9D and as indicated hereinabove with reference to FIG. 1, pump portion 110 is adapted to be immersed in water during operation and may be removably secured to a bottom of a bathtub (not shown) by a vacuum cup 112. Pump portion preferably includes an ON/OFF switch 114, which is preferably adult operable and not child operable, and is coupled, via flexible conduit 116, with nozzle portion 120.

As seen in FIGS. 9A-9D, the pump portion includes top and bottom pump housing portions 500 and 502 and a pair of porthole defining side elements 503, which together enclose an electrically operated water pump 504, which receives water from outside the bottom pump housing portion 502 via a filter 505 at a water inlet 506 as indicated by arrows 507. Water pump 504 is powered by electrical power from a water sealed battery pack 508 including a threaded cover 509. The operation of water pump 504 is controlled by an electrical control assembly 510, which is coupled to an electrical supply from battery pack 508 and receives control inputs via electrical cable 242 and from ON/OFF switch 114.

Flexible conduit 116 is mounted onto top pump housing portion 500 by means of upper and lower coupling elements 520 and 522, which are mounted in top pump housing portion 500, preferably by screws (not shown) inserted through apertures 523 into bosses (not shown) formed in the interior of top pump housing portion 500. Mounting of flexible conduit to top pump housing portion 500 is similar to the mounting of flexible conduit to nozzle portion 120 described hereinabove.

A looped end 526 of security cable 272 is fixedly secured to a protrusion 528 and serves to prevent disconnection of the flexible conduit 116, as well as electrical cable 242 and water supply conduit 271, from the top pump housing portion 500.

Pump portion 110 is rotatably attached to vacuum cup 112 by securing cap 530 and peg 532 which enable bottom pump housing portion 502 to rotatably engage protrusion 534 on vacuum cup 112.

Figure 10A:
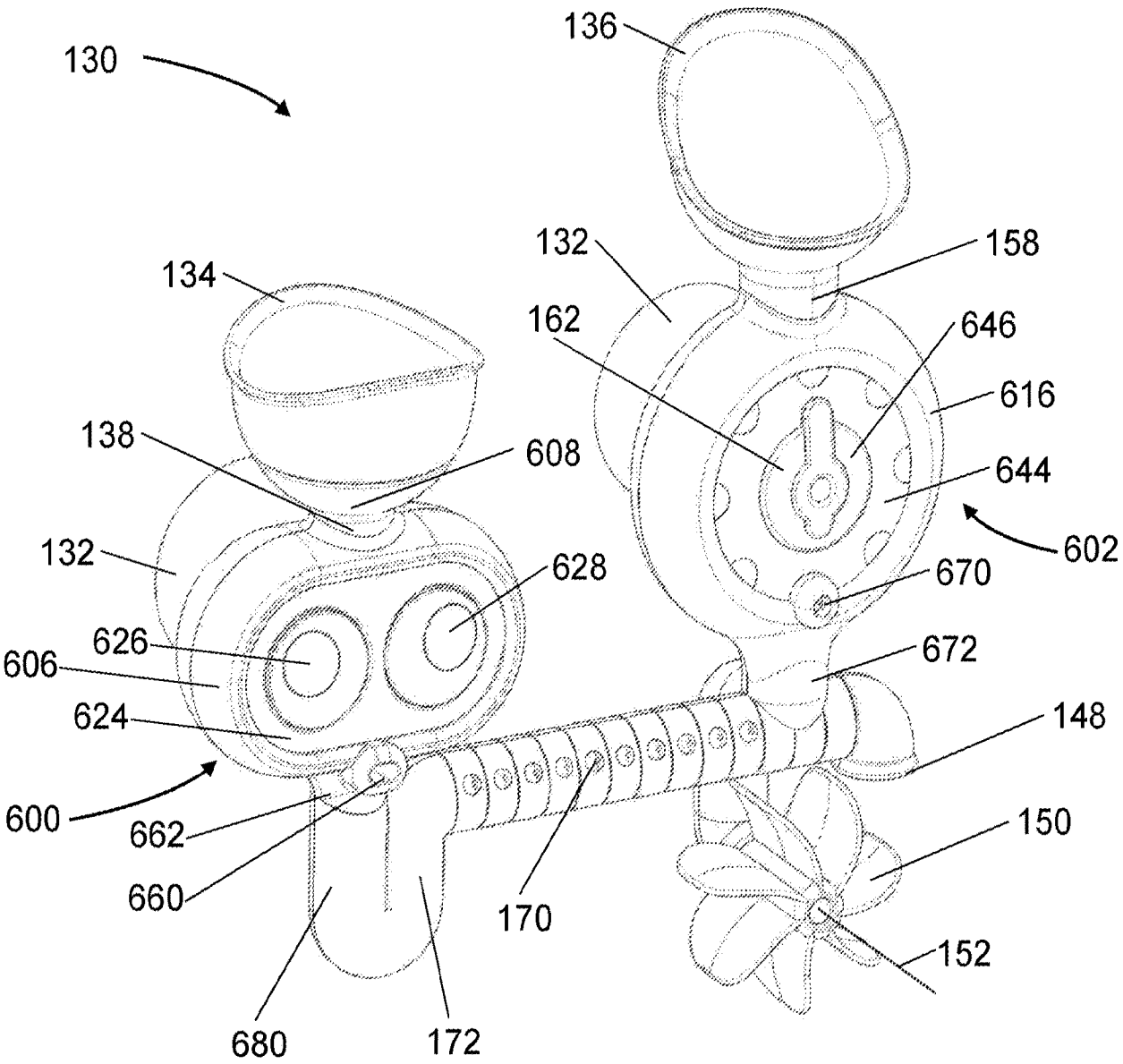
FIGS. 10A, 10B and 10C are, respectively, simplified front pictorial and rear pictorial, exploded view illustrations of a multi-directional mutually intersecting gravitational flow portion of the combination pumped flow and gravitational flow bath toy system of FIGS. 1-9C.
Figure 10B:
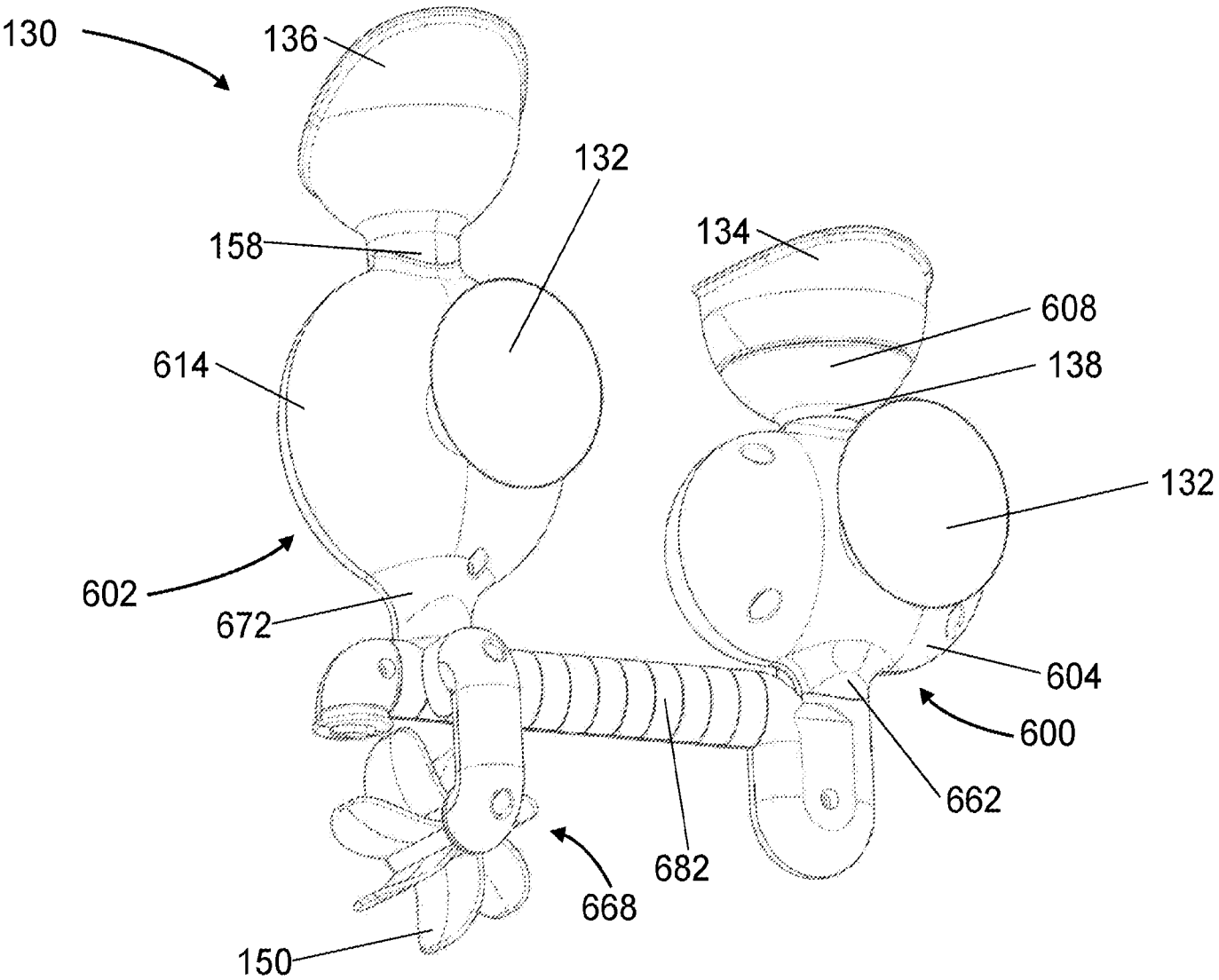
Figure 10C:
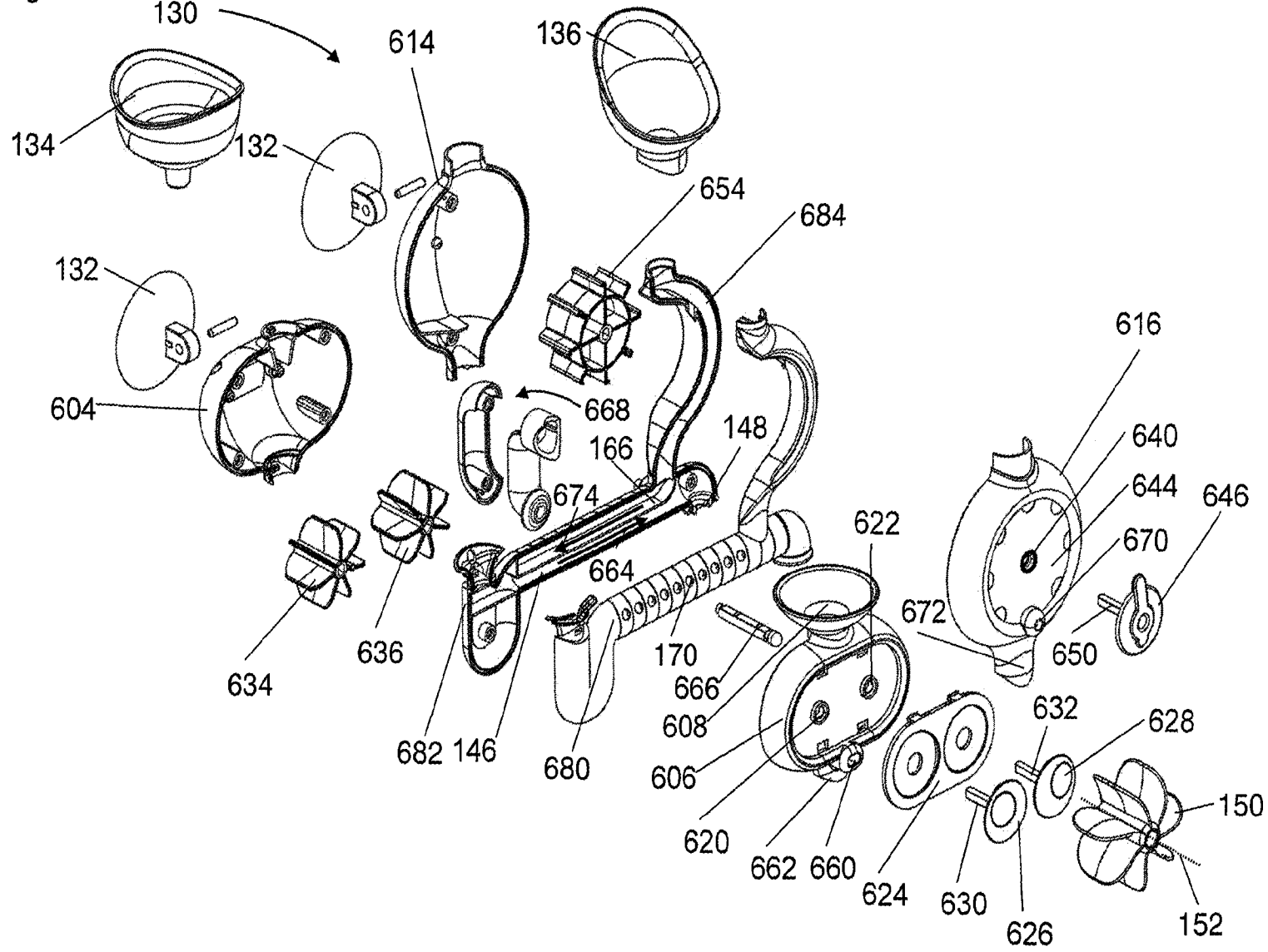

Reference is now made to FIGS. 10A, 10B and 10C, which are respectively simplified front pictorial, rear pictorial and exploded view illustrations of multi-directional mutually intersecting gravitational flow portion 130 of the combination pumped flow and gravitational flow bath toy system 100 of FIGS. 1-9C.

As noted above in the description of FIG. 1, the multi-directional mutually-intersecting gravitational flow portion 130 is adapted to receive water sprayed from nozzle 124, when actuated by even a very young child. The multi-directional mutually-intersecting gravitational flow portion 130 preferably is adapted to be mounted on a generally vertical surface, such as a side wall or end wall of a bathtub (not shown) and preferably is provided with suction cups 132 for this purpose. It is appreciated that water may be supplied to the multi-directional mutually-intersecting gravitational flow portion 130 other than from nozzle 124.

In accordance with a preferred embodiment of the present invention, the multi-directional mutually-intersecting gravitational flow portion 130, preferably includes at least two water receiving receptacles 134 and 136, which supply water via respective vertical conduits 138 and 158 to respective first and second gravity flow water-driven turbines 140 and 160, which are located inside respective turbine housing assemblies 600 and 602.

Turbine housing assembly 600 includes a rearward housing portion 604 and a forward housing portion 606, which is formed with a funnel inlet 608. Turbine housing assembly 602 includes a rearward housing portion 614 and a forward housing portion 616.

Both of forward housing portions 606 and 616 are preferably formed with fanciful visually sensible elements. Forward housing portion 606 is preferably formed with a pair of apertures 620 and 622 for accommodating turbine driven drive shafts, a forward face plate 624, here showing a pair of fanciful eye portions and a pair of rotatable elements 626 and 628 each representing an off-center eye pupil and having respective drive shafts 630 and 632, which extend through respective apertures 620 and 622 and are driven by respective turbine wheels 634 and 636, located within turbine housing assembly 600. Operation of the turbine in turbine housing assembly 600 provides a visually sensible googly eye appearance by virtue of rotation of rotatable elements 626 and 628.

Forward housing portion 616 is preferably formed with a single aperture 640 for accommodating a turbine driven drive shaft, a forward face plate 644, here showing a fanciful clock face, and a rotating object 162 (FIG. 1) defined by rotatable element 646 representing a clock dial and having a drive shaft 650, which extends through aperture 640 and is driven by a turbine wheel 654, located within turbine housing assembly 602. Operation of the turbine in turbine housing assembly 602 provides a visually sensible moving clock by virtue of rotation of rotatable element 646.

Forward housing portion 606 of turbine housing assembly 600 preferably includes a relatively small forward-facing water outlet aperture 660 and a relatively large downward-facing water outlet aperture 662 which, as noted generally above with respect to FIG. 1, is preferably coupled to generally horizontal conduit 146, which extends transversely in a first horizontal direction indicated by an arrow 664, to an outlet 148, which directs the water into driving engagement with second gravity flow water-drive turbine 150, typically in the shape of a pinwheel, which rotates on an axle 666 about rotation axis 152, which extends generally perpendicularly to generally horizontal conduit 146. Rotation axle 666 is mounted on a support assembly 668.

Forward housing portion 616 of turbine housing assembly 602 preferably includes a relatively small forward-facing water outlet aperture 670 and a forward portion of a relatively large downward-facing water outlet aperture 672 which, as noted generally above with respect to FIG. 1, is preferably coupled to generally horizontal conduit 166, generally parallel to horizontal conduit 146 and transversely in a second direction, indicated by an arrow 674, opposite to the first direction indicated by arrow 664. Generally horizontal conduit 166 preferably is formed with a linear, generally horizontal array of parallel spray outlets 170. As seen in FIG. 10C rearward housing portion 614 includes a rearward portion of relatively large downward-facing water outlet aperture 672.

It is a particular feature of an embodiment of the invention that generally horizontal conduit 146 and generally horizontal conduit 166 are together constructed to have a common outer housing. 172, which in fact defines two generally horizontal water conduits 146 and 166, arranged to accommodate two separate gravitationally driven flows in mutually opposite generally horizontal directions. Common outer housing 172 preferably is formed of forward and rearward housing portions 680 and 682, which together define a generally vertical water conduit from 684 from water outlet aperture 672 to generally horizontal conduit 166, generally parallel to horizontal conduit 146.

The horizontal array of parallel spray outlets 170 is defined by forward housing portion 680, while generally horizontal conduits 146 and 166 are jointly defined by forward housing portion 680 and rearward housing portion 682.

Figure 11A:
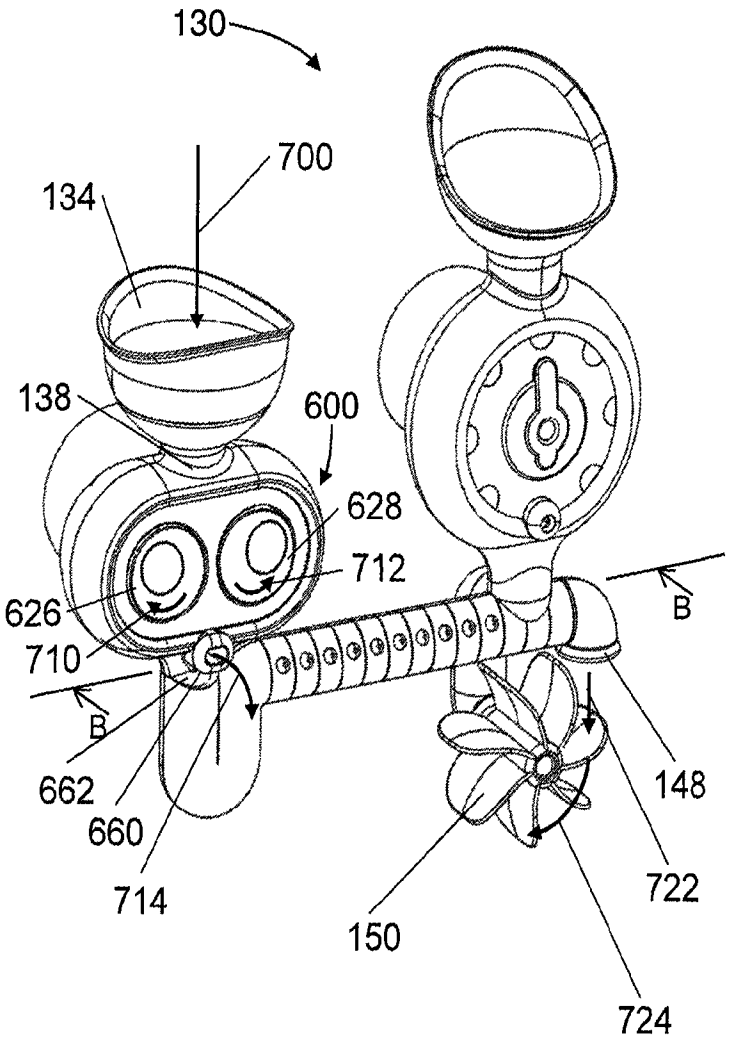
FIGS. 11A and 11B are simplified pictorial and sectional illustrations of a first gravitational flow mode of operation of the multi-directional mutually intersecting gravitational flow portion of FIGS. 10A-10C of the combination pumped flow and gravitational flow bath toy system of FIGS. 1-10C, FIG. 11B being taken along lines B-B in FIG. 11A.
Figure 11B:
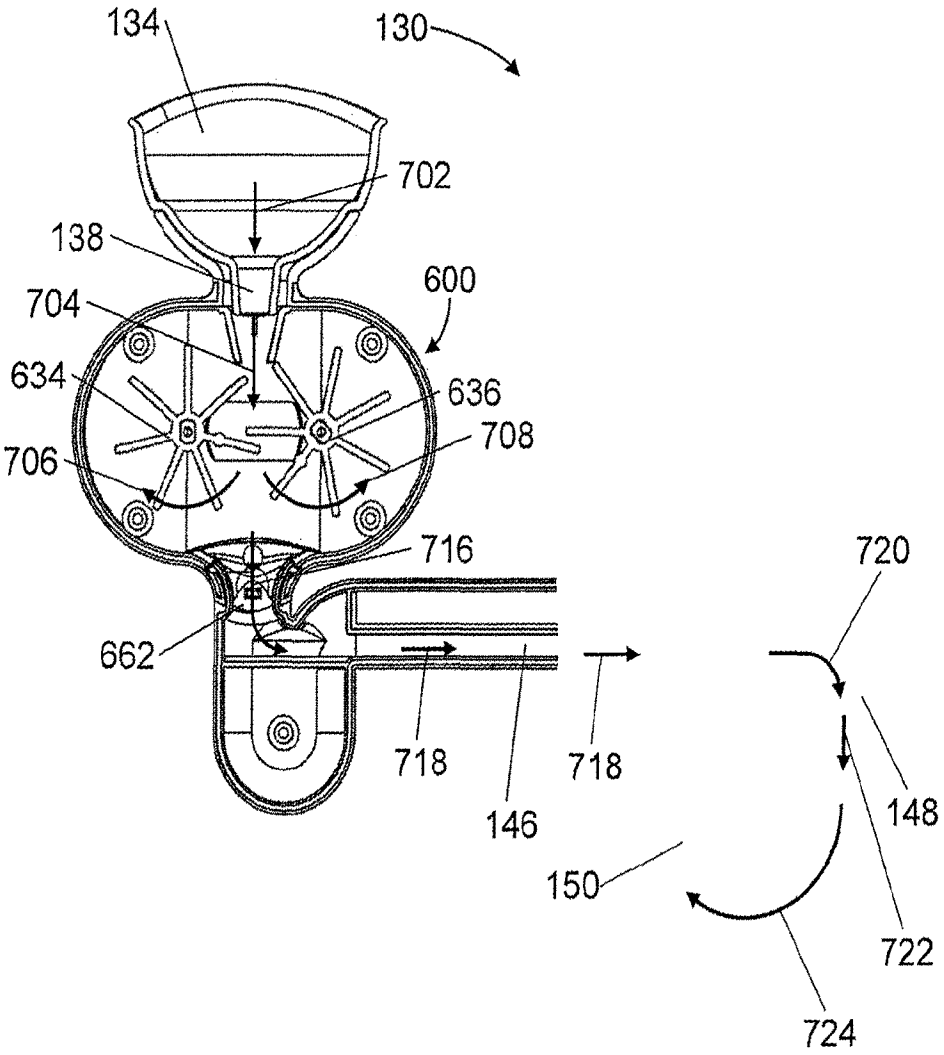

Reference is now made to FIGS. 11A and 11B, which are simplified pictorial and sectional illustrations of a first gravitational flow mode of operation of the multi-directional mutually intersecting gravitational flow portion of FIGS. 10A-10C of the combination pumped flow and gravitational flow bath toy system of FIGS. 1-10C, FIG. 11B being taken along lines B-B in FIG. 11A.

As seen in FIGS. 11A & 11B, water received at water receiving receptacle 134, as indicated by arrow 700, flow under gravity out of receptacle 134, as indicated by arrow 702, and through conduit 138 into turbine housing assembly 600, as indicated by arrow 704, and drives turbine wheels 634 and 636 in respective clockwise and counterclockwise directions, as indicated by respective arrows 706 and 708, thereby driving rotating elements 626 and 628 in corresponding clockwise and counterclockwise directions, indicated by respective arrows 710 and 712.

Some water exits turbine housing assembly 600 via outlet aperture 660, as indicated by arrow 714 and most of the water flows under the force of gravity through outlet aperture 662, as indicated by arrow 716 and through generally horizontal conduit 146, as indicated by arrows 718 and out outlet 148, as indicated by arrow 720, where it falls by gravity into driving engagement with pinwheel turbine 150, as indicated by arrows 722, thereby driving pinwheel turbine 150 in a clockwise direction, as indicated by arrows 724.

Figure 12A:
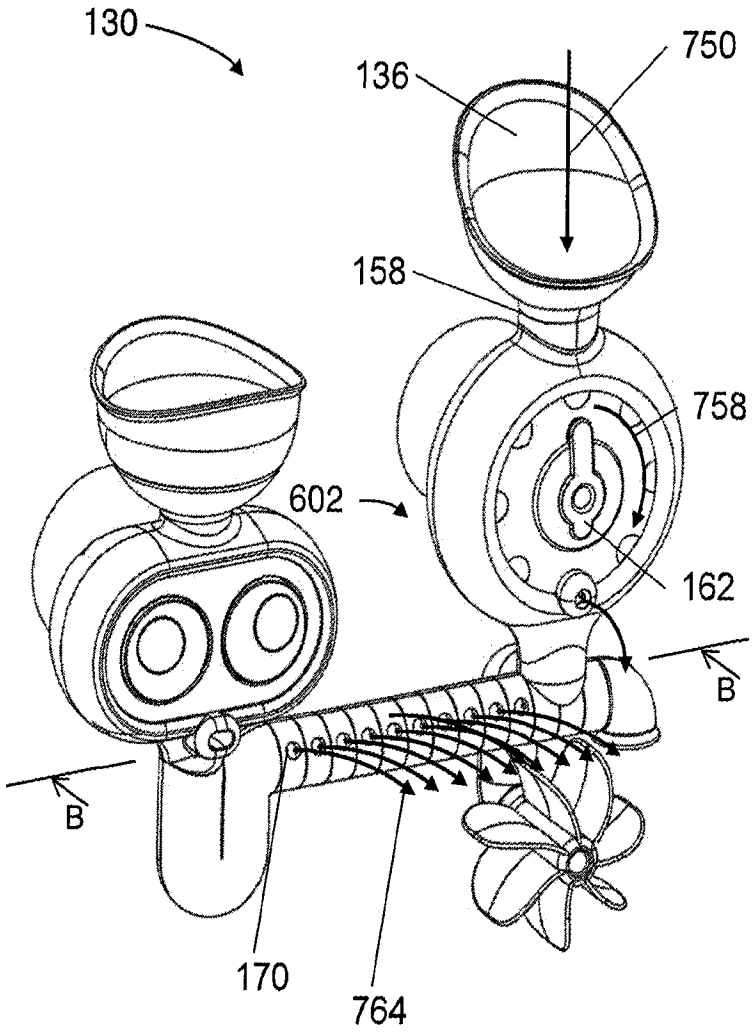
FIGS. 12A and 12B are simplified pictorial and sectional illustrations of a second gravitational flow mode of operation of the multi-directional mutually intersecting gravitational flow portion of FIGS. 10A-10C of the combination pumped flow and gravitational flow bath toy system of FIGS. 1-10C, FIG. 12B being taken along lines B-B in FIG. 12A.
Figure 12B:
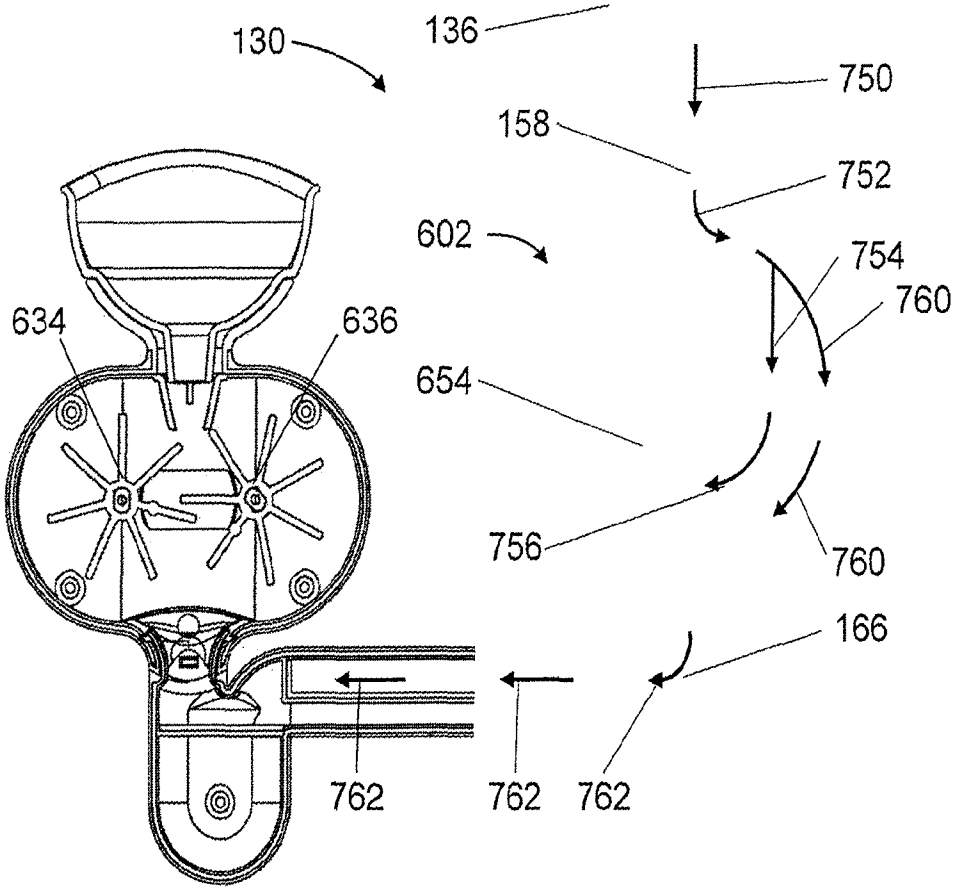

Reference is now made to FIGS. 12A and 12B, which are simplified pictorial and sectional illustrations of a second gravitational flow mode of operation of the multi-directional mutually intersecting gravitational flow portion of FIGS. 10A-10C of the combination pumped flow and gravitational flow bath toy system of FIGS. 1-10C, FIG. 12B being taken along lines B-B in FIG. 12A.

As seen in FIGS. 12A & 12B, water received at water receiving receptacle 136, as indicated by arrow 750, flow under gravity out of receptacle 136, as indicated by arrow 752, and through generally vertical gravitational water flow conduit 158. Part of the water flows under gravity into turbine housing assembly 602, as indicated by arrow 754, and drives turbine wheel 654 in a clockwise direction, as indicated by arrow 756, thereby driving rotating object 162 in a corresponding clockwise direction, indicated by arrow 758. Water continues to flow under gravity out of turbine housing assembly 602, as indicated by arrow 759, through forward-facing water outlet aperture 670.

Most of the water does not drive turbine 160 but passes through generally vertical conduit 158, as indicated by arrows 760 and into generally horizontal conduit 166, as indicated by arrows 762 and exits therefrom from spray outlets 170 in a generally horizontal array of sprays, indicated by arrows 764.

Figure 13A:
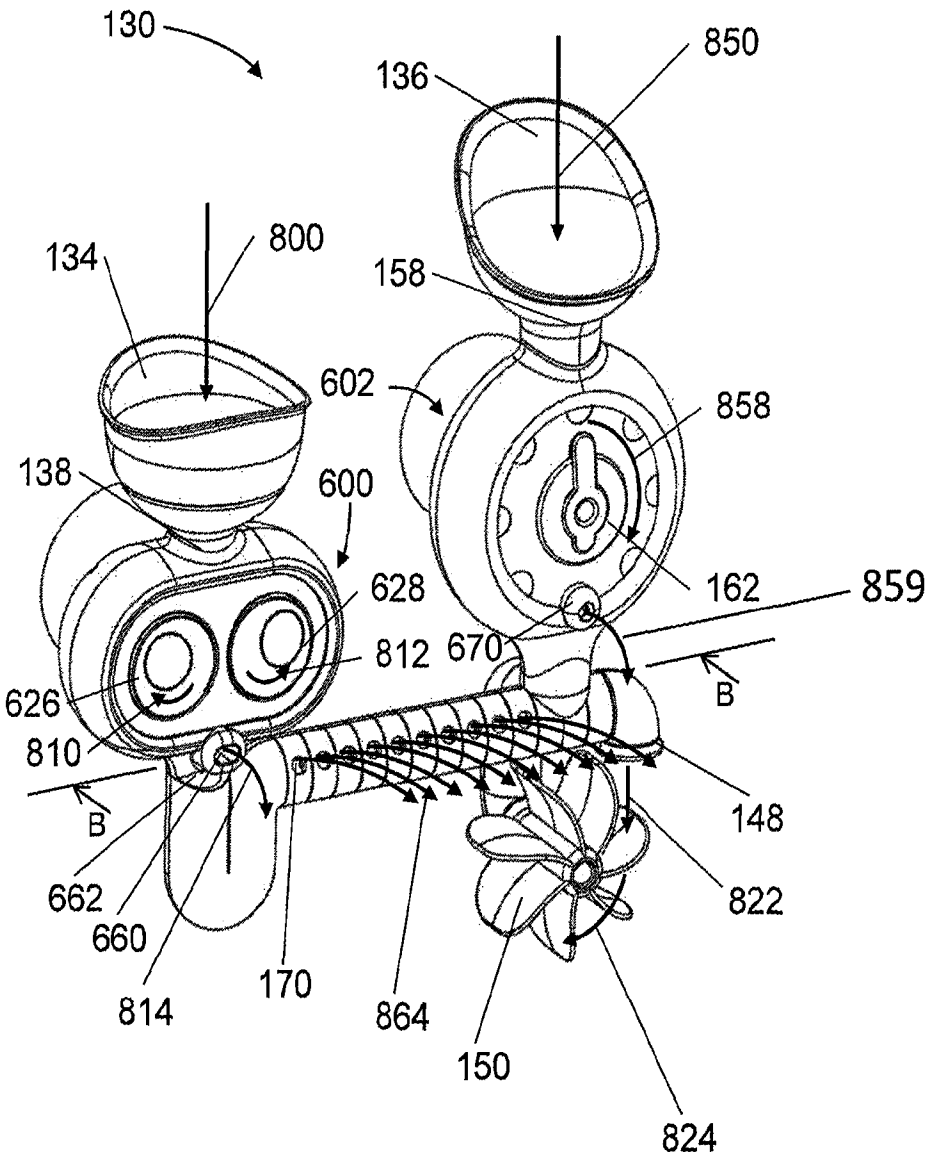
FIGS. 13A and 13B are simplified pictorial and sectional illustrations of a third gravitational flow mode of operation of the multi-directional mutually intersecting gravitational flow portion of FIGS. 10A-10C of the combination pumped flow and gravitational flow bath toy system of FIGS. 1-10C, FIG. 13B being taken along lines B-B in FIG. 13A.
Figure 13B:
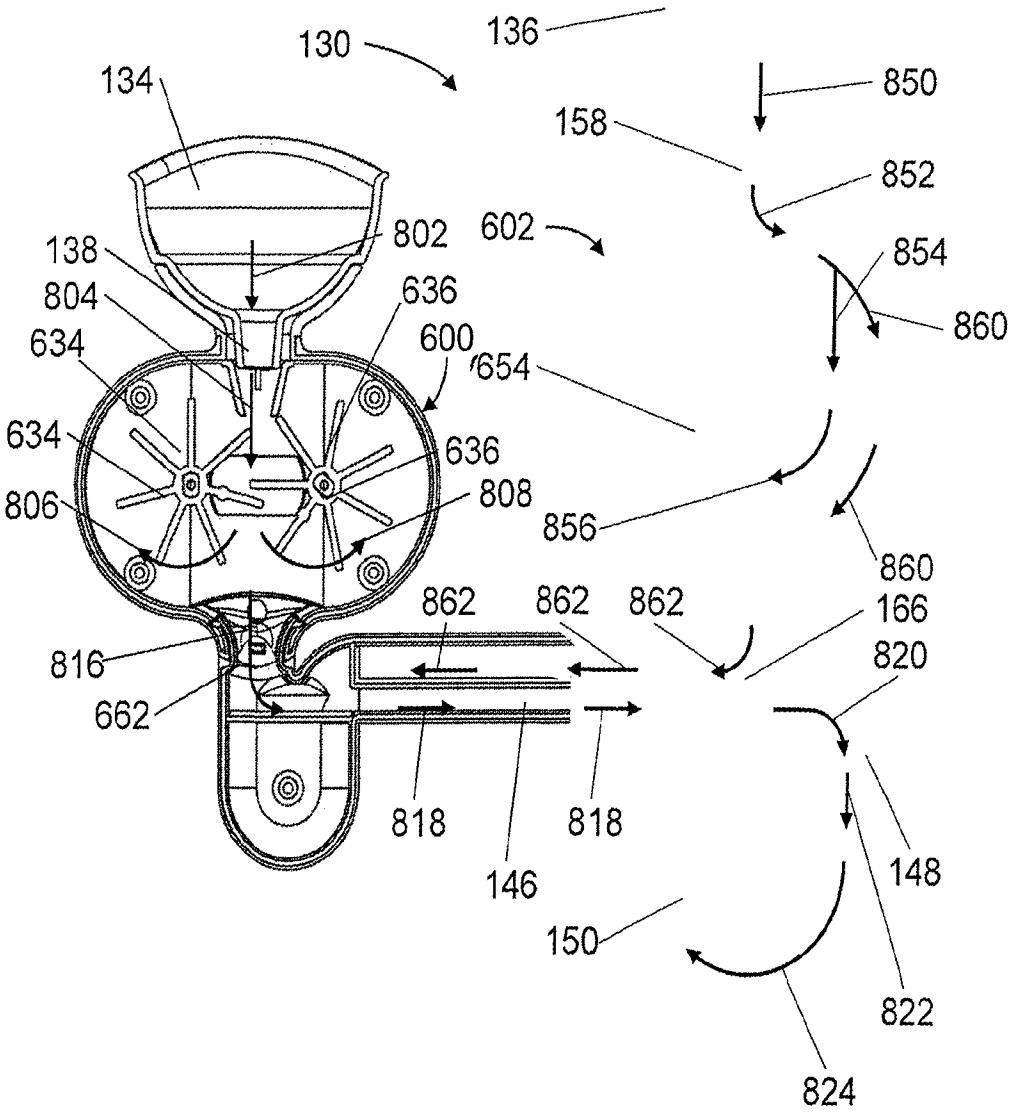

Reference is now made to FIGS. 13A and 13B, which are simplified pictorial and sectional illustrations of a third gravitational flow mode of operation of the multi-directional mutually intersecting gravitational flow portion of FIGS. 10A-10C of the combination pumped flow and gravitational flow bath toy system of FIGS. 1-10C, FIG. 13B being taken along lines B-B in FIG. 13A.

As seen in FIGS. 13A & 13B, water received at water receiving receptacle 134, as indicated by arrow 800, flow under gravity out of receptacle 134, as indicated by arrow 802, and through conduit 138 into turbine housing assembly 600, as indicated by arrow 804, and drives turbine wheels 634 and 636 in respective clockwise and counterclockwise directions, as indicated by respective arrows 806 and 808, thereby driving corresponding rotatable elements 626 and 628 in corresponding clockwise and counterclockwise directions, indicated by respective arrows 810 and 812.

Some water exits turbine housing assembly 600 via outlet aperture 660, as indicated by arrow 814, and most of the water flows under the force of gravity through outlet aperture 662, as indicated by arrow 816, and through horizontal conduit 146, as indicated by arrows 818, and out outlet 148, as indicated by arrow 820, where it falls by gravity into driving engagement with pinwheel turbine 150, as indicated by arrow 822, thereby driving pinwheel turbine 150 in a clockwise direction, as indicated by arrow 824.

As further seen in FIGS. 13A & 13B, water received simultaneously at water receiving receptacle 136, as indicated by arrow 850, flows under gravity out of receptacle 136, as indicated by arrow 852, and through conduit 158. Part of the water flows under gravity into turbine housing assembly 602, as indicated by arrow 854, and drives turbine wheel 654 in a clockwise direction, as indicated by arrow 856, thereby driving rotating object 162 in a corresponding clockwise direction, indicated by arrow 858. Water continues to flow under gravity out of turbine housing assembly 602, as indicated by arrow 859, through forward-facing water outlet aperture 670.

Most of the water does not drive turbine 160 but passes through generally vertical conduit 158, as indicated by arrows 860, and into generally horizontal conduit 166, as indicated by arrows 862, and exits therefrom from spray outlets 170 in a generally horizontal array of sprays, indicated by arrows 864.

Figure 14A:
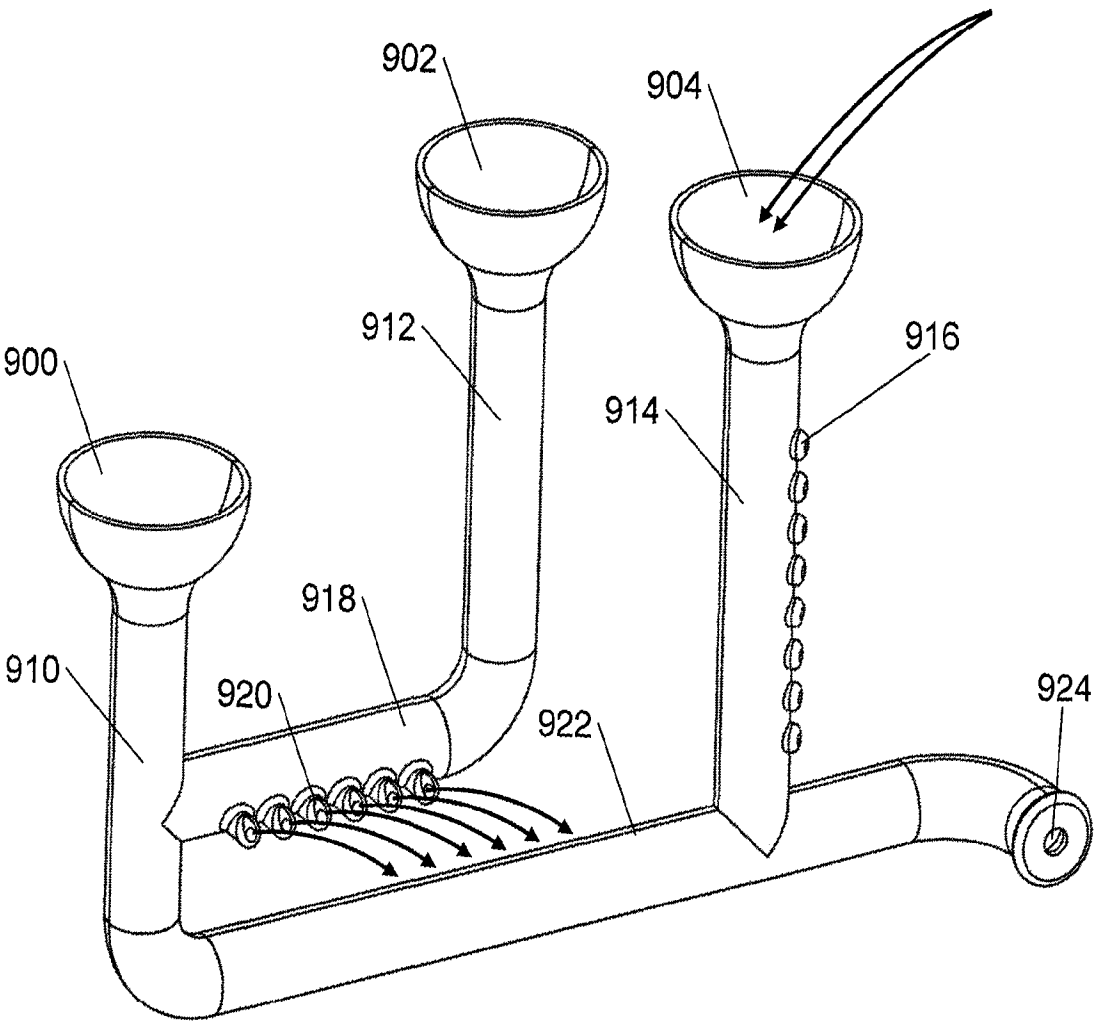
FIGS. 14A and 14B are simplified respective forward-facing and rear-facing illustrations of an alternative embodiment of a mutually opposite generally horizontal gravity driven flow water toy constructed and operative in accordance with a preferred embodiment of the present invention and FIGS. 14C and 14D are respective forward and rear-facing exploded views thereof, showing the various flow channels formed therein.
Figure 14B:
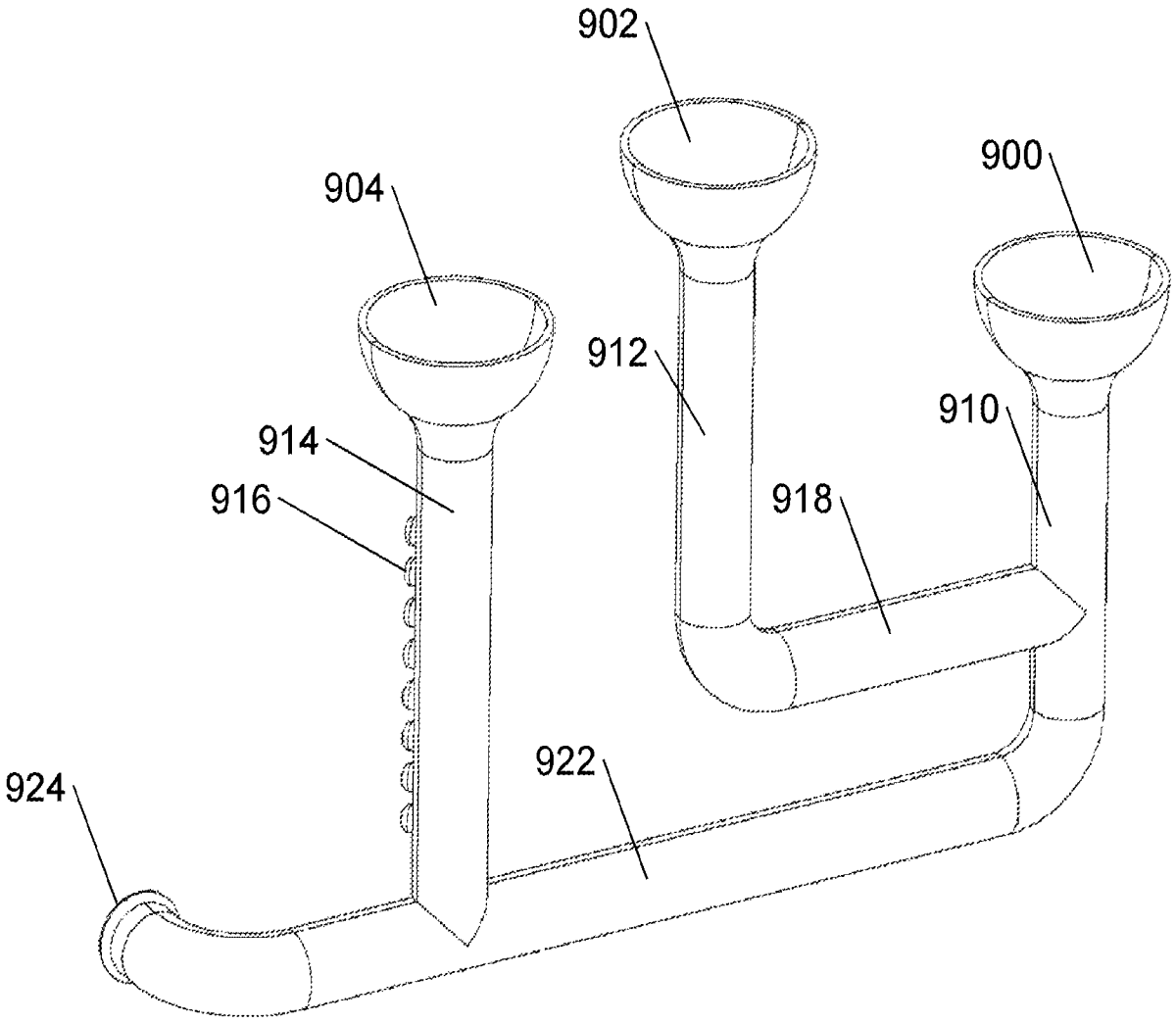
Figure 14C:
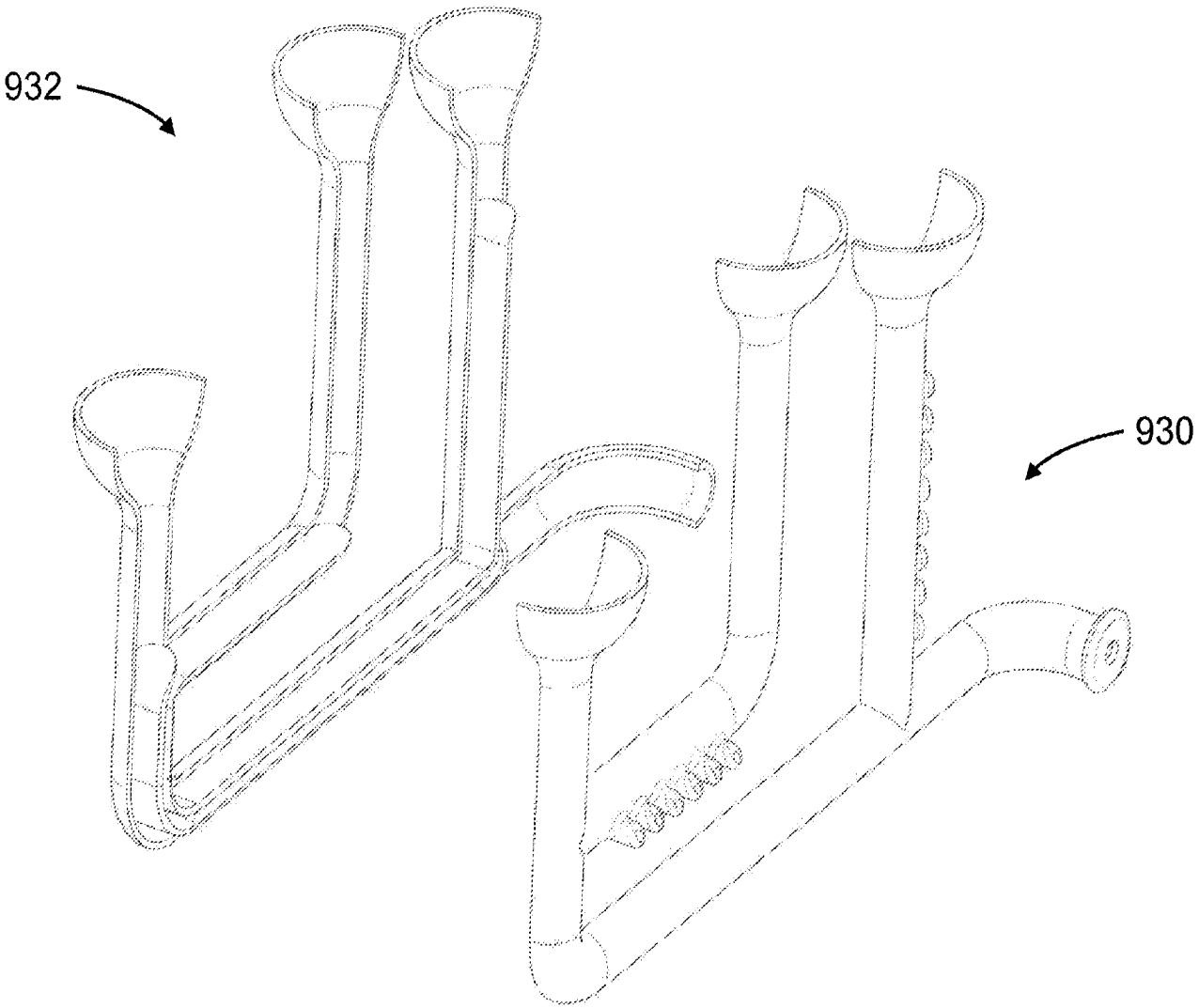
Figure 14D:
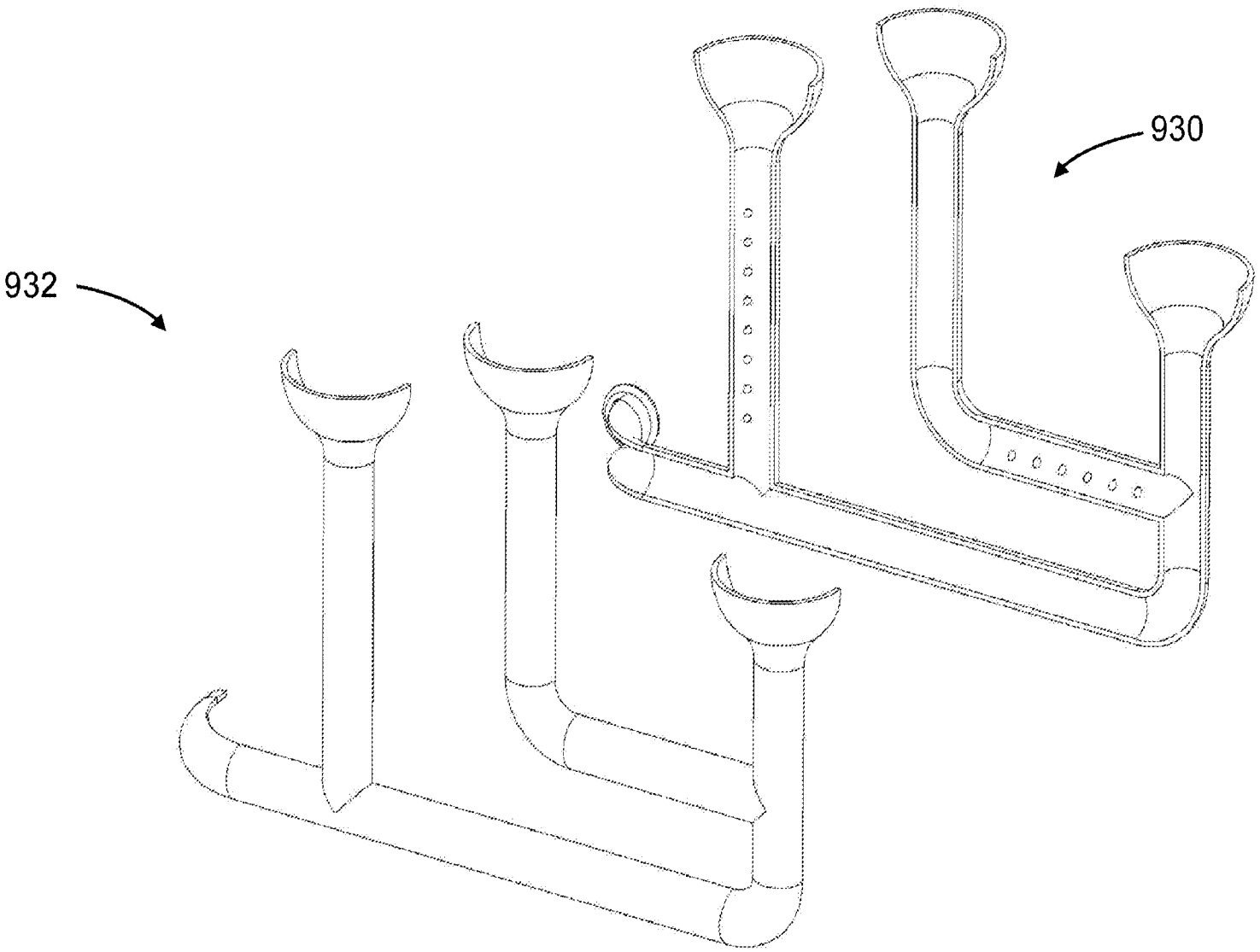
Figure 15B:
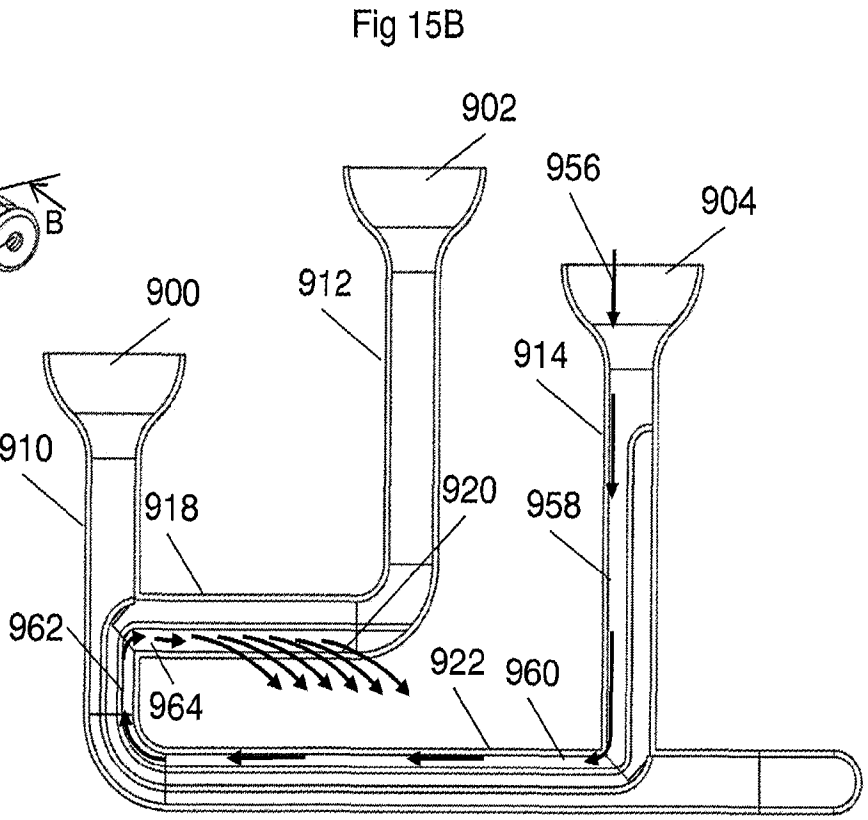
FIGS. 15A and 15B are respective pictorial and sectional illustrations of a first flow pattern in the mutually opposite generally horizontal gravity driven flow water toy of FIGS. 14A-14D.
Figure 15A:
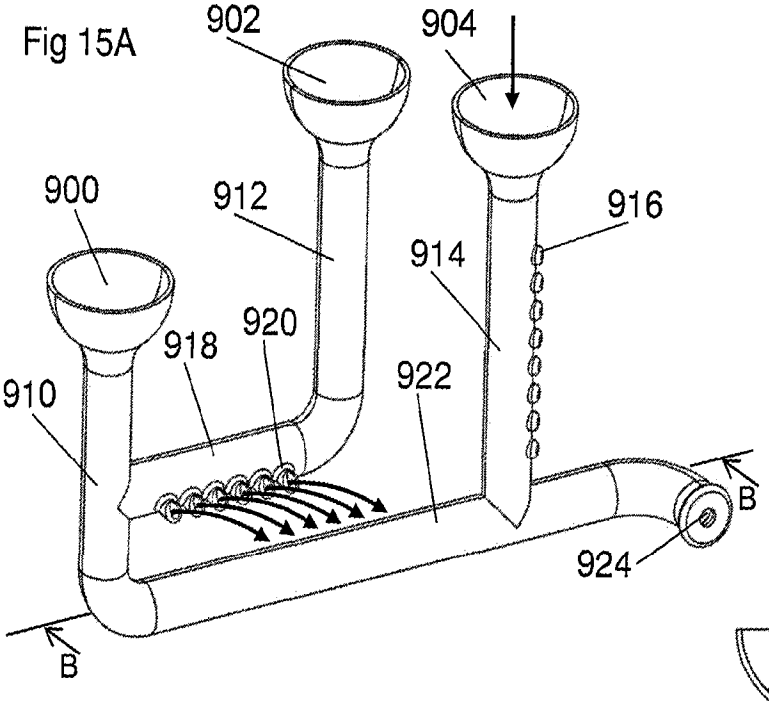
Figures 16A, 16B:
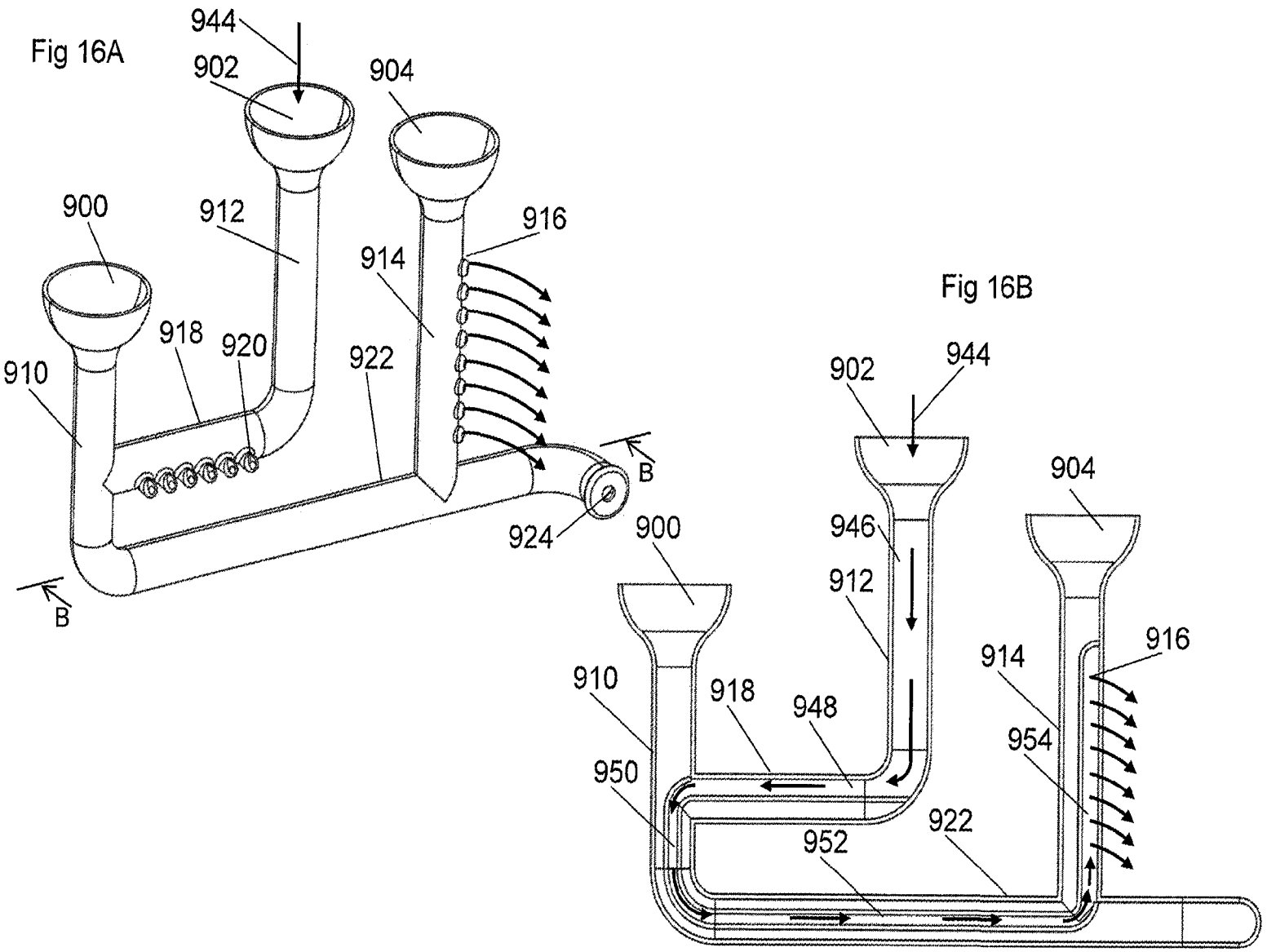
FIGS. 16A and 16B are respective pictorial and sectional illustrations of a second flow pattern in the mutually opposite generally horizontal gravity driven flow water toy of FIGS. 14A-14D.
Figures 17A, 17B:
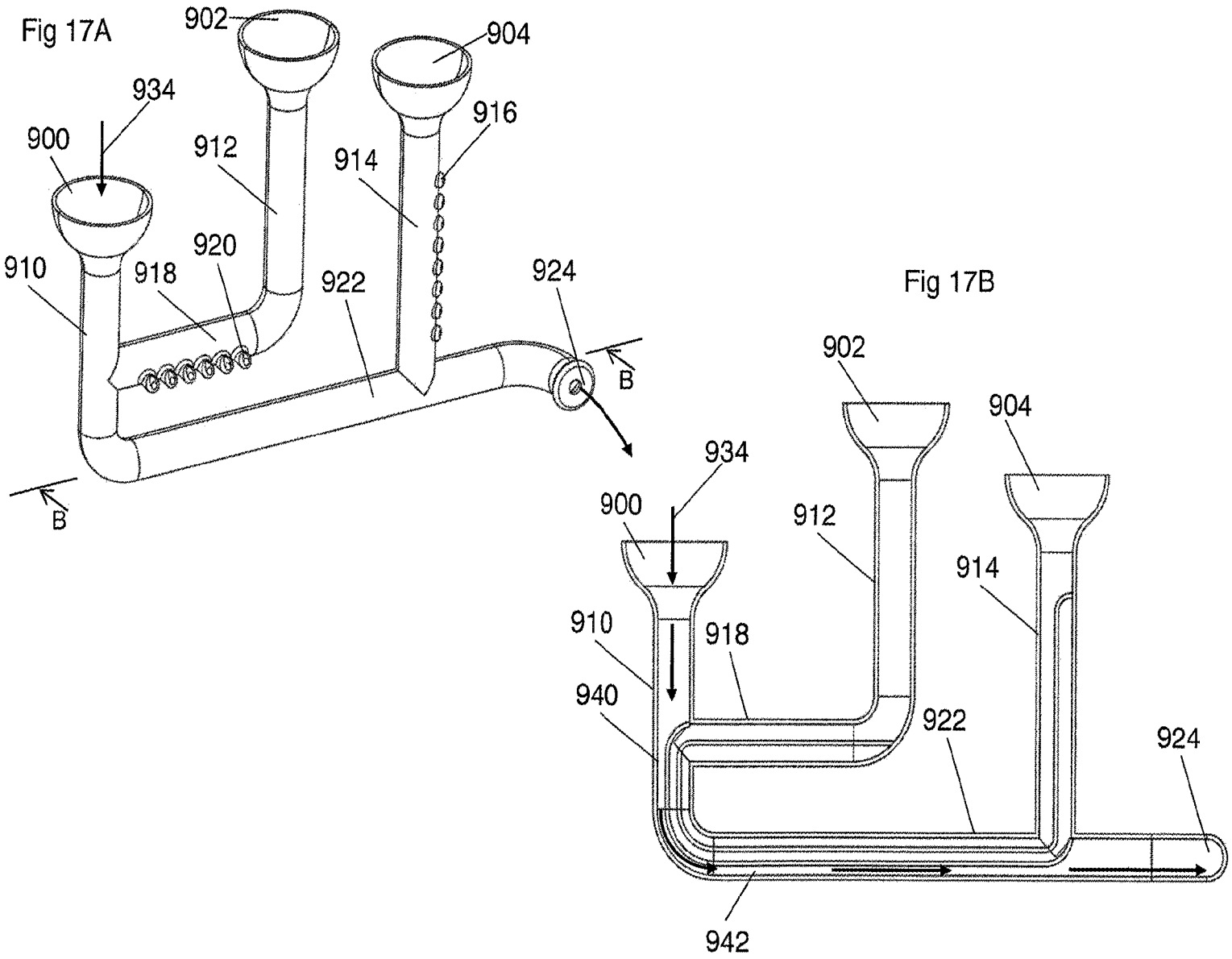
FIGS. 17A and 17B are respective pictorial and sectional illustrations of a third flow pattern in the mutually opposite generally horizontal gravity driven flow water toy of FIGS. 14A-14D.
Figures 18A, 18B:
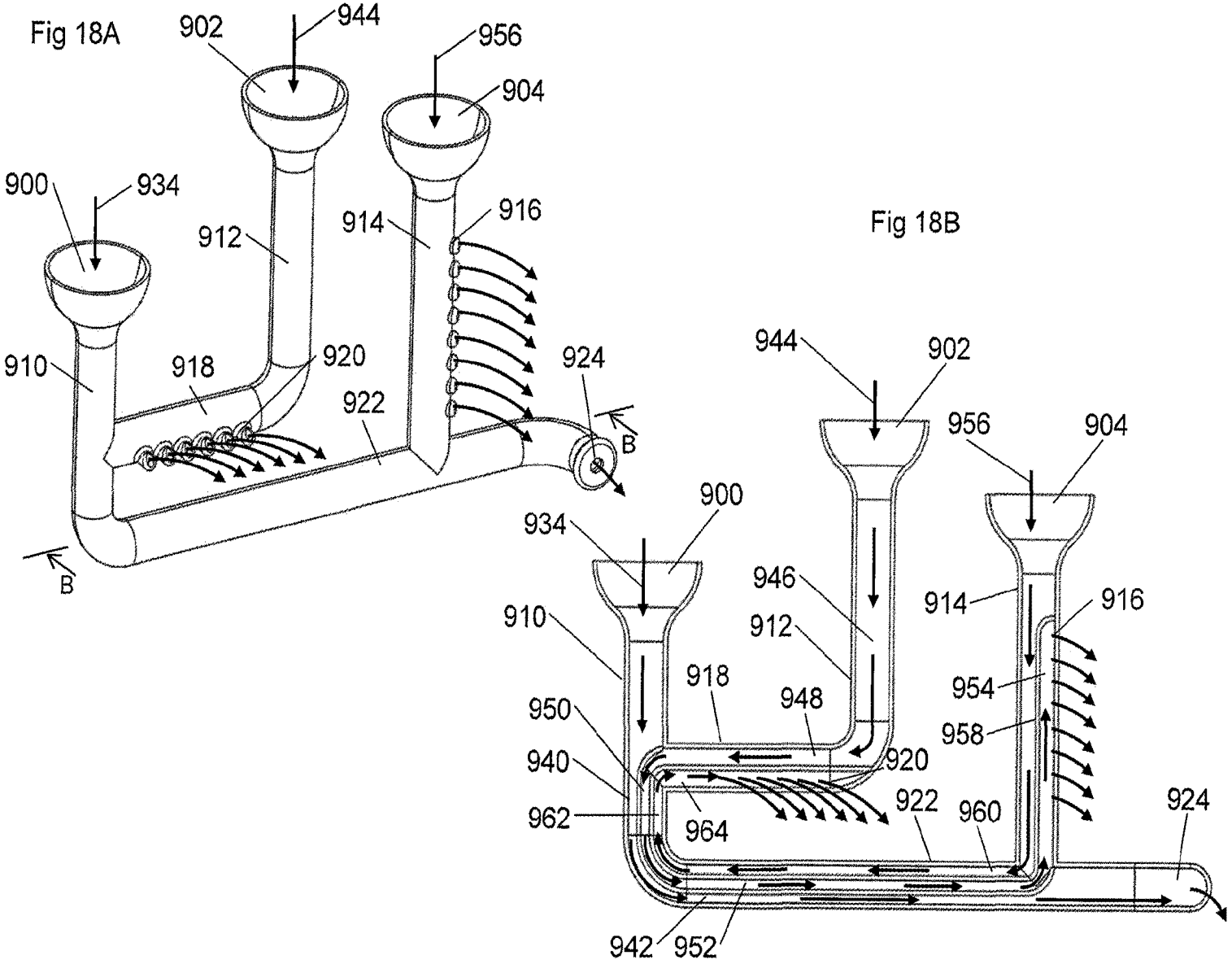
FIGS. 18A and 18B are respective pictorial and sectional illustrations of a fourth flow pattern in the mutually opposite generally horizontal gravity driven flow water toy of FIGS. 14A-14D.

Reference is now made to FIGS. 14A and 14B, which are simplified respective forward-facing and rear-facing illustrations of an alternative embodiment of a mutually opposite generally horizontal gravity driven flow water toy constructed and operative in accordance with a preferred embodiment of the present invention, and FIGS. 14C and 14D, which are respective forward and rear-facing exploded views thereof, showing the various flow channels formed therein; to FIGS. 15A and 15B, which are respective pictorial and sectional illustrations of a first flow pattern in the mutually opposite generally horizontal gravity driven flow water toy of FIGS. 14A-14D; to FIGS. 16A and 16B, which are respective pictorial and sectional illustrations of a second flow pattern in the mutually opposite generally horizontal gravity driven flow water toy of FIGS. 14A-14D; to FIGS. 17A and 17B, which are respective pictorial and sectional illustrations of a third flow pattern in the mutually opposite generally horizontal gravity driven flow water toy of FIGS. 14A-14D; and to FIGS. 18A and 18B, which are respective pictorial and sectional illustrations of a fourth flow pattern in the mutually opposite generally horizontal gravity driven flow water toy of FIGS. 14A-14D.

As seen in FIGS. 14A-14B, three water receiving receptacles 900, 902 and 904 are provided and each communicates with a generally vertical water conduit, respectively designated by reference numerals 910, 912 and 914. Vertical water conduit 914 has a generally vertical linear array of water outlet nozzles 916. Generally vertical water conduits 910 and 912 appear to be interconnected by a generally horizontal water conduit 918 having a linear array of water outlet nozzles 920. Vertical water conduits 910 and 914 appear to be interconnected by a generally horizontal water conduit 922 having an outlet 924.

As seen clearly in FIGS. 14C and 14D, the toy of FIGS. 14A-18B is preferably formed of forward and rearward parts 930 and 932, which may be ultrasonically welded together or sealingly joined together in any other suitable manner.

As seen clearly in FIG. 18B, a gravity flow of water, indicated by arrows 934, from water receiving receptacle 900 extends along a generally vertical pathway portion 940 defined in generally vertical conduit 910 and then along a generally horizontal pathway portion 942, defined in generally horizontal conduit 922, to outlet 924.

As also seen clearly in FIG. 18B, a gravity flow of water, indicated by arrows 944, from water receiving receptacle 902 extends along a generally vertical pathway portion 946 defined in generally vertical conduit 912 and then along a generally horizontal pathway portion 948, defined in generally horizontal conduit 918 to a generally vertical pathway portion 950 defined in generally vertical conduit 910 to a generally horizontal pathway portion 952 defined in generally horizontal conduit 922 upwardly along a generally vertical pathway portion 954 defined in generally vertical conduit 914 and out through nozzles 916.

As further seen clearly in FIG. 18B, a gravity flow of water, indicated by arrows 956, from water receiving receptacle 904 extends along a generally vertical pathway portion 958 defined in generally vertical conduit 914 and then along a generally horizontal pathway portion 960, defined in generally horizontal conduit 922 in a direction opposite to the direction, indicated by arrows 944, of the flow in horizontal pathway portion 922, to a generally vertical pathway portion 962 defined in generally vertical conduit 910 to a generally horizontal pathway portion 964 defined in generally horizontal conduit 922 and in a direction opposite to the direction, indicated by arrows 944, of the flow in generally horizontal pathway portion 948, and out through nozzles 922.

Reference is now made to FIG. 19, which is a simplified pictorial illustration of a combination pumped flow and gravitational flow bath toy system 1100 constructed and operative in accordance with another preferred embodiment of the present invention.

As seen in FIG. 19, the combination pumped flow and gravitational flow bath toy system 1100 includes a pump portion 1110, typically in the fanciful form of a flower pot, which is adapted to be immersed in water, such as in a bath, and may be removably secured to a bottom of a bathtub (not shown) as by a vacuum cup (not shown). Pump portion preferably includes an ON/OFF switch 1114 and is coupled via a flexible conduit 1116, preferable enclosing a pressurized water conduit and an electrical switch actuation electrical conduit (not shown), with a nozzle portion 1120, preferably in the fanciful shape of a flower, wherein the flexible conduit 1116 may be envisioned as a flexible flow stem extending upwardly from the flower pot.

Nozzle portion 1120 preferably includes a nozzle housing 1122, which is securely coupled to flexible conduit 1116 and which defines a pumped pressurized spray output nozzle 1124. It is a particular feature of the illustrated embodiment of the present invention that there is provided an electrical spray control switch assembly, which can be operated by a very young child, even a child under the age of one year.

The spray control switch assembly is preferably realized in the illustrated embodiment by a pair of push buttons 1126, which are mounted in nozzle housing 1122, and which may be simultaneously grabbed by the hand of a young child. The spray control switch assembly preferably may be actuated by a young child who squeezes the push buttons 1126 towards each other. According to a preferred embodiment of the present invention, squeezing of either or both of the push buttons 1126 by even a very young child is sufficient to actuate a spray output from the nozzle 1124.

Preferably the nozzle portion 1120 and the nozzle housing 1122 are configured to have a fanciful appearance, such as that of a flower, in the illustrated embodiment.

The combination pumped flow and gravitational flow bath toy system 1100 preferably also includes a water spray driven, side mounted toy assembly 1130 including a plurality of mutually interdigitated water spray drivable wheels, here preferably three wheels, 1132, 1134 and 1136, which can be removed and replaced by a young child onto a corresponding plurality of hubs, respectively designated by reference numerals 1142, 1144 and 1146.

It is a particular feature of the present invention that in the illustrated embodiment, each of the plurality of hubs 1142, 1144 and 1146 preferably has a different geometrical outer circumferential configuration, such as a square, a circle and a triangle. Accordingly, preferably each of the plurality of mutually interdigitated water spray drivable wheels 1132, 1134 and 1136 correspondingly has a different geometrical inner circumferential configuration corresponding to one of the geometrical outer circumferential configurations of the plurality of hubs, thus enabling one of the wheels 1132, 1134 and 1136 to be mounted by a child only onto a hub 1142, 1144 or 1146 having a corresponding geometrical configuration.

As seen in FIG. 19, typically a spray of water from nozzle portion 1120 causes wheel 1132 to rotate about its axis in a counterclockwise direction, wheel 1134 to rotate about its axis in a clockwise direction and wheel 1136 to rotate in a counterclockwise direction.

Figure 20:
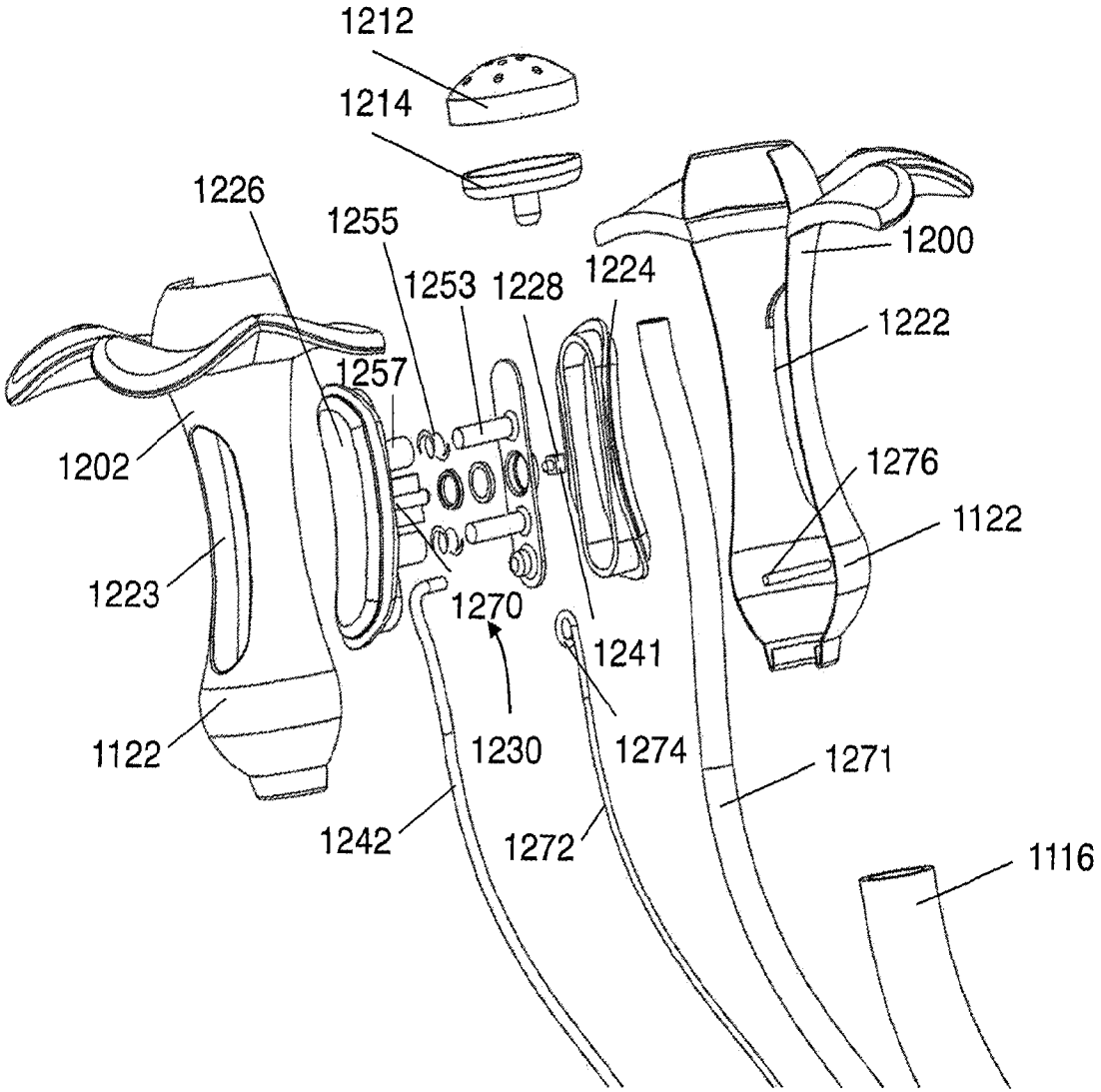
FIG. 20 is a simplified exploded view illustration of a nozzle and conduit portion of the combination pumped flow and gravitational flow bath toy system of FIG. 19.
Figure 21B:
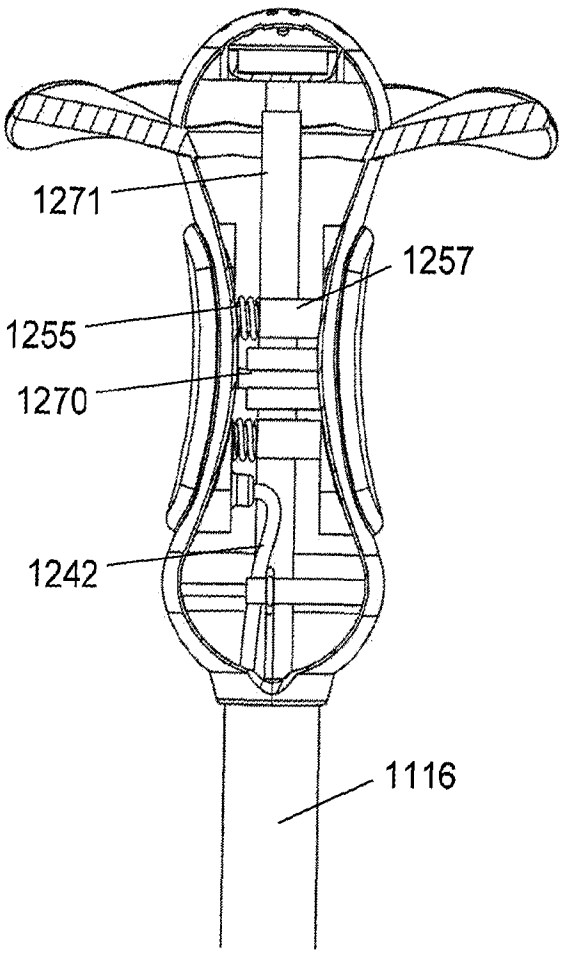
FIGS. 21A and 21B are simplified pictorial and sectional illustrations of a first nozzle housing element forming part of the nozzle and conduit portion of FIG. 20, taken along a first direction.
Figure 21A:
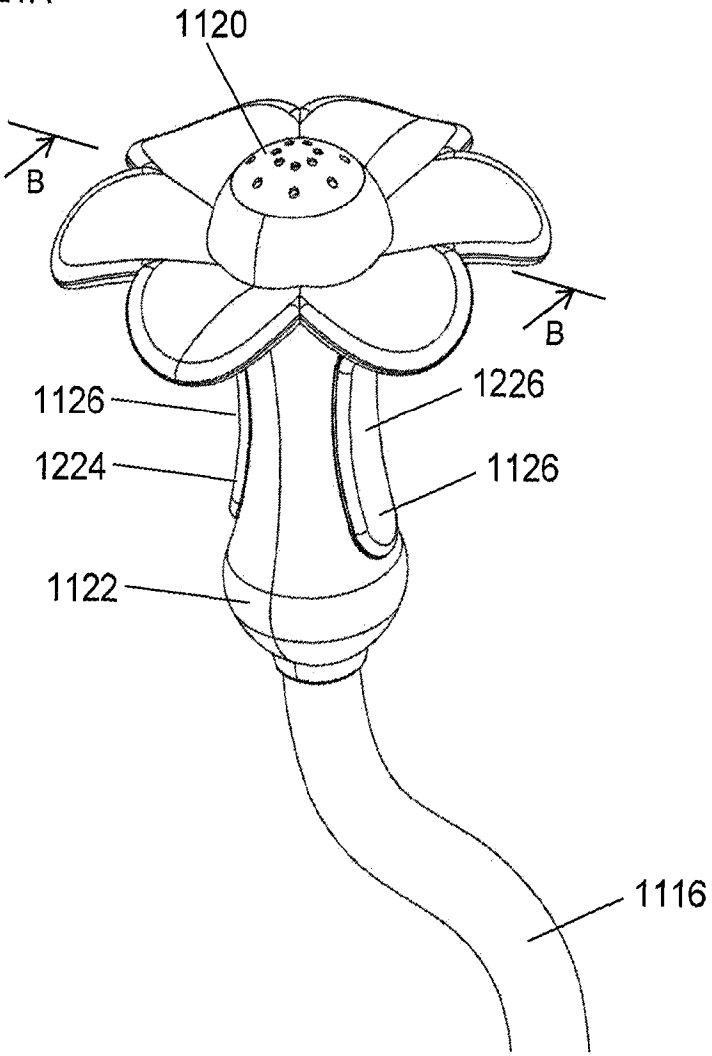
Figure 22B:
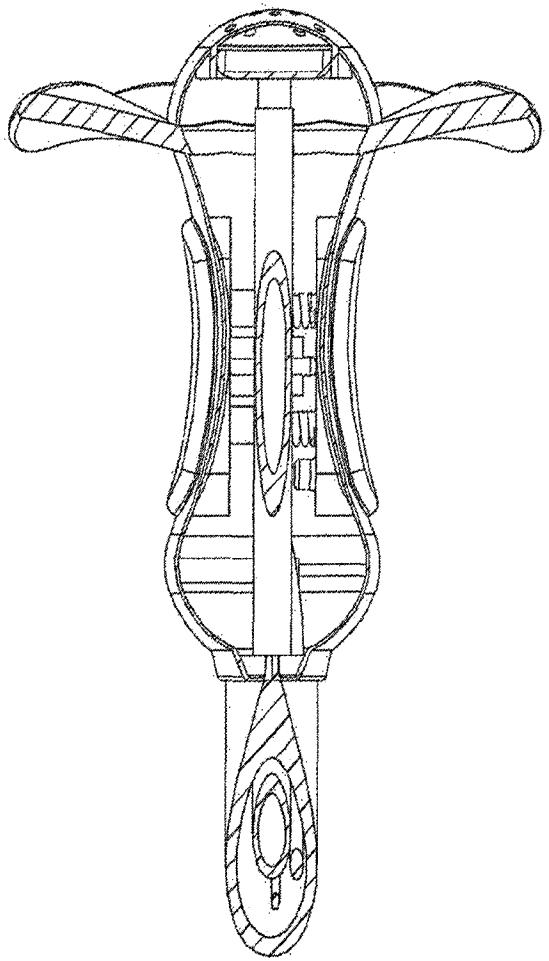
FIGS. 22A and 22B are simplified pictorial and sectional illustrations of a first nozzle housing element forming part of the nozzle and conduit portion of FIG. 20, taken along a second direction.
Figure 22A:
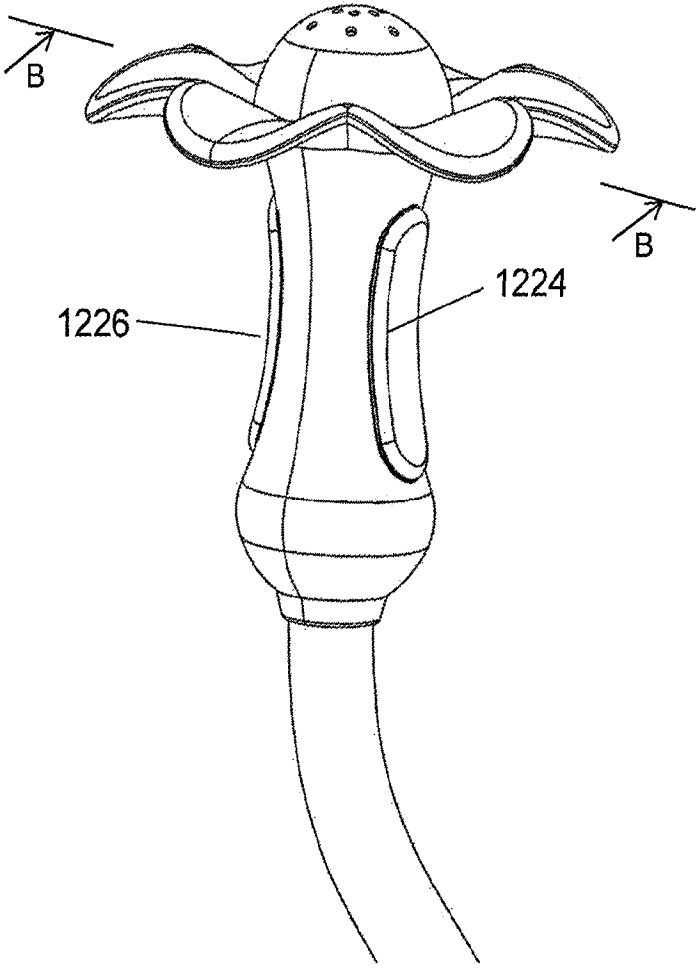

Reference is now made to FIG. 20, which is a simplified exploded view illustration of a nozzle and conduit portion of the combination pumped flow and gravitational flow bath toy system of FIG. 19, to FIGS. 21A and 21B, which are simplified pictorial and sectional illustrations of a nozzle housing element forming part of the nozzle conduit portion of FIG. 20, to FIGS. 22A and 22B, which are simplified pictorial and sectional illustrations of a nozzle housing element forming part of the nozzle conduit portion of FIG. 20 and to FIGS. 23A-23E, which illustrate a spray control switch assembly forming part of the nozzle conduit portion of FIG. 20.

As seen in FIGS. 20-23E, the nozzle and conduit portion includes nozzle portion 1120, including nozzle housing 1122, which is securely coupled to flexible conduit 1116. Nozzle housing 1122 includes a first nozzle housing portion 1200 and a second nozzle housing portion 1202, which are preferably held together by screws (not shown), which extend through apertures (not shown), in second housing portion 1202 and engage respective corresponding interiorly threaded bosses (not shown) in first housing portion 1200.

Disposed within nozzle housing 1122 and extending through an aperture formed by first nozzle housing portion 1200 and second nozzle housing portion 1202 in a top portion thereof is a nozzle outlet element 1212, which preferably includes a pressurized water inlet 1214 and a pair of mounting apertures (not shown), which enable mounting of the nozzle outlet element 1212 onto the first nozzle housing 1122 by engagement with bosses (not shown) in first nozzle housing portion 1200 and second nozzle housing portion 1202

First nozzle housing portion 1200 and second nozzle housing portion 1202 are each formed with a central slot, designated respectively by reference numerals 1222 and 1223, which accommodate nozzle flow control push buttons 1224 and 1226, which together with an electrical nozzle flow control switch 1228 and other elements described hereinbelow, define a spray control switch assembly 1230, which will now be described in detail with particularly reference to FIGS. 23A-23E.

Push button 1224 includes an outer-facing child hand engageable outer surface 1238 and an inner, generally concave surface which partially defines an enclosure and includes pair of inner-facing protrusions (not shown), which define a seat for a microswitch 1241, which is coupled to an electrical cable 1242.

A microswitch retaining and sealing element 1244 retains and seals microswitch 1241 within the enclosure partially defined by the inner, generally concave surface of push button 1224 and is sealingly seated within an inner circumferential recess (not shown) therein. Microswitch 1241 includes a microswitch actuation button 1247 and is preferably a part TS-2037, commercially available Hongkong Leader Industrial Company of 126 Yee Kuk Street, Sham Shui Po, Kowloon.

Figure 23A:
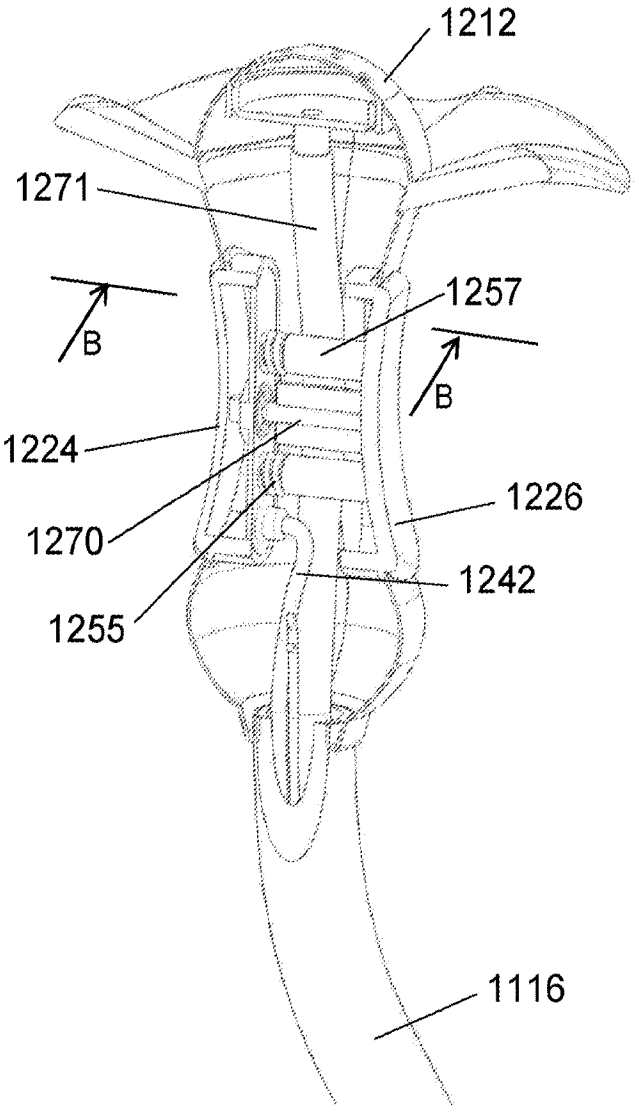
FIG. 23A is a simplified illustration of the interior of the nozzle and conduit portion of FIGS. 19-22B, FIGS. 23B and 23C are simplified sectional illustrations of a spray control switch assembly forming part of the nozzle and conduit portion of FIGS. 19 and 23A, taken along lines B-B in FIG. 23A, in first and second operative orientations.
Figure 23B:
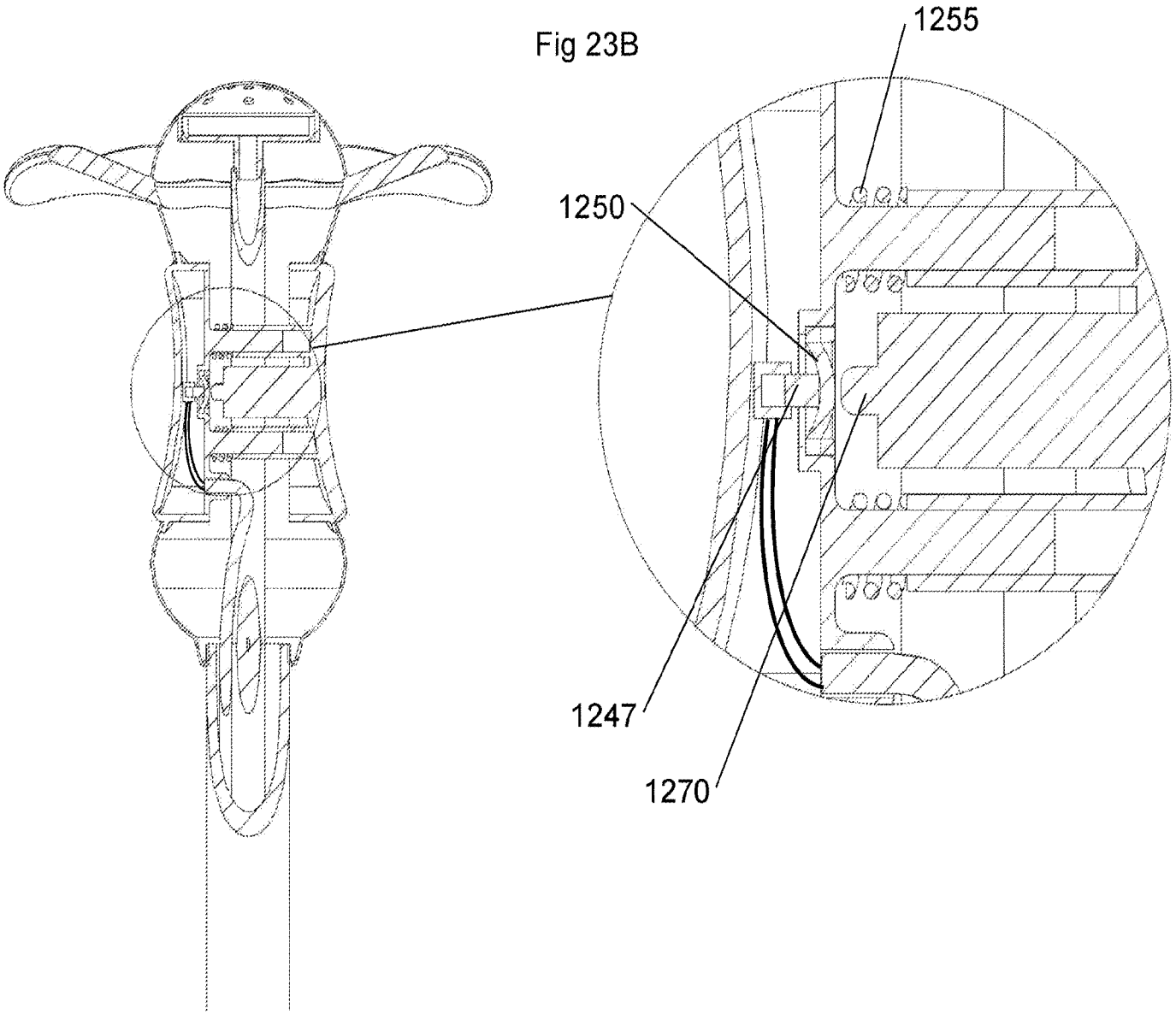
FIGS. 23D and 23E are simplified assembled and exploded illustrations of the spray control switch assembly of FIGS. 23B and 23C.
Figure 23C:
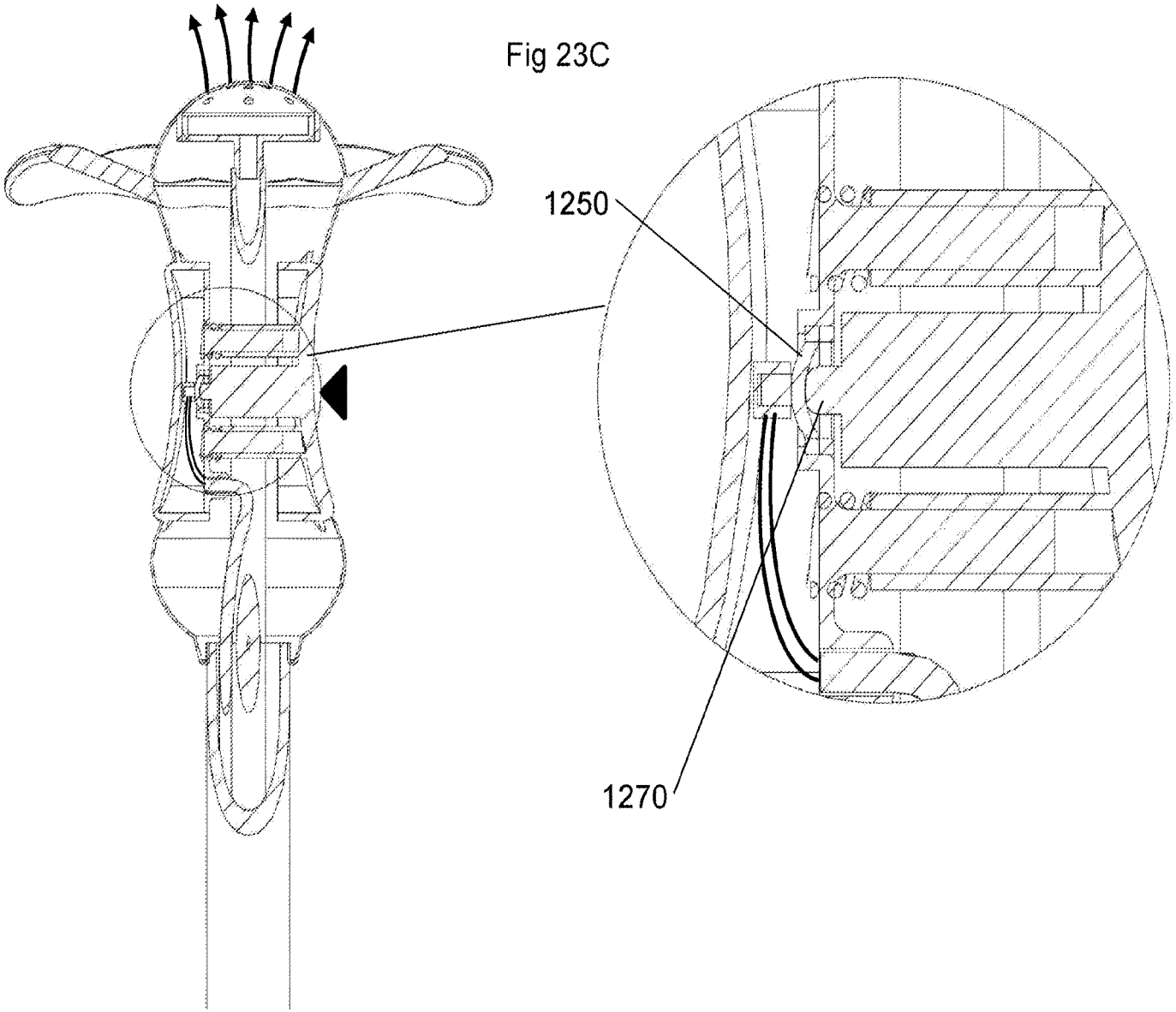
Figure 23E:
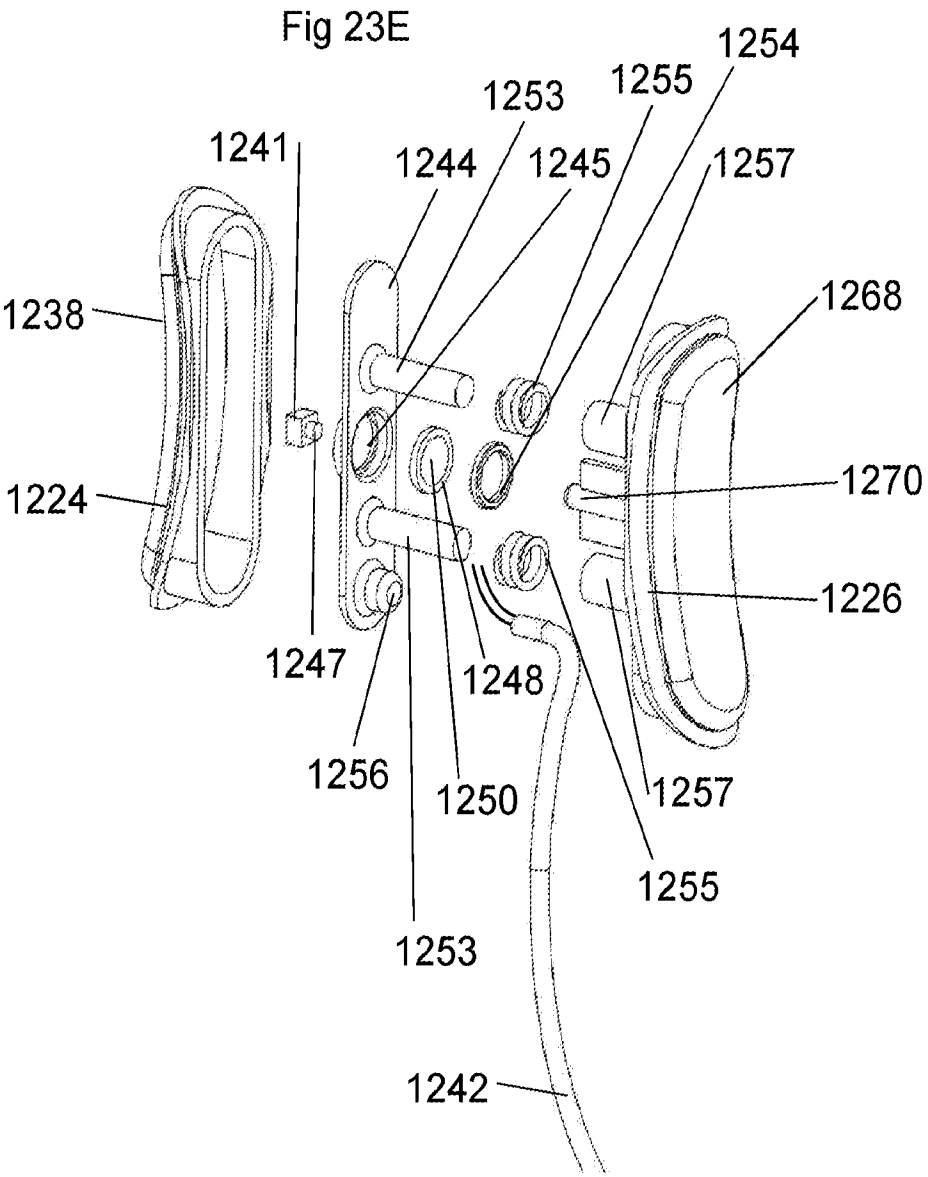
Figure 23D:
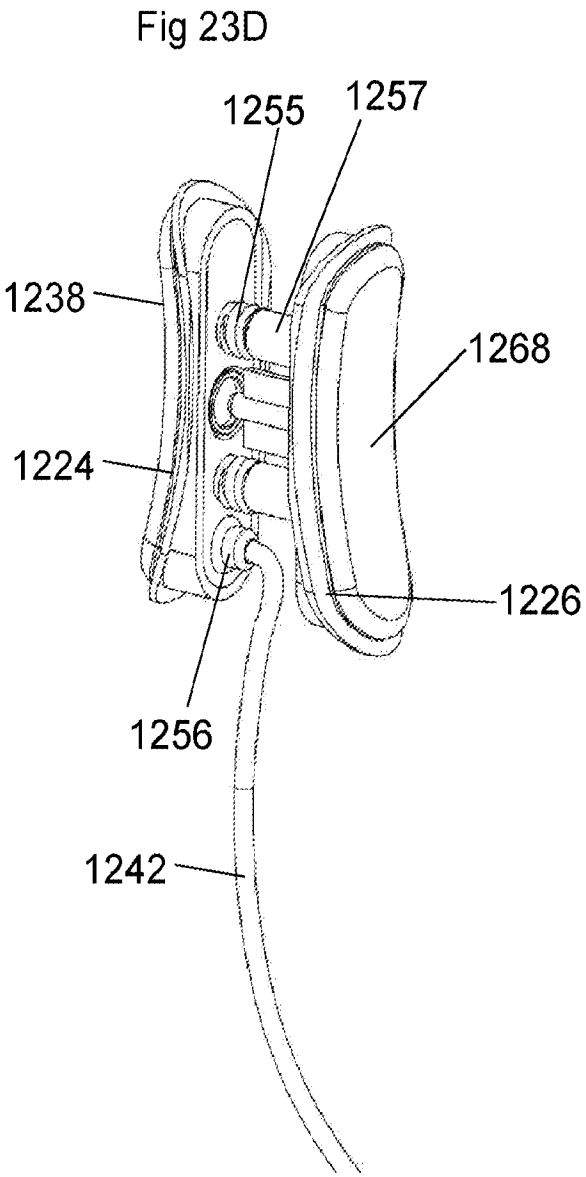

As seen particularly in FIG. 23E, microswitch retaining and sealing element 1244 is a generally planar element having a central recess 1245 for receiving a sealed flexible microswitch actuation assembly 1248, including a flexible water-impermeable web portion 1250, which is mounted in a ring mount 1252. Sealed flexible microswitch actuation assembly 1248 is preferably sealingly retained in central recess 1245 by a retaining ring 1254. A pair of inwardly extending pegs 1253 is formed on microswitch retaining and sealing element 1244 which extend through springs 1255 and are engaged by bosses 1257 formed on an inwardly facing portion of push button 1226.

Microswitch retaining and sealing element 1244 preferably includes an electrical cable conduit portion 1256, which sealingly accommodates electrical cable 1242.

Push button 1226 includes an outer-facing child hand engageable outer surface 1268 and an inner, facing protrusion 1270 which, depending on the relative orientations of push button elements 1222 and 1223, may pushingly engage web portion 1250 mounted onto microswitch retaining and sealing element 1244 for actuating microswitch actuation button 1247, as will be described hereinbelow in detail.

FIG. 23B illustrates a relative operative orientation of push buttons 1224 and 1226 wherein neither of pushbuttons 1224 and 1226 is pressed. It is seen that protrusion 1270 does not pushingly engage web portion 1250 and does not actuate microswitch actuation button 1247 and thus, preferably the switch is closed and no spray is provided.

FIG. 23C illustrates a relative operative orientation of push buttons 1224 and 1226 wherein either or both of push buttons 1224 and 1226 is pressed. It is seen that protrusion 1270 pushingly engages web portion 1250 and actuates microswitch actuation button 1247 and thus, preferably the switch is open and a spray is produced. It is appreciated, that alternatively a microswitch may be employed which provides a variable volume spray, which may vary from no spray to a spray of a maximum volume.

Water inlet 1214 of nozzle outlet element 1212 is preferably fixedly coupled to a water supply conduit 1271, which, together with electrical cable 1242, extends through flexible conduit 1116. It is a particular feature of an embodiment of the present invention that there is provided a security cable 1272, preferably formed of NYLON of diameter 1.5 mm, which is fixedly coupled at a looped end 1274 to forward housing portion engagement in engagement with a boss 1276 in first housing portion 1200, such as by placement of looped end 1274 over boss 1276, and serves to prevent disconnection of the flexible conduit 1116, as well as electrical cable 1242 and water supply conduit 1271, from the nozzle housing 1122 and from the pump portion 1110 (FIG. 19).

Flexible conduit 1116 is preferably mounted onto both first and second nozzle housing portions 1200 and 1202 by means of upper and lower mutually threaded coupling elements (not shown), which retain an end of flexible conduit 1116 under pressure from the threaded engagement therebetween. Lower coupling element is retained within first and second nozzle housing portions 1200 and 1202 by an inner-facing circumferential protrusion (not shown) formed at the interior of nozzle housing portions 1200 and 1202. Rotation of the lower coupling element and thus of the flexible conduit 1116 relative to first and second nozzle housing portions 1200 and 1202 is prevented by engagement of an internal protrusion (not shown) of the first housing portion 1200 with a corresponding slot (not shown) formed in lower coupling element (not shown).

Reference is now made to FIGS. 24A, 24B, 24C and 24D, which are simplified pictorial illustrations of four operational states of the spray control switch assembly of housing 1120, and to FIGS. 25A, 25B, 25C and 25D, which are simplified sectional illustrations corresponding to FIGS. 24A, 24B, 24C and 24D, taken along section lines B-B in FIG. 23A.

Figures 24A, 24B, 24C, 24D:
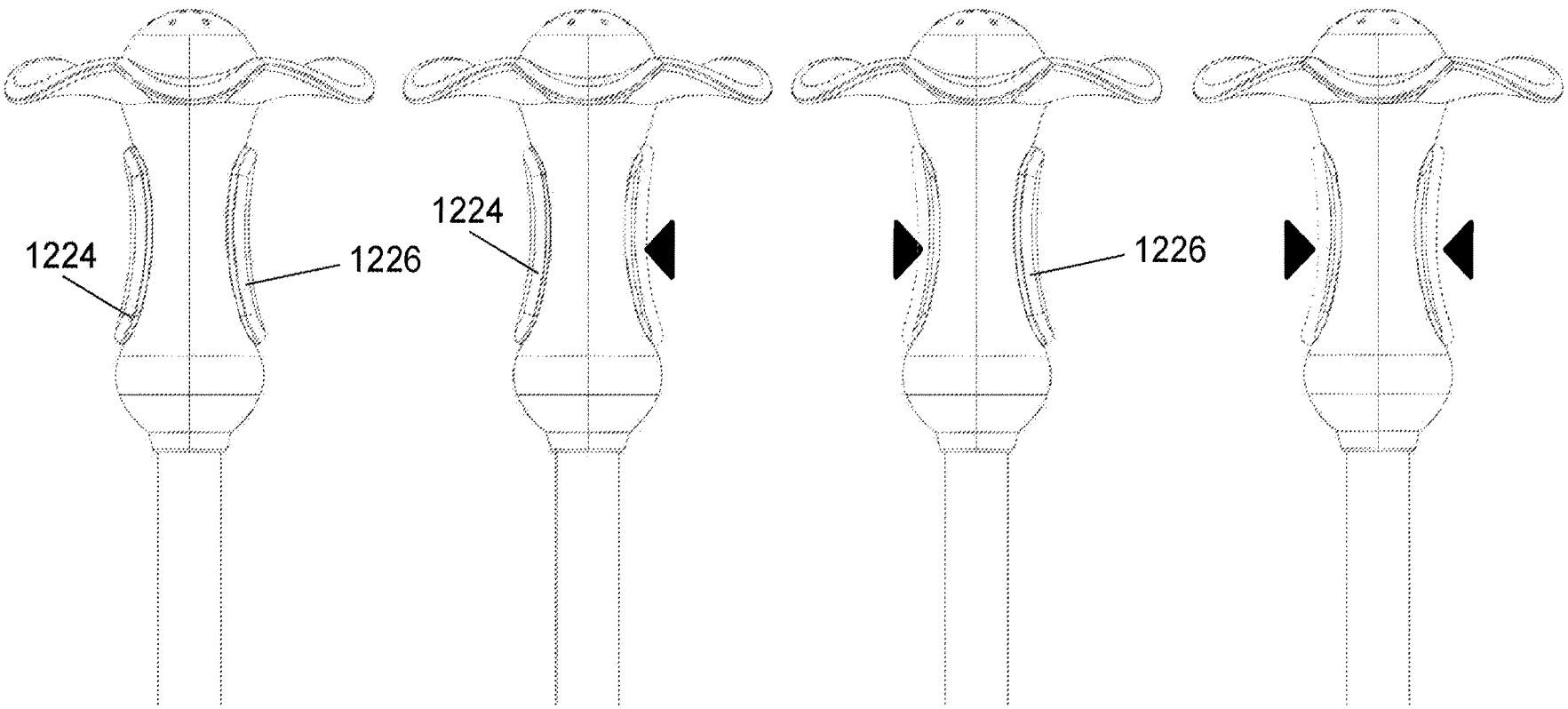
FIGS. 24A, 24B, 24C and 24D are simplified pictorial illustrations of four operational states of the spray control switch assembly of the nozzle portion in the embodiment of FIGS. 19-23A.

FIGS. 24A and 25A illustrate a first operative orientation wherein neither of push buttons 1226 and 1228 is pressed and the microswitch is not actuated and no spray is produced.

FIGS. 24B and 25B illustrate a second operative orientation wherein push button 1226 is pressed, causing protrusion 1270 to pushingly engage web portion 1250 and actuate microswitch 1241, thereby producing a spray.

FIGS. 24C and 25C illustrate a third operative orientation wherein push button 1224 is pressed, causing protrusion 1270 to pushingly engage web portion 1250 and actuate microswitch 1241, thereby producing a spray.

FIGS. 24D and 25D illustrate a fourth operative orientation wherein both push buttons 1224 and 1226 are simultaneously pressed, causing protrusion 1270 to pushingly engage web portion 1250 and actuate microswitch 1241, thereby producing a spray.

Reference is now made to FIGS. 26A, 26B and 26C, which are, respectively, a simplified partially cut-away illustration of the pump portion taken in a direction indicated by an arrow A in FIG. 19, a simplified sectional illustration of a pump portion of the combination pumped flow and gravitational flow bath toy system of FIG. 19, taken along lines B-B in FIG. 19, and a simplified exploded view illustration of the pump portion of FIGS. 26A and 26B.

As seen in FIGS. 26A-26C and as indicated hereinabove with reference to FIG. 19, pump portion 1110 is adapted to be immersed in water during operation and may be removably secured to a bottom of a bathtub (not shown) by a vacuum cup (not shown). Pump portion 1110 preferably includes an ON/OFF switch 1114, which is preferably adult operable and not child operable, and is coupled, via flexible conduit 1116, with nozzle portion 1120 (FIG. 19).

As seen in FIGS. 26A-26C, the pump portion 1110 includes left and right pump housing portions 1500 and 1501 and a bottom pump housing portion 1502, which together enclose an electrically operated water pump 1504, which receives water from outside the bottom pump housing portion 1502 via a filter 1505 at a water inlet 1506 as indicated by arrows 1507. Water pump 1504 is powered by electrical power from a water sealed battery pack 1508 including a threaded cover 1509. The operation of water pump 1504 is controlled by an electrical control assembly (not shown), which is coupled to an electrical supply from battery pack 1508 and receives control inputs via electrical cable 1242 and from ON/OFF switch 1114.

Flexible conduit 1116 is mounted onto pump portion 1110 by means of upper and lower coupling elements (not shown), which are mounted in left and right pump housing portions 1500 and 1501, preferably by screws (not shown) inserted through apertures (not shown) into bosses (not shown) formed in the interior of left and right pump housing portions 1500 and 1501. Mounting of flexible conduit to left and right pump housing portions 1500 and 1501 is similar to the mounting of flexible conduit to nozzle portion 1120 described hereinabove.

A looped end 1526 of security cable 1272 is fixedly secured to a protrusion 1528 and serves to prevent disconnection of the flexible conduit 1116, as well as electrical cable 1242 and water supply conduit 1271, from left and right pump housing portions 1500 and 1501.

Pump portion 1110 is rotatably attached to vacuum cup (not shown) by securing cap (not shown) and peg (not shown) which enable bottom pump housing portion 1502 to rotatably engage protrusion (not shown) on vacuum cup (not shown).

Reference is now made to FIG. 27, which is a simplified pictorial illustration of the pump portion of the embodiment of FIGS. 19-26C in a floating operative orientation. This embodiment may be identical to that of FIGS. 19-26C and simply may not be attached to the bottom of a bathtub or the like, or alternatively, it may be provided without any means for attachment. The embodiment of FIG. 27 preferably includes buoyant materials to render it floatable, which are preferably arranged so that the pump portion is not readily sinkable or listable.

Reference is now made to FIGS. 28A, 28B and 28C, which are respective simplified front and back view assembled illustrations and an exploded view illustration of a spray driven turbine water toy 1600, which may be used in cooperation with a pump and nozzle as shown in any of the embodiments of FIGS. 1-27 or without a pump, to FIGS. 29A and 29B, which are, respectively, a simplified pictorial illustration of a disassembled orientation and a simplified partially cut-away side view illustration showing that differently shaped turbine portions may be selectably removable and replaceable on correspondingly differently shaped hubs as in the embodiment of FIGS. 28A-28C, to provide a shape matching play experience, to FIGS. 30A, 30B, 30C and 30D, which are simplified pictorial illustrations illustrating rotation patterns realizable by the toy of the embodiment of FIGS. 28A-29B in response to differently directed water sprays thereon, and to FIGS. 31A, 31B and 31C, which illustrate three examples of removal of wheels from hubs in the embodiment of FIGS. 28A-30D.

As see in FIGS. 28A-31C, the spray driven turbine water toy preferably includes a base 1602, which is mountable on a wall as of a bathtub, preferably by suction cups 1604. Base 1604 preferably defines a plurality of mutually parallel rotation axles, typically three in number, as shown and designated by reference numerals 1612, 1614 and 1616. A plurality of hubs, here designated by reference numerals 1622, 1624 and 1626 are rotatably mounted on respective axles 1612, 1614 and 1616.

It is a particular feature of this embodiment of the present invention that each of the hubs 1622, 1624 and 1626 preferably has a different overall geometrical configuration, here seen to be typically a square, a circle and a triangle.

In accordance with a preferred embodiment of the present invention, a plurality of mutually interdigitated water spray drivable wheels, here preferably three wheels, 1632, 1634 and 1636, which can be removed and replaced by a young child onto corresponding hubs, respectively designated by reference numerals 1622, 1624 and 1626, by matching the internal circumferential shape of each of the wheels 1632, 1634 and 1636 with the corresponding outer circumferential shape of corresponding hubs 1622, 1634 and 1636.

It is a particular feature of the present invention that in the illustrated embodiment, each of the plurality of hubs 1622, 1624 and 1626 preferably has a different geometrical outer circumferential configuration, such as a square, a circle and a triangle. Accordingly, preferably each of the plurality of mutually interdigitated water spray drivable wheels 1632, 1634 and 1636 correspondingly has a different geometrical inner circumferential configuration corresponding to one of the geometrical outer circumferential configurations of the plurality of hubs, thus enabling one of the wheels 1632, 1634 and 1636 to be mounted by a child only onto a hub 1622, 1624 or 1626 having a corresponding geometrical configuration.

As seen in FIG. 30A, typically a spray of water onto wheels 1632 and 1634 causes wheel 1632 to rotate about its axis in a counterclockwise direction, wheel 1634 to rotate about its axis in a clockwise direction and wheel 1636 to rotate in a counterclockwise direction.

As seen in FIG. 30B, typically a spray of water onto wheel 1632 alone causes wheel 1632 to rotate about its axis in a clockwise direction, wheel 1634 to rotate about its axis in a counter clockwise direction and wheel 1636 to rotate in a clockwise direction.

As seen in FIG. 30C, typically a spray of water onto wheel 1636 alone causes wheel 1632 to rotate about its axis in a counterclockwise direction, wheel 1634 to rotate about its axis in a clockwise direction and wheel 1636 to rotate in a counterclockwise direction.

As seen in FIG. 30D, typically a spray of water onto wheel 1634 alone causes wheel 1632 to rotate about its axis in a clockwise direction, wheel 1634 to rotate about its axis in a counter clockwise direction and wheel 1636 to rotate in a clockwise direction.

As seen in FIG. 31A, typically a spray of water onto wheels 1632 and 1634 causes wheel 1632 to rotate about its axis in a counterclockwise direction and wheel 1634 to rotate about its axis in a clockwise direction even when wheel 1636 is removed from hub 1626.

As seen in FIG. 31B, typically a spray of water onto wheel 1634 alone causes wheel 1634 to rotate about its axis in a clockwise direction and wheel 1636 to rotate about its axis in a counterclockwise direction even when wheel 1632 is removed from hub 1622.

As seen in FIG. 31C, typically simultaneous sprays of water onto wheels 1632 and 1636 causes wheel 1632 to rotate about its axis in a clockwise direction and wheel 1636 to rotate in a counterclockwise direction, when wheel 1634 is removed from hub 1624.

Reference is now made to FIG. 32, which is a simplified illustration of operation of a toy 1650 similar to that shown in FIGS. 28A-31C by a bathtub mountable pump assembly 1652, which provides a pressurized flow of water in a direction indicated by an arrow 1654.

Reference is now made to FIGS. 33A and 33B, which illustrate two operative orientations of a finger modulated spray nozzle 1700, which may be incorporated, for example, in the embodiment of FIGS. 19-27, to FIGS. 34A and 34B, which are simplified sectional illustrations illustrating water flows corresponding to the two operative orientations of FIGS. 33A and 33B.

As seen in FIGS. 33A-34B, an upward water flow, indicated by arrows 1702 passes directly upward and out through a relatively large central aperture 1704, as indicated by an arrow 1706. As long as aperture 1704 is unblocked, water does not exit from peripheral apertures 1708 which surround aperture 1704 and which are smaller and not aligned with the water flow indicated by arrows 1702.

When the water flow through aperture 1704 is fully or partly blocked, as seen in FIGS. 33B and 34B, as by a finger, water pressure builds up in a chamber 1710, as indicated by arrows 1712, underlying aperture 1704 and peripheral apertures 1708 and results in a water spray, as indicated by arrows 1716, from peripheral apertures 1708.

Reference is now made to FIGS. 35A and 35B, which illustrate two operative orientations of a finger modulated spray nozzle, which may be incorporated, for example, in the bathtub mountable pump assembly of FIG. 32 and in the embodiment of FIGS. 19-27, and to FIGS. 36A and 36B, which are simplified sectional illustrations illustrating water flows corresponding to the two operative orientations of FIGS. 35A and 35B.

As seen in FIGS. 35A and 36A, a downward water flow, indicated by arrows 1722, passes directly through the pump assembly and out through a relatively large central aperture 1724, as indicated by an arrow 1726. As long as aperture 1724 is unblocked, water does not exit from peripheral apertures 1728 which surround aperture 1724 and which are smaller and not aligned with the water flow indicated by arrows 1722.

When the water flow through aperture 1724 is fully or partly blocked, as seen in FIGS. 35B and 36B, as by a finger, water pressure builds up in a chamber 1730 overlying aperture 1724, as indicated by arrows 1731, and peripheral apertures 1728 and results in a water spray, as indicated by arrows 1732, from peripheral apertures 1728.

Reference is now made to FIGS. 37A, 37B and 37C, which illustrate three operative orientations of a nozzle element modulated spray nozzle, which may be incorporated, for example, in the embodiment of FIGS. 19-27, to FIG. 38, which is a simplified exploded view illustration of a portion of the nozzle element modulated spray nozzle of FIGS. 37A-37C, to FIGS. 39A and 39B, which are simplified sectional illustrations illustrating water flows corresponding to the operative orientations of FIGS. 37A and 37C.

As seen in FIGS. 37A-39B, a pressurized water conduit 1750 is coupled to a water pressure chamber 1752, which receives a pressurized flow of water from conduit 1750. Water pressure chamber 1752 is provided with a large central outlet aperture 1754, which is normally blocked by a pivotably mounted blocking element 1756, and with a plurality of relatively small peripheral outlet apertures 1758, through which water normally flows out of the nozzle element, as seen in FIGS. 37A and 39A.

As seen in FIGS. 37C and 39B, when the pivotably mounted blocking element 1757 is forced to pivot to a non-flow blocking position, as by an hollow outlet element 1760, which is fully inserted, as seen in FIG. 37B, into central outlet aperture 1754, a relatively strong pressurized stream of water passes through hollow outlet element 1760 and no water passes through peripheral outlet apertures 1758, since the water flow to them is blocked by the hollow outlet element 1760, as clearly seen in FIG. 39B.

Reference is now made to FIGS. 40A, 40B and 40C, which illustrate three operative orientations of a nozzle element modulated spray nozzle 1770 forming part of a floating water toy 1772, and to FIGS. 41A and 41B, which are simplified sectional illustrations illustrating water flows corresponding to the operative orientations of FIGS. 40A and 40C.

As seen in FIGS. 40A-41B, the floating toy includes a floating platform 1774, which preferably is non-sinkable and non-listable by virtue of including suitably positioned buoyant material 1776 therein.

A pressurized water conduit 1780 is coupled to a water pressure chamber 1782, which receives a pressurized flow of water via conduit 1780 from a pump 1784. Water pressure chamber 1782 is provided with a large central outlet aperture 1786, which is normally blocked by a pivotably mounted blocking element 1788, and with a plurality of relatively small peripheral outlet apertures 1790, through which water normally flows out of the nozzle element, as seen in FIGS. 40A and 41A.

As seen in FIGS. 40C and 41B, when the pivotably mounted blocking element 1788 is forced to pivot to a non-flow blocking position, as by an hollow outlet element 1792, which is fully inserted as seen in FIG. 40B, into central outlet aperture 1786, a relatively strong pressurized stream of water passes through hollow outlet element 1792 and no water passes through peripheral outlet apertures 1790, since the water flow to them is blocked by the hollow outlet element 1792, as clearly seen in FIG. 40B.

It is appreciated that the structures of normally blocking a central outlet aperture or selectively blocking the central outlet aperture by a finger may be used interchangeably in all applicable embodiments of the invention.

It will be appreciated by persons skilled in the art that the present invention is not limited to what has been particularly shown and described hereinabove and includes various combinations and subcombinations of features which are described hereinabove with reference to the drawings, notwithstanding that the features are not shown in various combinations. Thus, for example, the embodiment of FIGS. 14A-18B may be employed in the water toy of FIG. 13B. Accordingly, the scope of the present invention is not limited by the description above or by the claims which follow but rather includes combinations and subcombinations of features described hereinabove which would occur to persons skilled in the art upon reading the foregoing and which are not in the prior art.

The invention claimed is:

1. A water toy comprising:

a source of pressurized water in the form of a pump;

a water sealed battery pack electrically coupled to said pump;

a pump housing enclosing said pump and said water sealed battery pack; and a nozzle coupled to said source of pressurized water and said nozzle having a plurality of nozzle outlets including at least one principal nozzle outlet and at least one secondary nozzle outlet which are interconnected with said source of pressurized water such that when said at least one principal nozzle outlet is not closed, water from said pump is expelled only from said at least one principal outlet and water from said pump is expelled from said at least one secondary nozzle outlet only when said at least one principal outlet is closed.

2. The water toy according to claim 1 and wherein said at least one principal nozzle outlet is normally open, so that water from said pump is expelled from said at least one principal nozzle outlet and water from said pump is not expelled from said at least one secondary nozzle outlet.

3. The water toy according to claim 2 and wherein said at least one principal nozzle outlet is manually blockable by a child, so that when at least one principal nozzle outlet is blocked, by said child, said water is not expelled from said at least one principal nozzle outlet and water is expelled from said at least one secondary nozzle outlet.

4. The water toy according to claim 1 and wherein said at least one principal nozzle outlet is normally closed, whereby water from said pump is expelled from said at least one secondary outlet and water from said pump is not expelled from said at least one principal outlet.

5. The water toy according to claim 4 and wherein said at least one principal nozzle outlet is normally closed by a blocking element.

6. The water toy according to claim 5 and wherein said blocking element comprises a pivotably mounted blocking element.

7. The water toy according to claim 6 and wherein said pivotably mounted blocking element pivots from a flow blocking position to a non-flow blocking position.

8. The water toy according to claim 4 and wherein said at least one principal nozzle outlet is manually openable by a child, so that when said at least one principal nozzle outlet is opened, by said child, water is not expelled from said at least one secondary outlet and water is expelled from said at least one principal outlet.

9. The water toy according to claim 1 further comprising:

a suction cup coupled to said pump housing such that said pump housing is configured to be submerged in a vessel containing water and coupled to a bottom or a sidewall of said vessel via said suction cup.

10. The water toy according to claim 1 and wherein said pump and said nozzle are assembled into a floatable platform and said floatable platform has buoyant material so that said floatable platform is configured to be submerged in water.

11. The water toy according to claim 10 and wherein said floating platform comprises a non-sinkable and non-listable floating platform.

12. The water toy according to claim 10 and wherein said floating platform comprises buoyant material at predetermined locations therein.

13. The water toy according to claim 10 and wherein said at least one principal nozzle outlet is upwardly facing on said floatable platform.

14. The water toy according to claim 13, wherein said at least one principal nozzle outlet is normally closed by a blocking element.

15. The water toy according to claim 9 and wherein said at least one principal nozzle outlet is downwardly facing.

16. The water toy according to claim 15 and wherein said source of pressurized water is a mountable pump assembly.

17. The water toy according to claim 1 and wherein:

said pump is submersible and coupled to a flexible conduit for providing a pressurized water flow therethrough; and said nozzle is a child hand holdable water spray nozzle coupled to said flexible conduit configured to receive said pressurized water flow and having a child hand operable water flow switch including a pair of oppositely directed squeezable button elements governing output of water through said nozzle from said pressurized water flow, said child hand operable water flow switch being electrically connected to an electrical water flow controller and to said water sealed battery pack via an electrical conductor conduit extending through said flexible conduit.

18. The water toy according to claim 1 and further comprising:

at least first and second water inlets for receiving a flow of water from said nozzle;

at least first and second generally vertical water conduits coupled to respective ones of said at least first and second water inlets for directing a gravity flow of water therethrough from said respective ones of said first and second water inlets; and at least first and second generally horizontal water conduits coupled to respective ones of said at least first and second generally vertical water conduits for directing a gravity flow of water therethrough from said respective ones of said first and second water inlets and via respective ones of said at least first and second generally vertical water conduits, said at least first and second generally horizontal water conduits being arranged such that said gravity flow of water therethrough is in generally opposite directions.

19. The water toy according to claim 1 and also comprising:

a water receptacle arranged to receive a flow of water from said nozzle;

a first water conduit coupled to said water receptacle;

a first water turbine driven by a gravity flow of water from said water receptacle via said first water conduit and driving a visually sensible fanciful moving display;

a second water conduit receiving water from said first water receptacle; and a second water turbine driven by a gravity flow of water from said water receptacle via said second water conduit, said second water turbine being visible and child engageable and stoppable.

20. The water toy according to claim 1 and also comprising a chamber receiving pressurized water from said source of pressurized water when said at least one principal nozzle outlet is blocked.

21. The water toy according to claim 20 and wherein said at least one secondary nozzle outlet receives pressurized water from said chamber when said at least one principal nozzle outlet is blocked.

22. The water toy according to claim 1 and wherein said at least one principal nozzle outlet is aligned with a water flow path defined by said source of pressurized water.

23. The water toy according to claim 1 and wherein said at least one secondary nozzle outlet is not aligned with a water flow path defined by said source of pressurized water.

* * * * *